US012108920B2

(12) United States Patent
Conrad

(10) Patent No.: US 12,108,920 B2
(45) Date of Patent: Oct. 8, 2024

(54) HAND VACUUM CLEANER

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

(21) Appl. No.: 17/374,502

(22) Filed: Jul. 13, 2021

(65) Prior Publication Data

US 2023/0017024 A1 Jan. 19, 2023

(51) Int. Cl.

| | |
|---|---|
| ***A47L 5/24*** | (2006.01) |
| ***A47L 9/12*** | (2006.01) |
| ***A47L 9/16*** | (2006.01) |
| ***A47L 9/28*** | (2006.01) |
| ***A47L 9/32*** | (2006.01) |

(52) U.S. Cl.

CPC ..... *A47L 5/24* (2013.01); *A47L 9/127* (2013.01); *A47L 9/1683* (2013.01); *A47L 9/2884* (2013.01); *A47L 9/322* (2013.01)

(58) Field of Classification Search

CPC ... A47L 5/24; A47L 9/10; A47L 9/102; A47L 9/2868; A47L 9/322

See application file for complete search history.

(56) References Cited

U.S. PATENT DOCUMENTS

| | | | | |
|---|---|---|---|---|
| 8,302,250 | B2 | 11/2012 | Dyson et al. | |
| 8,950,039 | B2 | 2/2015 | Conrad | |
| 9,232,881 | B2 | 1/2016 | Conrad | |
| 9,451,853 | B2 | 9/2016 | Conrad et al. | |
| 9,591,952 | B2 * | 3/2017 | Conrad | A47L 9/106 |
| 9,591,958 | B2 | 3/2017 | Conrad | |
| 9,888,817 | B2 | 2/2018 | Conrad | |
| 9,962,047 | B2 | 5/2018 | Brown et al. | |
| 9,986,880 | B2 | 6/2018 | Conrad | |
| 10,264,934 | B2 | 4/2019 | Conrad | |
| 10,405,708 | B2 * | 9/2019 | Dimbylow | A47L 9/242 |
| 10,433,687 | B2 | 10/2019 | Dimbylow | |

(Continued)

FOREIGN PATENT DOCUMENTS

| | | | |
|---|---|---|---|
| CN | 107343774 | A | 11/2017 |
| CN | 108024674 | A | 5/2018 |

(Continued)

OTHER PUBLICATIONS

PE2E Translation CN 109330476; Yin, Xue-bing; Feb. 15, 2019; p. 1-15 (Year: 2019).*

(Continued)

*Primary Examiner* — Laura C Guidotti
*Assistant Examiner* — Sidney D Full
(74) *Attorney, Agent, or Firm* — Philip C. Mendes Da Costa; BERESKIN & PARR LLP/S.E.N.C.R.L., s.r.l.

(57) ABSTRACT

A hand vacuum cleaner has an air flow path extending from a dirty air inlet to a clean air outlet. An air treatment member and suction motor are positioned in the air flow path. The air treatment member is provided at the front end of the hand vacuum cleaner and has an air outlet provided at the rear end of the air treatment member. A pre-motor filter housing is provided rearward of the air treatment member. A pistol grip handle has an upper end that is mounted to the pre-motor filter housing.

27 Claims, 66 Drawing Sheets

(56) References Cited

U.S. PATENT DOCUMENTS

| | | | | |
|---|---|---|---|---|
| 10,595,691 | B2 | 3/2020 | Dimbylow et al. | |
| 10,722,086 | B2 | 7/2020 | Conrad | |
| 10,806,317 | B2 | 10/2020 | Conrad | |
| 11,013,378 | B2 | 5/2021 | Conrad | |
| 11,116,375 | B2 * | 9/2021 | King | A47L 9/32 |
| 2008/0196194 | A1 * | 8/2008 | Conrad | A47L 5/24 15/353 |
| 2017/0071426 | A1 * | 3/2017 | Krebs | A47L 9/22 |
| 2018/0177353 | A1 * | 6/2018 | Conrad | A47L 9/1633 |
| 2019/0008346 | A1 * | 1/2019 | Conrad | A47L 9/2884 |
| 2019/0090701 | A1 | 3/2019 | Tonderys et al. | |
| 2019/0290082 | A1 | 9/2019 | Conrad | |
| 2019/0320863 | A1 * | 10/2019 | Conrad | A47L 9/322 |
| 2019/0328188 | A1 * | 10/2019 | Conrad | A47L 9/1608 |
| 2020/0383544 | A1 | 12/2020 | Conrad | |
| 2021/0045596 | A1 | 2/2021 | Conrad et al. | |
| 2022/0151446 | A1 | 5/2022 | Conrad et al. | |
| 2022/0369879 | A1 * | 11/2022 | Tang | A47L 9/1608 |
| 2023/0301478 | A1 * | 9/2023 | Escalettes | A47L 9/127 15/344 |
| 2023/0307478 | A1 * | 9/2023 | Mao | H01L 27/14629 |
| 2024/0023774 | A1 | 1/2024 | Hyun et al. | |
| 2024/0130584 | A1 * | 4/2024 | Dussek | A47L 9/125 |

FOREIGN PATENT DOCUMENTS

| | | | | | |
|---|---|---|---|---|---|
| CN | 108652518 | A | * | 10/2018 | A47L 5/24 |
| CN | 109330476 | A | * | 2/2019 | A47L 5/24 |
| CN | 110664299 | A | * | 1/2020 | |
| CN | 111345729 | A | * | 6/2020 | A47L 5/24 |
| CN | 211324701 | U | | 8/2020 | |
| CN | 211459996 | U | | 9/2020 | |
| CN | 212307697 | U | | 1/2021 | |
| CN | 213883037 | U | | 8/2021 | |
| EP | 3954262 | A1 | | 2/2022 | |
| EP | 4091517 | A1 | | 11/2022 | |
| GB | 2542387 | A | | 3/2017 | |
| JP | 48054459 | U | | 7/1973 | |
| JP | 55088757 | U | | 6/1980 | |
| KR | 20200024292 | A | * | 3/2020 | A47L 9/102 |
| WO | WO-2020006182 | A1 | * | 1/2020 | A47L 5/24 |
| WO | 2020099832 | A1 | | 5/2020 | |
| WO | 2022096846 | A1 | | 5/2022 | |

OTHER PUBLICATIONS

Translation CN110664299; Huang, Yue-Lin; Cleaning Device and the Dust Collector; Jan. 10, 2020 (Year: 2020).*

PE2E Translation KR-20200024292-A; Handheld Vacuum Cleaners; Howard, Percy Rain Charles; Mar. 6, 2020 (Year: 2020).*

PE2E Translation CN-108652518-A; Hand-hold Vacuum Cleaner; Xu, Yuan-fe; Oct. 16, 2018 (Year: 2018).*

PE2E Translation CN-111345729; A Hand-held Dust Collector; Feng, Yong-bing; Jun. 30, 2020 (Year: 2020).*

Espacenet: English machine translation of CN212307697U, publishe don Jan. 8, 2021.

Espacenet: English machine translation of CN211459996U, published on Sep. 11, 2020.

Espacenet: English machine translation of CN108024674A, published on May 11, 2018.

Google Patents: English machine translation of CN107343774A, published on Nov. 14, 2017.

International Search Report and Written Opinion, received in connection to international patent application No. PCT/CA2022/050940, mailed on Aug. 12, 2022.

"Dyson Cyclone V10 Absolute", Web page <https://www.dyson.co.uk/vacuum-cleaners/cordless/v10/absolute#>, cited in the Search and Examination Report, received in connection to GB patent application No. GB2209088.0, mailed on Nov. 9, 2022.

English machine translation of CN213883037, published on Aug. 6, 2021.

The Combined Search and Examination report under Section 17 and 18(3), received in connection to GB2209088.0, issued by the U.K. Intellectual Property Office, mailed on Nov. 9, 2022.

English machine translation of CN211324701U, published on Aug. 25, 2020.

Combined Search and Examination Report under Section 17 and 18(3), mailed on Mar. 5, 2024, in connection to copending GB patent application No. GB2209088.0.

* cited by examiner

HAND VACUUM CLEANER

FIELD

This disclosure relates generally to surface cleaning apparatus. In a preferred embodiment, the surface cleaning apparatus comprises a portable surface cleaning apparatus, such as a hand vacuum cleaner.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuums. Further, various designs for cyclonic hand vacuum cleaners, including battery operated cyclonic hand vacuum cleaners, are known in the art.

SUMMARY

This summary is intended to introduce the reader to the more detailed description that follows and not to limit or define any claimed or as yet unclaimed invention. One or more inventions may reside in any combination or subcombination of the elements or process steps disclosed in any part of this document including its claims and figures.

In accordance with one aspect of this disclosure, which may be used alone or in combination with any other aspect, a hand vacuum cleaner has a pistol grip handle provided at the rear end of the hand vacuum cleaner and a finger grip area positioned between the pistol grip handle and the rear side of a forwardly positioned air treatment member. A body portion houses one or more heavier operating components of the hand vacuum cleaner, such as the first energy storage member and the suction motor and/or the power supply and the suction motor. The body portion overlies at least one of the finger grip area and the upper end of the pistol grip handle. This configuration of the heavier components of the hand vacuum cleaner and the pistol grip handle provides enhanced ergonomics.

The hand vacuum cleaner may include one or more second energy storage members to enhance cleaning power and/or lengthen time between charges. For example, the one or more second energy members may be positioned in the body portion, in the pistol grip handle, at the lower end of the pistol grip handle, at the upper end of the pistol grip handle or a combination thereof.

Alternately, or in addition, the hand vacuum cleaner includes a power supply to convert alternating current (supplied by household mains (electrical outlets)) to direct current for charging the first energy storage member (and/or the one or more second energy storage members) and/or providing power to the motor. For example, the power supply may be positioned in the body portion, in the pistol grip handle, at the lower end of the pistol grip handle, or at the upper end of the pistol grip handle.

In accordance with this aspect, there is provided a hand vacuum cleaner having a front end and a rear end, the hand vacuum cleaner comprising:

a) an air flow path extending from a dirty air inlet to a clean air outlet with a suction motor provided in the air flow path;

b) an air treatment member provided in the air flow path at the front end of the hand vacuum cleaner, the air treatment member having an upper end, a lower end, an air inlet provided at the upper end and an air outlet provided at the upper end;

c) a pistol grip handle provided at the rear end of the hand vacuum cleaner, wherein a finger grip area is positioned between the pistol grip handle and a rear side of the air treatment member; and, d) a body portion positioned overlying at least one of the finger grip area and an upper end of the pistol grip handle;

wherein a first energy storage member and the suction motor are provided in the body portion.

In accordance with this aspect, there is also provided a hand vacuum cleaner having a front end and a rear end, the hand vacuum cleaner comprising:

a) an air flow path extending from a dirty air inlet to a clean air outlet with a suction motor provided in the air flow path;

b) an air treatment member provided in the air flow path at the front end of the hand vacuum cleaner, the air treatment member having an upper end, a lower end, an air inlet provided at the upper end and an air outlet provided at the upper end;

c) a pistol grip handle provided at the rear end of the hand vacuum cleaner, wherein a finger grip area is positioned between the pistol grip handle and a rear side of the air treatment member; and, d) a body portion positioned overlying at least one of the finger grip area and an upper end of the pistol grip handle;

wherein the suction motor and a power supply are provided in the body portion.

In accordance with another aspect of this disclosure, which may be used alone or in combination with any other aspect, a hand vacuum cleaner has a pistol grip handle that is provided at the rear end of the hand vacuum cleaner. A finger grip area is positioned between the pistol grip handle and the rear side of the air treatment member. A body portion which houses the suction motor overlies at least one of the finger grip area and the upper end of the pistol grip handle. A first energy storage member is positioned forward of the suction motor. This configuration of the heavier components of the hand vacuum cleaner and the pistol grip handle provides enhanced ergonomics.

The hand vacuum cleaner may include one or more second energy storage members to enhance cleaning power and/or lengthen time between charges. For example, the one or more second energy members may be positioned in the body portion, in the pistol grip handle, at the lower end of the pistol grip handle, at the upper end of the pistol grip handle, or a combination thereof.

Alternately, or in addition, the hand vacuum cleaner may include a power supply to convert alternating current (supplied by electrical outlets) to direct current for the energy storage member (and/or the one or more second energy storage members). For example, the power supply may be positioned in the body portion, in the pistol grip handle, at the lower end of the pistol grip handle, or at the upper end of the pistol grip handle.

In accordance with this aspect, there is provided a hand vacuum cleaner having a front end and a rear end, the hand vacuum cleaner comprising:

a) an air flow path extending from a dirty air inlet to a clean air outlet with a suction motor provided in the air flow path;

b) an air treatment member provided in the air flow path at the front end of the hand vacuum cleaner, the air treatment member having an upper end, a lower end, an air inlet provided at the upper end and an air outlet provided at the upper end;

c) a pistol grip handle provided at the rear end of the hand vacuum cleaner, wherein a finger grip area is positioned between the pistol grip handle and a rear side of the air treatment member; and, d) a body portion positioned overlying at least one of the finger grip area and an upper end of the pistol grip handle;

wherein the suction motor is provided in the body portion and a first energy storage member is positioned forward of the suction motor.

In accordance with another aspect of this disclosure, which may be used alone or in combination with any other aspect, a hand vacuum cleaner has a pre-motor filter housing that is positioned rearward of the air treatment member. A pistol grip handle has an upper end that is mounted to the pre-motor filter housing. The suction motor may be rearward of the pre-motor filter housing. Accordingly, the handle may be further forward. This configuration provides enhanced ergonomics.

The hand vacuum cleaner may include one or more energy storage members to supply power to the suction motor. For example, the one or more energy storage members are positioned in the pistol grip handle, at the lower end of the pistol grip handle, radially outward of the suction motor, rearward of the pre-motor filter housing, or a combination thereof.

Alternately, or in addition, the hand vacuum cleaner may include a power supply to convert alternating current (supplied by household mains (electrical outlets)) to direct current for charging the first energy storage member (and/or the one or more second energy storage members) and/or providing power to the motor. For example, the power supply may be positioned in the body portion, in the pistol grip handle, at the lower end of the pistol grip handle, or at the upper end of the pistol grip handle.

In accordance with this aspect, there is provided a hand vacuum cleaner having a front end and a rear end, the hand vacuum cleaner comprising:

a) an air flow path extending from a dirty air inlet to a clean air outlet with a suction motor provided in the air flow path;

b) an air treatment member provided in the air flow path at the front end of the hand vacuum cleaner, the air treatment member having an upper end, a lower end, a front end, a rear end, an air inlet and an air outlet provided at the rear end of the air treatment member;

c) a pre-motor filter housing provided rearward of the air treatment member; and, d) a pistol grip handle having an upper end that is mounted to the pre-motor filter housing.

In accordance with another aspect of this disclosure, which may be used alone or in combination with any other aspect, a hand vacuum cleaner has a pre-motor filter that is positioned rearward of an air treatment chamber and at least one energy storage member that is positioned rearward of the pre-motor filter housing and radially outwardly of at least two of the upper end, the lower end, the first lateral side and the second lateral side of a suction motor housing. This configuration of the heavier components of the hand vacuum cleaner and the pistol grip handle provides enhanced ergonomics.

In accordance with this aspect, there is provided a hand vacuum cleaner having a front end and a rear end, the hand vacuum cleaner comprising:

a) an air flow path extending from a dirty air inlet to a clean air outlet with a suction motor provided in the air flow path;

b) an air treatment member provided in the air flow path at the front end of the hand vacuum cleaner, the air treatment member having an upper end, a lower end, a front end, a rear end, an air inlet and an air outlet provided at the rear end of the air treatment member;

c) a pre-motor filter housing provided rearward of the air treatment member;

d) a handle;

e) a suction motor housing, which houses the suction motor, positioned rearward of the pre-motor filter housing, the suction motor housing having an upper end, a lower end, a first lateral side extending between the upper and lower ends of the suction motor housing and a second lateral side that is opposed to the first lateral side and that extends between the upper and lower ends of the suction motor housing; and, f) at least one first energy storage member positioned rearward of the pre-motor filter housing and radially outwardly of at least two of the upper end, the lower end, the first lateral side and the second lateral side of the suction motor housing.

In accordance with another aspect of this disclosure, which may be used alone or in combination with any other aspect, a hand vacuum cleaner includes an air treatment member having a rear air outlet, a pre-motor filter housing that is positioned rearward of the air treatment member and at least one energy storage member that is positioned rearward of the pre-motor filter housing. This configuration provides enhanced ergonomics.

In accordance with this aspect, there is also provided a hand vacuum cleaner having a front end and a rear end, the hand vacuum cleaner comprising:

a) an air flow path extending from a dirty air inlet to a clean air outlet with a suction motor provided in the air flow path;

b) an air treatment member provided in the air flow path at the front end of the hand vacuum cleaner, the air treatment member having an upper end, a lower end, a front end, a rear end, an air inlet and an air outlet provided at the rear end of the air treatment member;

c) a pre-motor filter housing provided rearward of the air treatment member;

d) a pistol grip handle;

e) a suction motor housing, which houses the suction motor, positioned rearward of the pre-motor filter housing; and, f) at least one first energy storage member positioned rearward of the pre-motor filter housing.

In accordance with another aspect of this disclosure, which may be used alone or in combination with any other aspect, a hand vacuum cleaner has a recess that is provided at an upper end of a pistol grip handle. The recess houses, and optionally removably receives, part or all of an energy storage member pack. This configuration of the heavier components of the hand vacuum cleaner and the pistol grip handle provides enhanced ergonomics.

In accordance with this aspect, there is provided a hand vacuum cleaner having a front end and a rear end, the hand vacuum cleaner comprising:

a) an air flow path extending from a dirty air inlet to a clean air outlet with a suction motor provided in the air flow path;

b) an air treatment assembly provided in the air flow path at the front end of the hand vacuum cleaner, the air treatment assembly having an upper end, a lower end, a front end, a rear end, an air inlet and an air outlet provided at the rear end of the air treatment assembly;

c) a body portion, which houses the suction motor;

d) a pistol grip handle; and, e) a recess which removably receives an energy storage member pack provided at an upper end of the pistol grip handle.

In accordance with another aspect of this disclosure, which may be used alone or in combination with any other aspect, a hand vacuum cleaner has a pistol grip handle that has a front side that receives the fingers of a user, a rear side that receives the palm of a user, and first and second lateral sides which each extend between the front side and the rear side of the pistol grip handle. A first energy storage member is provided on the first lateral side of the pistol grip handle and/or a second energy storage member is provided on the second lateral side of the pistol grip handle. This configuration of the heavier components of the hand vacuum cleaner and the pistol grip handle provides enhanced ergonomics.

In some embodiments, the first and second energy storage members are provided in a single removable battery pack. This configuration facilitates attachment and detachment of the first and second battery storage members.

In accordance with this aspect, there is provided a hand vacuum cleaner having a front end and a rear end, the hand vacuum cleaner comprising:

a) an air flow path extending from a dirty air inlet to a clean air outlet with a suction motor provided in the air flow path;

b) an air treatment assembly provided in the air flow path at the front end of the hand vacuum cleaner, the air treatment assembly having an upper end, a lower end, a front end, a rear end, an air inlet and an air outlet;

c) a pistol grip handle having a front side that receives the fingers of a user, a rear side that receives the palm of a user, and first and second lateral sides which each extend between the front side and the rear side of the pistol grip handle; and, d) a first energy storage member provided on the first lateral side of the pistol grip handle and a second energy storage member provided on the second lateral side of the pistol grip handle.

In accordance with another aspect of this disclosure, which may be used alone or in combination with any other aspect, a hand vacuum cleaner has at least one energy storage member that is positioned radially outwardly of the suction motor housing. A handle is mounted to an upper end of the hand vacuum cleaner. This configuration of the heavier components of the hand vacuum cleaner and the pistol grip handle provides enhanced ergonomics.

In accordance with this aspect, there is provided a hand vacuum cleaner having a front end and a rear end, the hand vacuum cleaner comprising:

a) an air flow path extending from a dirty air inlet to a clean air outlet with a suction motor provided in the air flow path;

b) an air treatment assembly provided in the air flow path at the front end of the hand vacuum cleaner, the air treatment assembly having an upper end, a lower end, a front end, a rear end, an air inlet and an air outlet provided at the rear end of the air treatment assembly;

c) a suction motor housing, which houses the suction motor, positioned rearward of the air treatment assembly, the suction motor housing having an upper end, a lower end, a first lateral side extending between the upper and lower ends of the suction motor housing and a second lateral side that is opposed to the first lateral side and that extends between the upper and lower ends of the suction motor housing;

d) at least one first energy storage member positioned radially outwardly of the suction motor housing; and, e) a handle mounted to an upper end of the hand vacuum cleaner.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
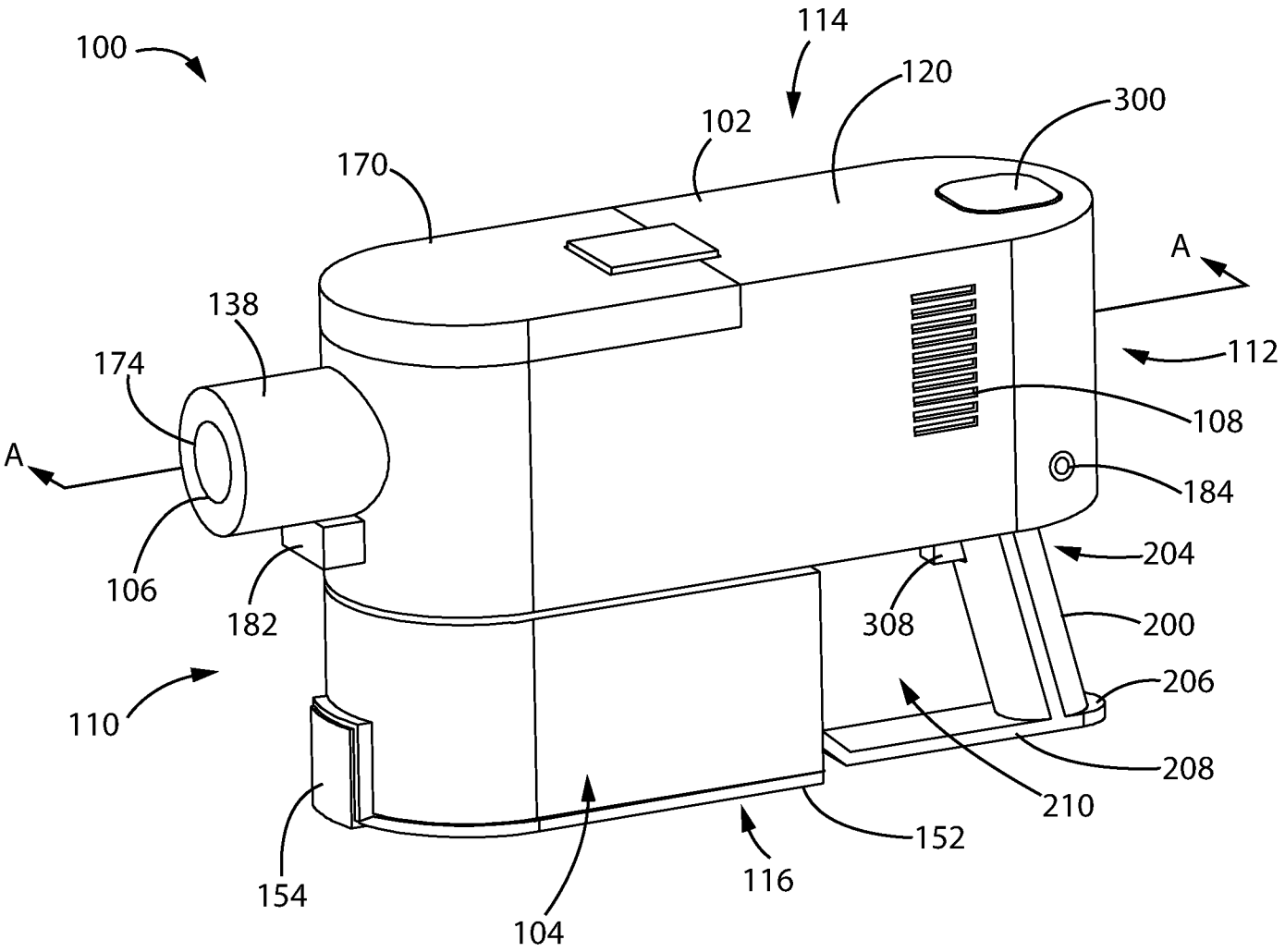
FIG. 1 is a side perspective view of an example hand vacuum cleaner with an energy storage member positioned above the handle.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatus, methods and compositions are described below to provide an example of an embodiment of each claimed invention. No embodiment described below limits any claimed invention and any claimed invention may cover apparatuses and methods that differ from those described below. The claimed inventions are not limited to apparatus, methods and compositions having all of the features of any one apparatus, method or composition described below or to features common to multiple or all of the apparatus, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened"

where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

As used herein and in the claims, two elements are said to be "parallel" where those elements are parallel and spaced apart, or where those elements are collinear.

Some elements herein may be identified by a part number, which is composed of a base number followed by an alphabetical or subscript-numerical suffix (e.g., 300*a*, or $\mathbf{300}_1$). Multiple elements herein may be identified by part numbers that share a base number in common and that differ by their suffixes (e.g., $\mathbf{300}_1$, $\mathbf{300}_2$, and $\mathbf{300}_3$). All elements with a common base number may be referred to collectively or generically using the base number without a suffix (e.g., 300).

It should be noted that terms of degree such as "substantially", "about" and "approximately" as used herein mean a reasonable amount of deviation of the modified term such that the end result is not significantly changed. These terms of degree may also be construed as including a deviation of the modified term, such as by 1%, 2%, 5% or 10%, for example, if this deviation does not negate the meaning of the term it modifies. For example, the expressions "substantially perpendicular" and "substantially parallel" mean within 10% of perpendicular and parallel, respectively.

General Description of a Hand Vacuum Cleaner

Referring to FIGS. 1-4, an exemplary embodiment of a surface cleaning apparatus is shown generally as 100. The following is a general discussion of surface cleaning apparatus 100, which provides a basis for understanding several of the features that are discussed herein. As discussed subsequently, each of the features may be used individually or in any particular combination or sub-combination in this or in other embodiments disclosed herein.

In the illustrated embodiment, surface cleaning apparatus 100 is a hand vacuum cleaner. As used herein, a hand vacuum cleaner is a vacuum cleaner that can be operated to clean a surface generally one-handedly. That is, the entire weight of the hand vacuum cleaner may be held by the same hand as the one used to direct a dirty air inlet of the hand vacuum cleaner with respect to a surface to be cleaned. For example, the handle and the dirty air inlet of the hand vacuum cleaner may be rigidly coupled to each other (directly or indirectly) so as to move as one while maintaining a constant orientation relative to each other. This is to be contrasted with canister and upright vacuum cleaners, whose weight is typically supported by a surface (e.g., a floor) during use. When a canister vacuum cleaner is operated or when an upright vacuum cleaner is operated in a 'lift-away' configuration, a second hand is typically required to direct the dirty air inlet at the end of a flexible hose.

Surface cleaning apparatus 100 includes a main body 102 having an air treatment assembly 104 (which may be permanently affixed to main body 102 or may be removable in part or in whole therefrom for emptying, and optionally is removable as a sealed air treatment assembly 104 other than the air treatment assembly air inlet and the air treatment assembly air outlet), a dirty air inlet 106, a clean air outlet 108, and an air flow path extending between dirty air inlet 106 and clean air outlet 108.

Surface cleaning apparatus 100 has a front end 110, a rear end 112, an upper end 114, and a lower end 116. In the illustrated embodiment, dirty air inlet 106 is at an upper portion of front end 110 and clean air outlet 108 is at a rearward portion of main body 102. It will be appreciated that dirty air inlet 106 and clean air outlet 108 may be provided in different locations.

A suction motor 118 is positioned in the air flow path to generate vacuum suction through the air flow path. Suction motor 118 is positioned within a body portion 120 (which may be part of the main body 102). The suction motor 118 may be provided in body portion 120 of main body 102 and, optionally, a suction motor housing 119 may be provided in body portion 120. Suction motor 118 may be a fan-motor assembly including an electric motor and impeller blade(s). Suction motor 118 defines a motor axis 122 (about which the impeller rotates). In the illustrated embodiment, suction motor 118 is positioned downstream of air treatment assembly 104. In this configuration, suction motor 118 may be referred to as a "clean air motor". Alternatively, suction motor 118 may be positioned at alternate locations, such as upstream of air treatment assembly 104 in which case it may be referred to as a "dirty air motor".

Suction motor 118 may be oriented in any direction. For example, when surface cleaning apparatus 100 is oriented with the upper end 114 above the lower end 116, e.g., positioned substantially parallel to a horizontal surface, motor axis 122 may be oriented horizontally (as exemplified in FIG. 2) or vertically (as exemplified in FIG. 6). In alternative embodiments, suction motor 118 may be oriented at any angle between horizontal and vertical. As described below, suction motor 118 may have various positional arrangements, which may improve the ergonomics of the hand vacuum cleaner 100 (e.g., reduced weight, better weight balance, or greater portability).

Air treatment assembly 104 is configured to remove particles of dirt and other debris from the air flow. Air treatment assembly 104 may comprise one or more cyclonic stages, each of which may comprise a single cyclone or a plurality of cyclones in parallel. Each cyclonic stage may have a single dirt collection chamber or a plurality of dirt collection chambers. The dirt collection chamber(s) may be external to the cyclone chamber or may be internal the cyclone chamber and configured as a dirt collection area or region within the cyclone chamber. Alternatively, air treatment assembly 104 need not include a cyclonic cleaning stage, and can comprise any air treatment chamber known in the vacuum cleaner arts and/or may optionally incorporate a bag, a porous physical filter media (such as foam or felt), or other air treating means.

As exemplified in FIGS. 1-4, air treatment assembly 104 utilizes an air treatment chamber that is a cyclone chamber 124 that has an external dirt collection chamber 126. Cyclone chamber 124 has first and second cyclone ends 128, 130 and a cyclone sidewall 132 that extends between first and second cyclone ends 128, 130. Cyclone chamber 124 has a cyclone axis 134 that extends between first and second cyclone ends 128, 130.

Cyclone chamber 124 may be oriented in any direction. As exemplified in FIG. 2, when hand vacuum cleaner 100 is oriented with the upper end 114 above the lower end 116, e.g., positioned substantially parallel to a horizontal surface, cyclone axis 134 may be oriented vertically. In these configurations, first and second cyclone ends 128, 130 may be referred to as cyclone upper and lower ends 128, 130, respectively. Alternatively, as exemplified in FIG. 29, when hand vacuum cleaner 100 is oriented with upper end 114 above lower end 116, e.g., positioned substantially parallel to a horizontal surface, cyclone axis 134 may be oriented horizontally. In these configurations, first and second cyclone ends 128, 130 may be referred to as cyclone front and rear ends 128, 130, respectively. In alternative embodiments, cyclone chamber 124 may be oriented at any angle between horizontal and vertical.

Air circulates about cyclone axis 134 when in cyclone chamber 124. Accordingly, cyclone axis 134 is alternatively referred to herein as a "cyclone axis of rotation". Cyclone chamber 124 includes a cyclone air inlet 136 in fluid communication with an inlet conduit 138, a cyclone air outlet 140, and a dirt outlet 142 that is in communication with the dirt collection chamber 126. As exemplified in FIG. 2, cyclone chamber 124 may have a single dirt outlet 142. Alternatively, cyclone chamber 124 may include two or more dirt outlets that are in communication with the same dirt collection chamber, or optionally with different dirt collection chambers.

Cyclone air inlet 136, cyclone air outlet 140 and dirt outlet 142 may be of any design and positioning that is known in the art. Preferably, cyclone air inlet 136 is generally tangentially oriented relative to cyclone sidewall 132, so that air entering the cyclone chamber 124 will tend to swirl and circulate within cyclone chamber 124, thereby disentraining dirt and debris from the air flow, before leaving cyclone chamber 124 through cyclone air outlet 140.

Cyclone chamber 124 may optionally be a 'uniflow' cyclone chamber (i.e., where the cyclone air inlet and cyclone air outlet are at opposite ends of the cyclone chamber). Alternatively, cyclone chamber 124 may provide bidirectional air flow (i.e., where the cyclone air inlet and cyclone air outlet are at the same end of the cyclone chamber). In the illustrated embodiments, cyclone chamber 124 uses bidirectional air flow. As exemplified in FIG. 2, cyclone air inlet 136 and cyclone air outlet 140 may be both provided at cyclone upper end 128. As exemplified in FIG. 29, cyclone air inlet 136 and cyclone air outlet 140 may be both provided at cyclone rear end 130. Optionally, cyclone chamber 124 may be an inverted cyclone chamber with the cyclone air inlet 136 and cyclone air outlet 140 provided at the lower end.

Figure 2:
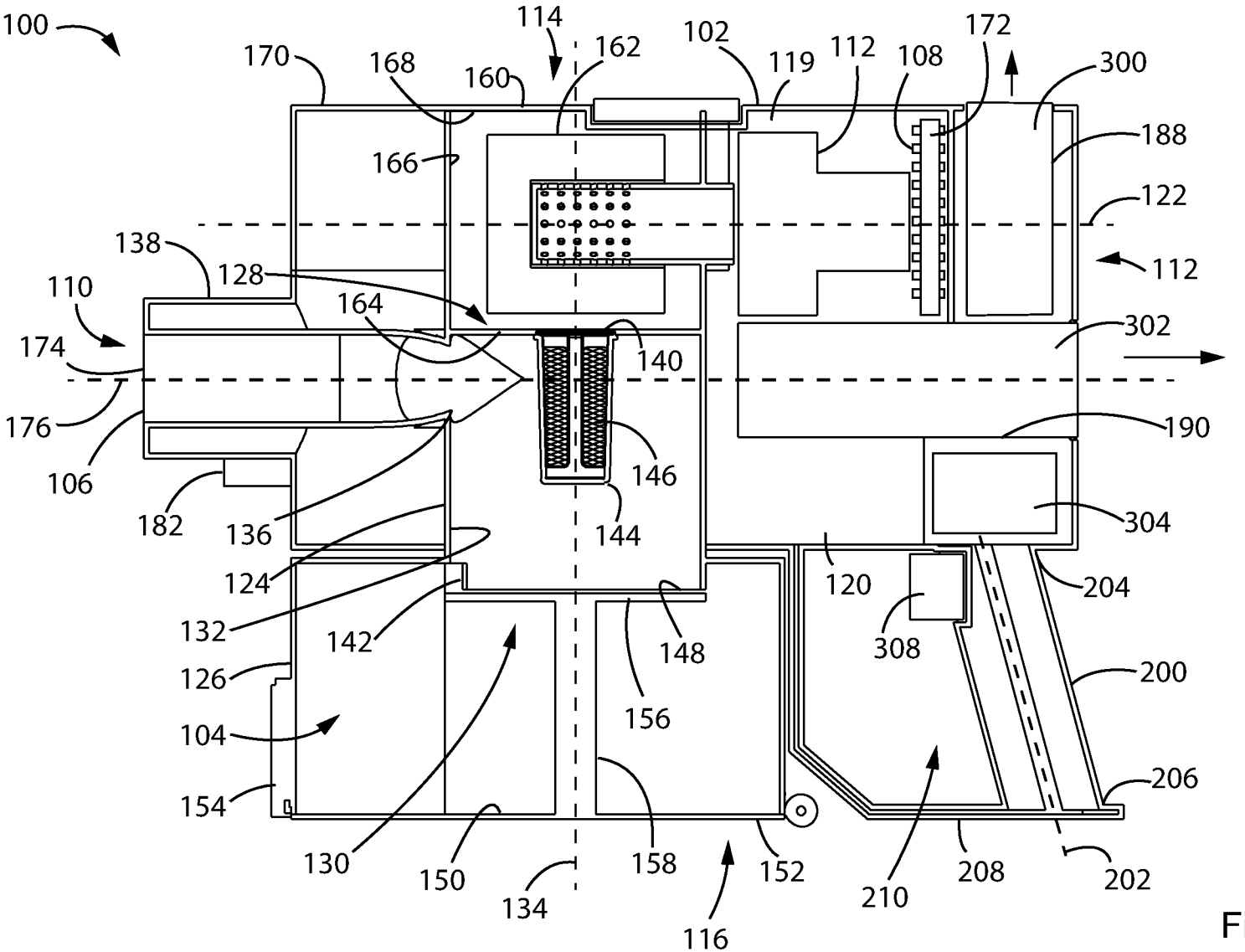
FIG. 2 is a cross-sectional view taken along line A-A of FIG. 1.

As exemplified in FIG. 2, dirt collection chamber 126 may be external to cyclone chamber 124 (i.e., dirt collection chamber 126 may have a discrete volume from that of cyclone chamber 124 and in communication with cyclone chamber 124 through dirt outlet 142). In such an embodiment, the dirt outlet 142 may be at any location. For example, it may be at the same end as the air treatment chamber air outlet. Alternately, as exemplified in FIG. 2, the dirt outlet 142 is vertically spaced apart cyclone air inlet 136 and cyclone air outlet 140.

Figure 31:
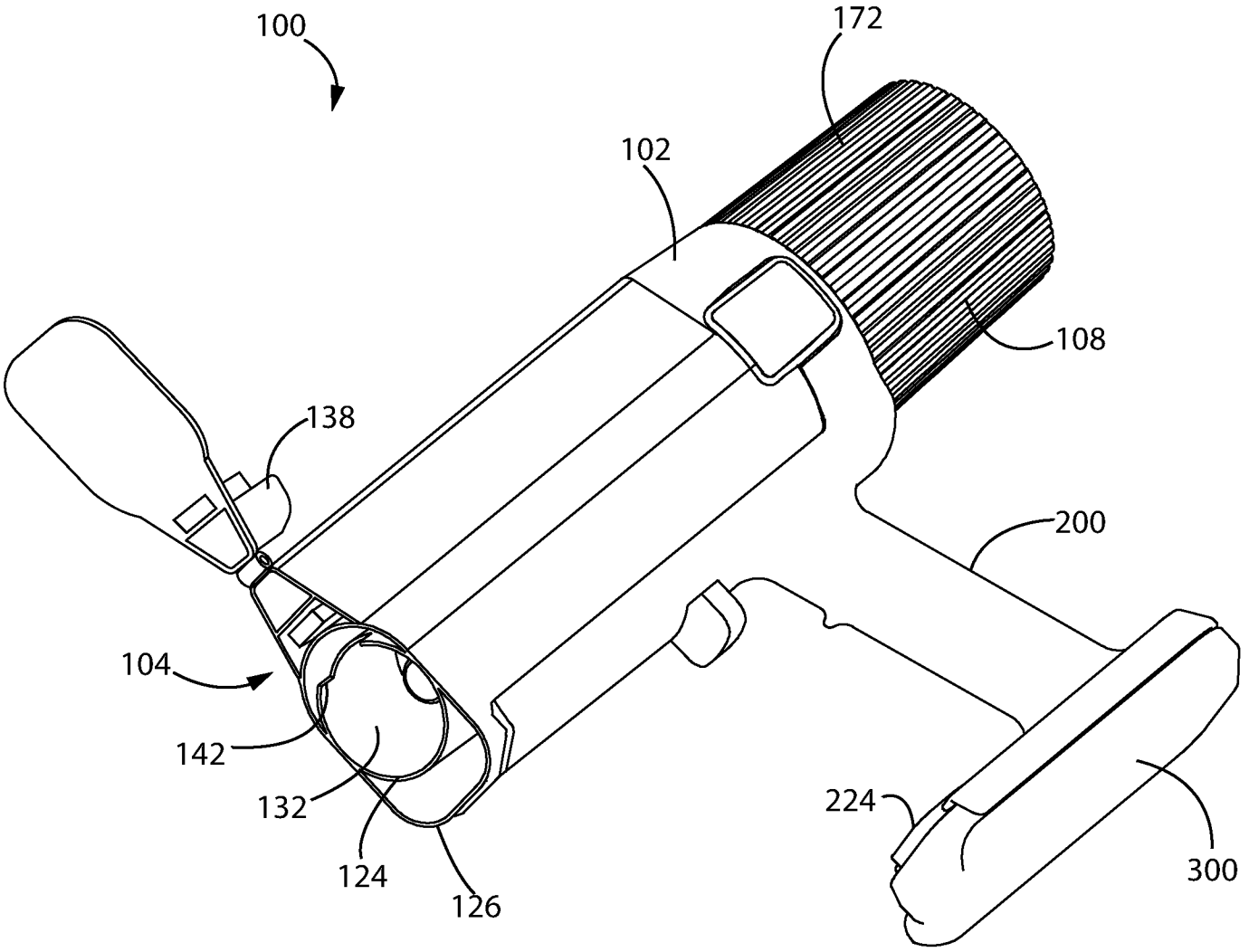
FIG. 31 is a front perspective view of the hand vacuum cleaner of FIG. 28 with the front door in an open position.

Cyclone chamber 124 and dirt collection chamber 126 may be of any configuration suitable for separating dirt from an air stream and collecting the separated dirt respectively and cyclone air inlet 136 and cyclone air outlet 140 may be of any design and position known in the art. As exemplified in FIG. 2, dirt collection chamber 126 may be positioned below cyclone chamber 124 when hand vacuum cleaner 100 is oriented with the upper end 114 above the lower end 116. Alternatively, or in addition, dirt collection chamber 126 may surround part of all of cyclone chamber 124 (see, e.g., FIG. 31).

In the illustrated embodiment, cyclone air outlet 140 includes a vortex finder 144. As exemplified in FIG. 2, the vortex finder 144 may consist of or comprise a mesh screen 146 to help filter lint, fluff, and other debris, such as hair, that remains in the exiting air flow. Mesh screen 146 may extend inwardly into the cyclone chamber from a solid outlet conduit.

Preferably, at least a portion of air treatment assembly 104 may be openable for emptying. For example, at least one end (e.g., the bottom end as exemplified in FIG. 3 or the front end as exemplified in FIG. 31) may be openable. Optionally both ends of treatment assembly 104 may also be openable for emptying. The openable end may open the dirt collection chamber and/or the air treatment chamber.

Figure 3:
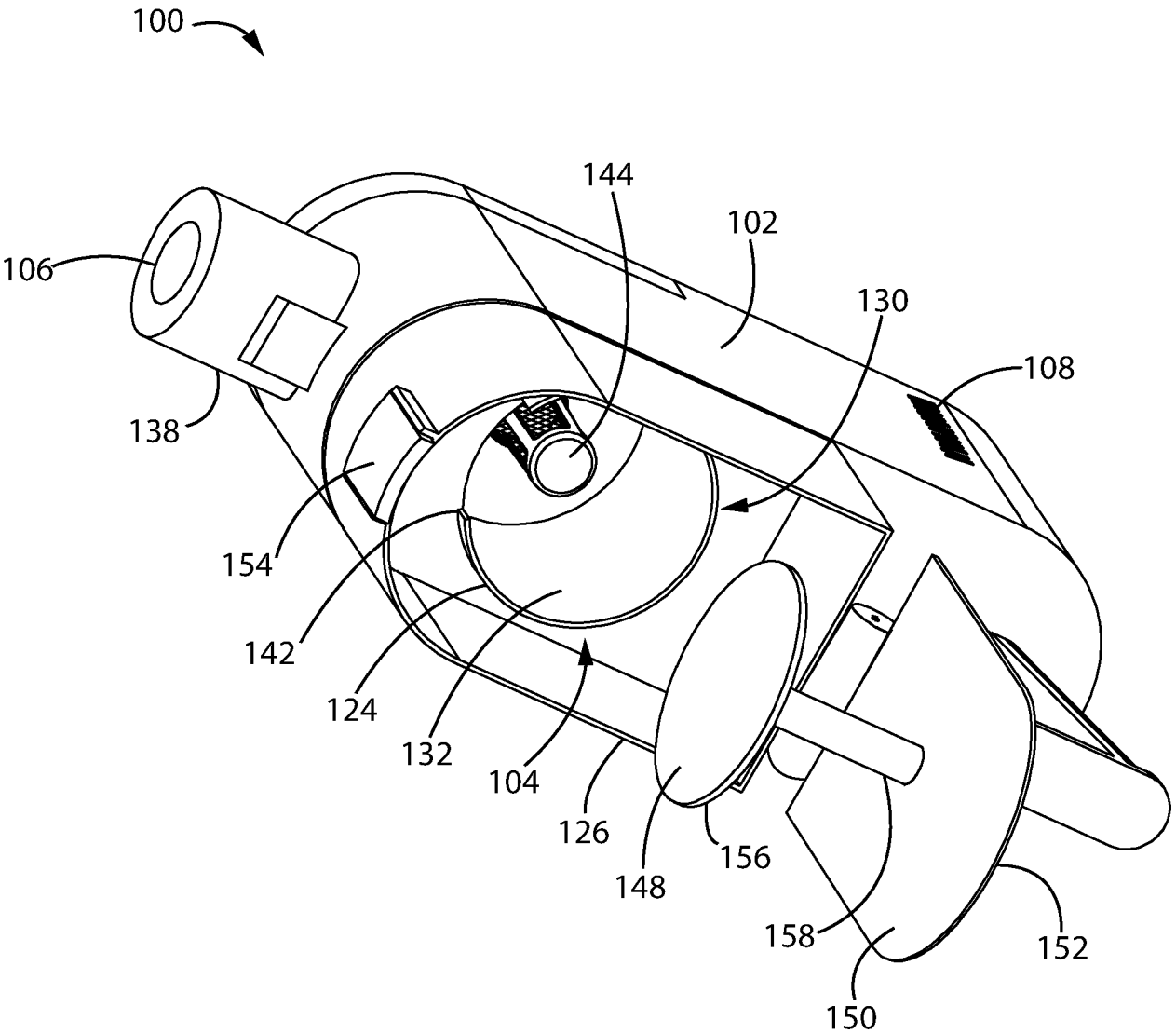
FIG. 3 is a bottom perspective view of the hand vacuum cleaner of FIG. 1 with the bottom door in an open position.
Figure 4:
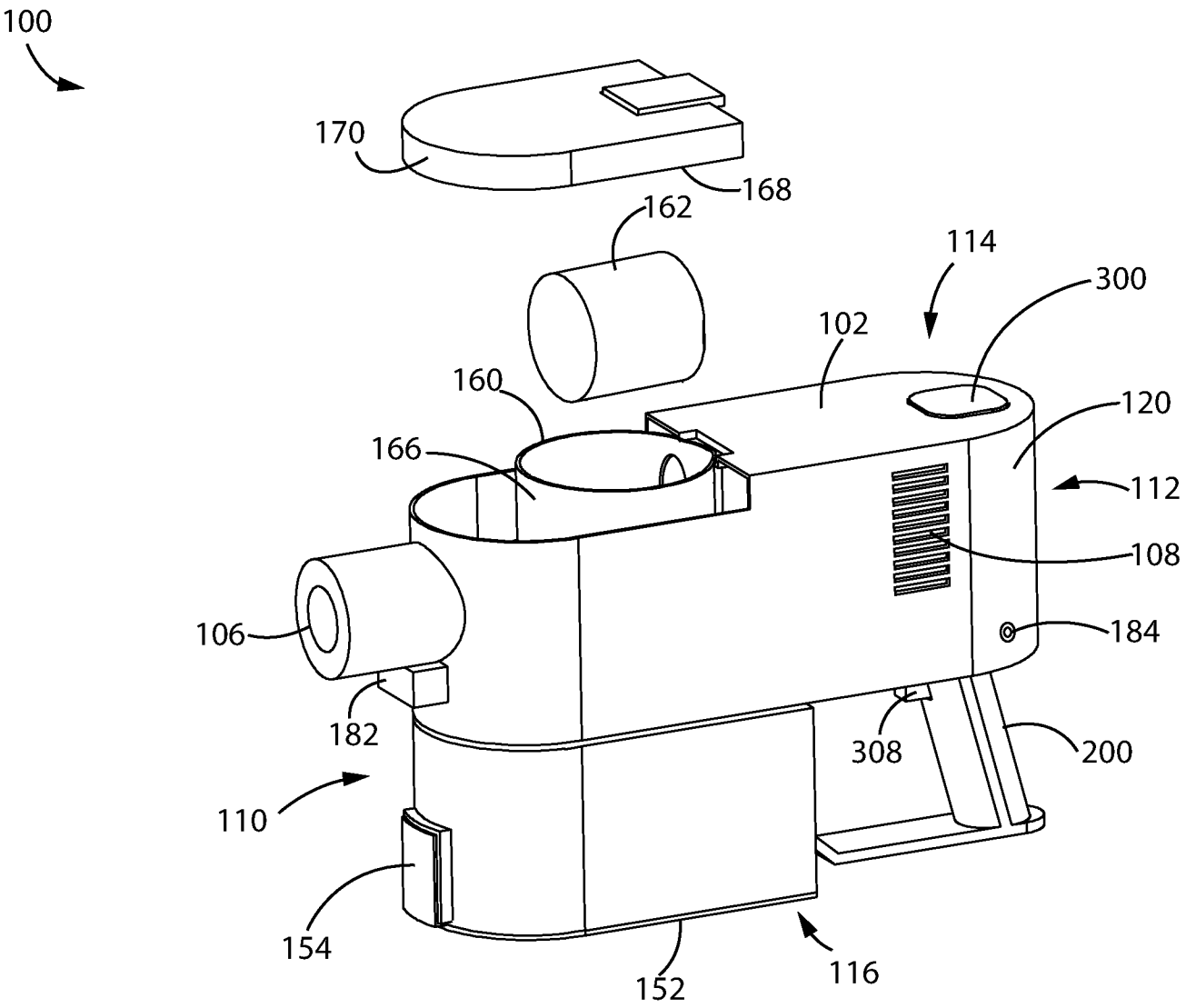
FIG. 4 is a partially exploded perspective view of the hand vacuum cleaner of FIG. 1.

In the illustrated embodiment of FIG. 3, the bottom end wall 148 of cyclone chamber 124 and the bottom end wall 150 of dirt collection chamber 126 and are both provided by portions of an openable bottom door 152. In this arrangement, opening bottom door 152 concurrently opens bottom end walls 148, 150 of cyclone and dirt collection chambers 124, 126. Bottom door 152 may be movably connected (e.g., pivotally openable or removably mounted) to air treatment assembly 104 using any suitable mechanism, including a hinge or other suitable device. Optionally, bottom door 152 may be secured in the closed position using any suitable type of locking mechanism. As exemplified in FIG. 1, bottom door 152 may be held in the closed position by a latch 154 that may be released by a user. It will be appreciated that the openable end of an air treatment chamber or the air treatment assembly may comprise or consist of an end wall. It will also be appreciated that if an external dirt collection chamber is provided, that the air treatment chamber and the dirt collection chamber are concurrently openable.

As exemplified in FIG. 2, a deflector or arrestor plate 156 may be positioned at cyclone lower end 130, at the interface between cyclone chamber 124 and dirt collection chamber 126. In such an embodiment, the dirt outlet 142 may be provided by one or more gaps between the arrestor plate 156 and the end of the sidewall 132 of the cyclone chamber 124. Alternately, the arrester plate 156 may about the end of the cyclone sidewall 132 and the sidewall may have a slot which defines the dirt outlet 142. Accordingly, for example, arrester plate 156 may be sized to cover substantially all of cyclone lower end 130, and to abut the lower end of cyclone sidewall 132 to form bottom end wall 148 of cyclone chamber 124. When arrestor plate 156 abuts the lower end of cyclone sidewall 132 it may define part of the gaps or slots that form dirt outlet 142. For example, dirt outlet 142 may be bounded on three sides by cyclone sidewall 132 and on a fourth side by arrestor plate 156. Alternatively, cyclone sidewall 132 may be spaced apart from arrestor plate 156 and the dirt outlet is defined by the gap between the arrester plate 156 and the end of the cyclone sidewall 132.

Optionally, arrestor plate 156 may be fixed in its position with respect to cyclone sidewall 132 or may be moveable or openable. Providing an openable arrestor plate 156 may help facilitate emptying of cyclone chamber 124. Optionally, arrestor plate 156 may be openable concurrently with another portion of the surface cleaning apparatus, including, for example, dirt collection chamber 126.

In the illustrated embodiment, arrestor plate 156 is mounted to and supported spaced from bottom end wall 150 of dirt collection chamber 126 by a support member 158. Support member 158 may be of any suitable configuration and may be formed from any suitable material that is capable of supporting arrestor plate 156 and resisting stresses exerted on arrestor plate 156 by the air flow in cyclone chamber 124 or dirt particles exiting cyclone chamber 124. In this configuration, arrestor plate 156 is movable concurrently with bottom end wall 150 of dirt collection chamber 126, so that opening bottom end wall 150 simultaneously opens cyclone chamber 124 and dirt collection chamber 126. Alternatively, arrestor plate 156 may be mounted to cyclone sidewall 132 (or other portion of the surface cleaning apparatus) and need not open in unison with bottom end wall 150 of dirt collection chamber 126.

Optionally, one or more pre-motor filters may be placed in the air flow path between air treatment assembly 104 and suction motor 118. In the illustrated embodiment of FIG. 2, hand vacuum cleaner 100 includes a pre-motor filter housing 160 provided in the air flow path downstream of air treatment assembly 104 and upstream of suction motor 118. As exemplified, pre-motor filter housing 160 may be provided as a portion of main body 102, above air treatment assembly 104. Alternatively, pre-motor filter housing 160 may be provided elsewhere between air treatment assembly 104 and suction motor 118 (e.g., pre-motor filter housing 160 may be rearward of air treatment assembly 104 as exemplified in FIG. 29).

Pre-motor filter housing 160 may be of any suitable construction, including any of those exemplified herein. One or more pre-motor filters 162 may be positioned within pre-motor filter housing 160. Pre-motor filter(s) 162 may be formed from any suitable physical, porous filter media and having any suitable shape, including the examples disclosed herein with respect to a removable pre-motor filter assembly. For example, pre-motor filter 162 may be one or more of a foam filter, felt filter, HEPA filter, other physical filter media, electrostatic filter, and the like.

In some embodiments, at least a portion of pre-motor filter 162 may be positioned overlying at least a portion of air treatment assembly 104. In some embodiments, at least 50% (e.g., 50%, 60%, 70%, 80%, 90% or more) of pre-motor filter 162 may be positioned overlying air treatment assembly 104. As an example, the illustrated embodiment of FIG. 2 shows 100% of pre-motor filter 162 overlying air treatment assembly 104.

The diameter or length of the pre-motor filter 162 in a plane transverse to the cyclone axis of rotation 134 may be least 50% (e.g., 50%, 60%, 70%, 80%, 90%, 100% or more) of the diameter or length of the air treatment assembly 104 in the same plane.

As exemplified in FIG. 2, pre-motor filter housing 160 may be bounded by a bottom wall 164, a sidewall 166 and an upper wall 168. In the illustrated embodiment, upper wall 168 is provided by an upper cover 170. Preferably, at least one of bottom wall 164, sidewall 166 and upper cover 170 are openable to allow access to the interior of pre-motor filter housing 160. In the illustrated embodiment, upper cover 170 is removable (see FIG. 4) to provide access to the interior of pre-motor filter housing 160. Alternatively, instead of being removable, upper cover 170 may be pivotally openable or otherwise moveably coupled to main body 102.

Alternately, if the air treatment assembly is removable, then the pre-motor filter 162 may be accessible when the air treatment assembly is removed. For example, pre-motor filter housing 160 may be removable from main body 102 with the air treatment assembly 104. For example, pre-motor filter housing 160 and air treatment assembly 104 may be detachably mounted to main body 102. Alternately, pre-motor filter housing 160 may remain in place with main body 102 when air treatment assembly 104 is removed. For example, air treatment assembly 104 may be detachably mounted by itself to main body 102 and optionally to pre-motor filter housing 160.

Optionally, one or more post-motor filters may be positioned in the air flow path between suction motor 118 and clean air outlet 108 to help further treat the air passing through the hand vacuum cleaner 100. As exemplified in FIG. 2, hand vacuum cleaner 100 may include an optional post-motor filter 172 provided in the air flow path downstream of suction motor 118 and upstream of clean air outlet 108. In the illustrated embodiment, post-motor filter 172 is provided in body portion 120, rearward of suction motor 118. As described herein below, various alternative positions of post-motor filter 172 are possible. Post-motor filter 172 may be formed from any suitable physical, porous filter media for filtering air in the airflow path downstream of suction motor 118 and may be of any suitable shape. Post-motor filter 172 may be any suitable type of filter such as one or more of a foam filter, felt filter, HEPA filter, other physical filter media, electrostatic filter, and the like. Clean air outlet 108 may form part of an optional post-motor filter housing.

Inlet conduit 138 extends from dirty air inlet 106 to cyclone air inlet 136. In the illustrated embodiment, dirty air inlet 106 of hand vacuum cleaner 100 is an inlet end 174 of inlet conduit 138. Optionally, inlet end 174 of inlet conduit 138 can be used as a nozzle to directly clean a surface. Inlet conduit 138 is, in this example, a generally linear hollow member that extends along an inlet conduit axis 176 that is oriented in a longitudinal forward/rearward direction and is generally horizontal when hand vacuum cleaner 100 is oriented with the upper end 114 above the lower end 116. Alternatively, or in addition to functioning as a nozzle, inlet conduit 138 may be connectable or directly connectable to the downstream end of any suitable accessory tool such as a rigid air flow conduit (e.g., an above floor cleaning wand), a crevice tool, a mini brush, and the like.

Figure 48:
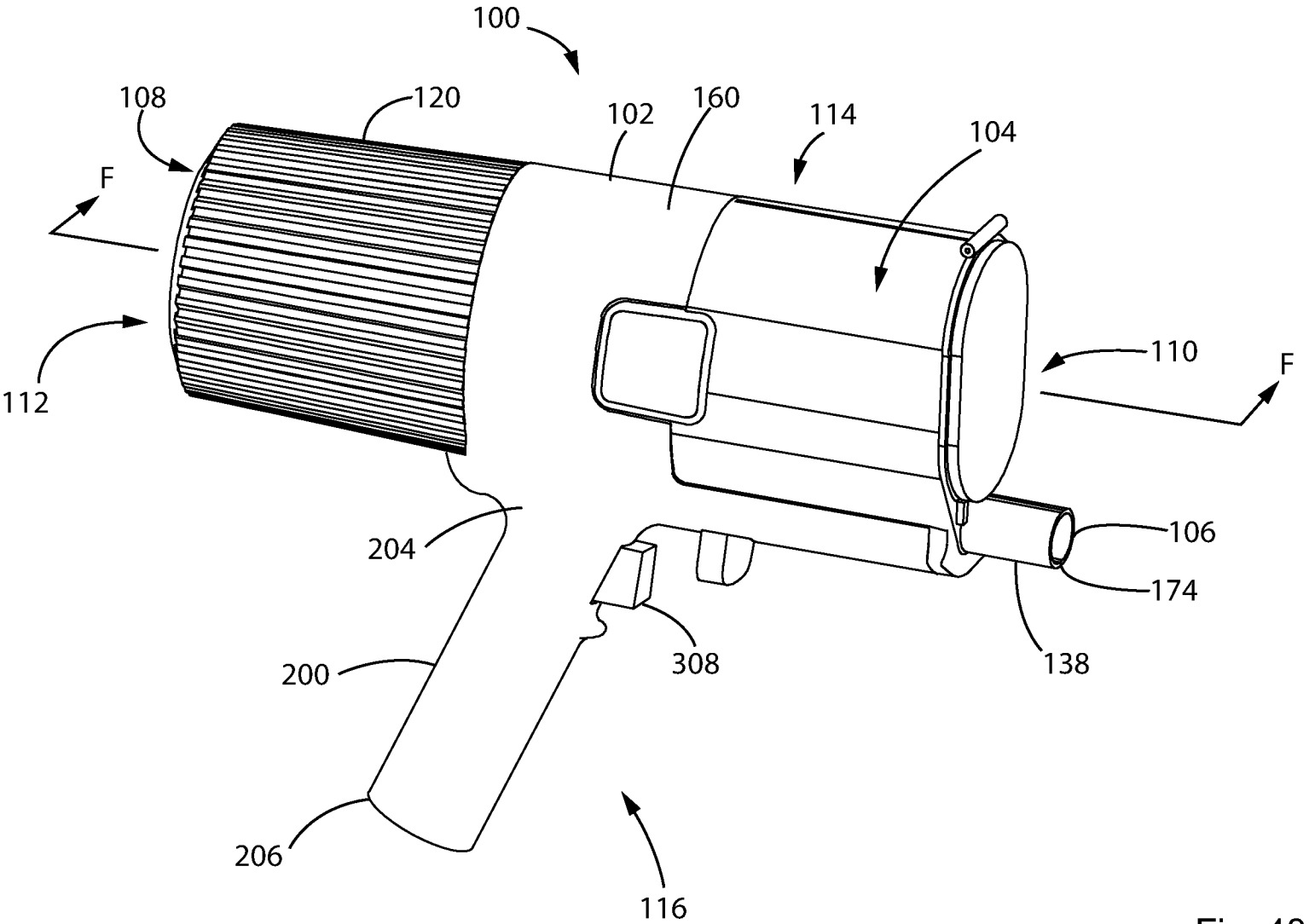
FIG. 48 is a side perspective view of an example hand vacuum cleaner with a pistol grip handle mounted to the pre-motor filter housing.

FIGS. 1-4 exemplify an inlet conduit 138 positioned forward of air treatment assembly 104 and at an upper end of the hand vacuum cleaner. In this configuration, inlet conduit axis 176 intersects body portion 120 (see FIG. 2). Alternatively, in the illustrated embodiment of FIGS. 29 and 30, inlet conduit 138 may be positioned above air treatment assembly 104 when hand vacuum cleaner 100 is oriented with the upper end 114 above the lower end 116. In this configuration inlet conduit axis 176 intersects pre-motor filter housing 160. Alternatively, in the illustrated embodiment of FIGS. 48 and 49, inlet conduit 138 may be positioned below air treatment assembly 104 when hand vacuum cleaner 100 is oriented with the upper end 114 above the lower end 116. In this configuration, inlet conduit axis 176 intersects pre-motor filter housing 160. In some embodiments, inlet conduit axis 176 may intersect both suction motor 118 and first energy storage pack 300 (see, e.g., FIG. 11).

Figure 5:
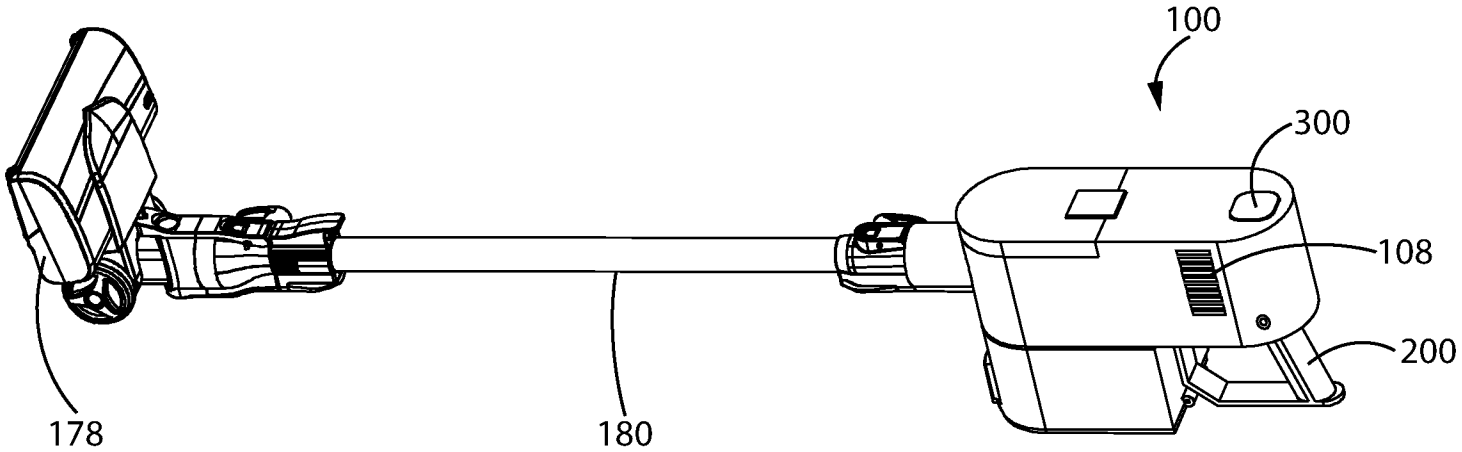
FIG. 5 is a perspective view of the hand vacuum cleaner of FIG. 1 attached to a wand and a floor surface cleaning head.
Figure 32:
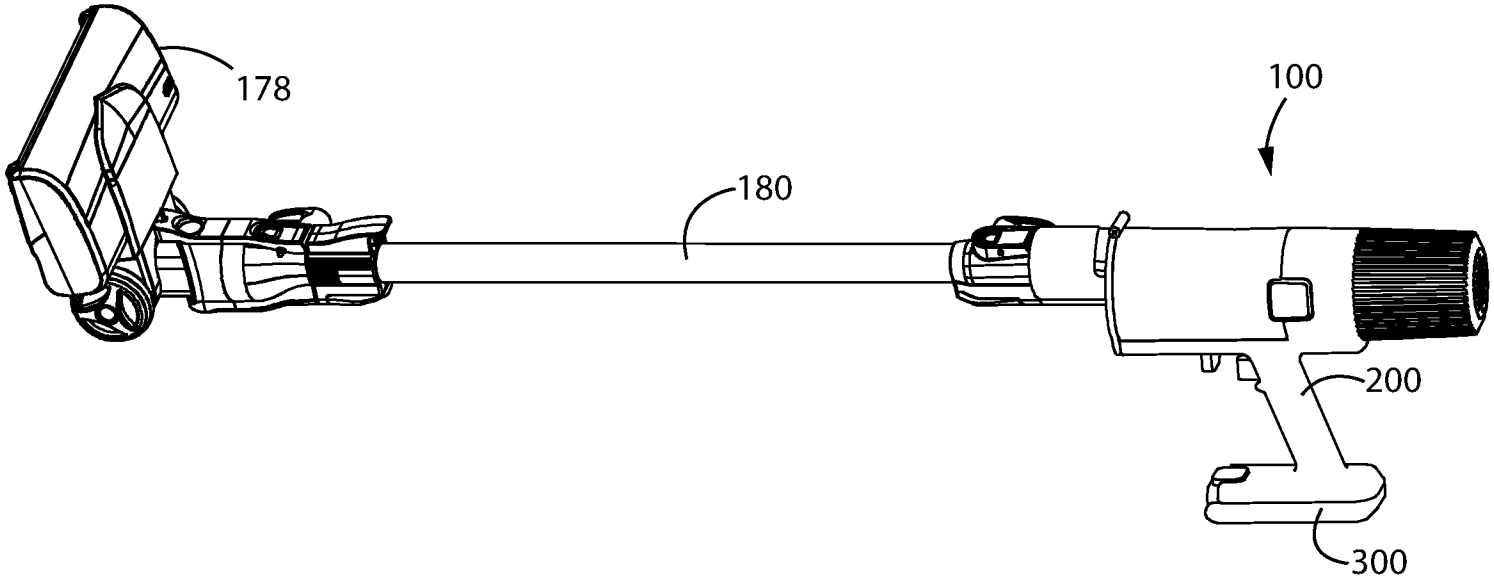
FIG. 32 is a perspective view of the hand vacuum cleaner of FIG. 28 attached to a wand and a floor surface cleaning head.

Optionally, hand vacuum cleaner 100 may be removably mountable on a base (e.g., a surface or floor cleaning head and an upright housing or wand that is pivotally mounted to the surface cleaning head) so as to form, for example, an upright vacuum cleaner or a stick vacuum cleaner, or, if the base is a canister body, then it may be part of a canister vacuum cleaner. The base and the hand vacuum cleaner may provide a surface cleaning apparatus that is a vacuum cleaner, a wet-dry vacuum cleaner and the like. As exemplified in FIGS. 5 and 32, the base of surface cleaning apparatus may include a surface cleaning head 178 and an elongate wand 180 that can be connected to hand vacuum cleaner 100 so as to provide a stick vacuum cleaner. In this configuration, the surface cleaning apparatus may be used to clean a floor or other surface in a manner analogous to a conventional upright-style vacuum cleaner.

Inlet end 174 of inlet conduit 138 may include any suitable connector that is operable to connect to, and preferably detachably connect to, a hose, cleaning tool, the upright section (e.g., rigid wand) of a base of an upright or stick vacuum cleaner) or other accessory. Optionally, in addition to providing an air flow connection, inlet conduit 138 may also include an electrical connection. Providing an electrical connection may allow cleaning tools, accessories and the like that are coupled to inlet conduit 138 to be powered by hand vacuum cleaner 100. For example, hand vacuum cleaner 100 can be used to provide both power and suction to surface cleaning head 178 (see FIGS. 5 and 32). As exemplified in FIGS. 1 and 28, inlet conduit 138 may include an electrical coupling in the form of a female socket member 182, and a corresponding male prong member may be provided on the wand, hose, cleaning tool and/or accessory that is connected to inlet conduit 138.

Figure 33:
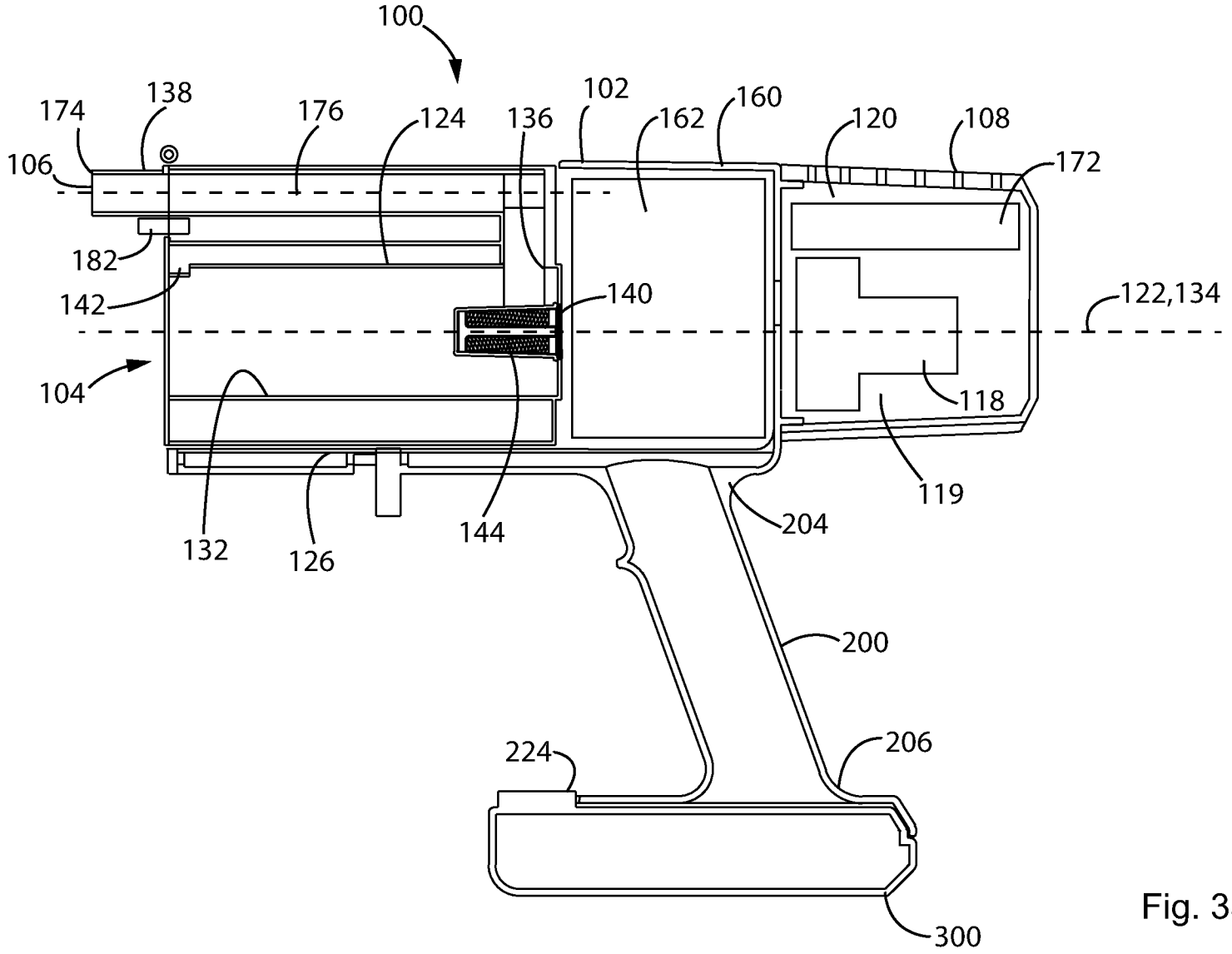
FIGS. 33-34 are cross-sectional views of other example hand vacuum cleaners with a pistol grip handle mounted to the main body at a location forward of the suction motor and with an energy storage member positioned at the lower end of the handle.
Figure 38:
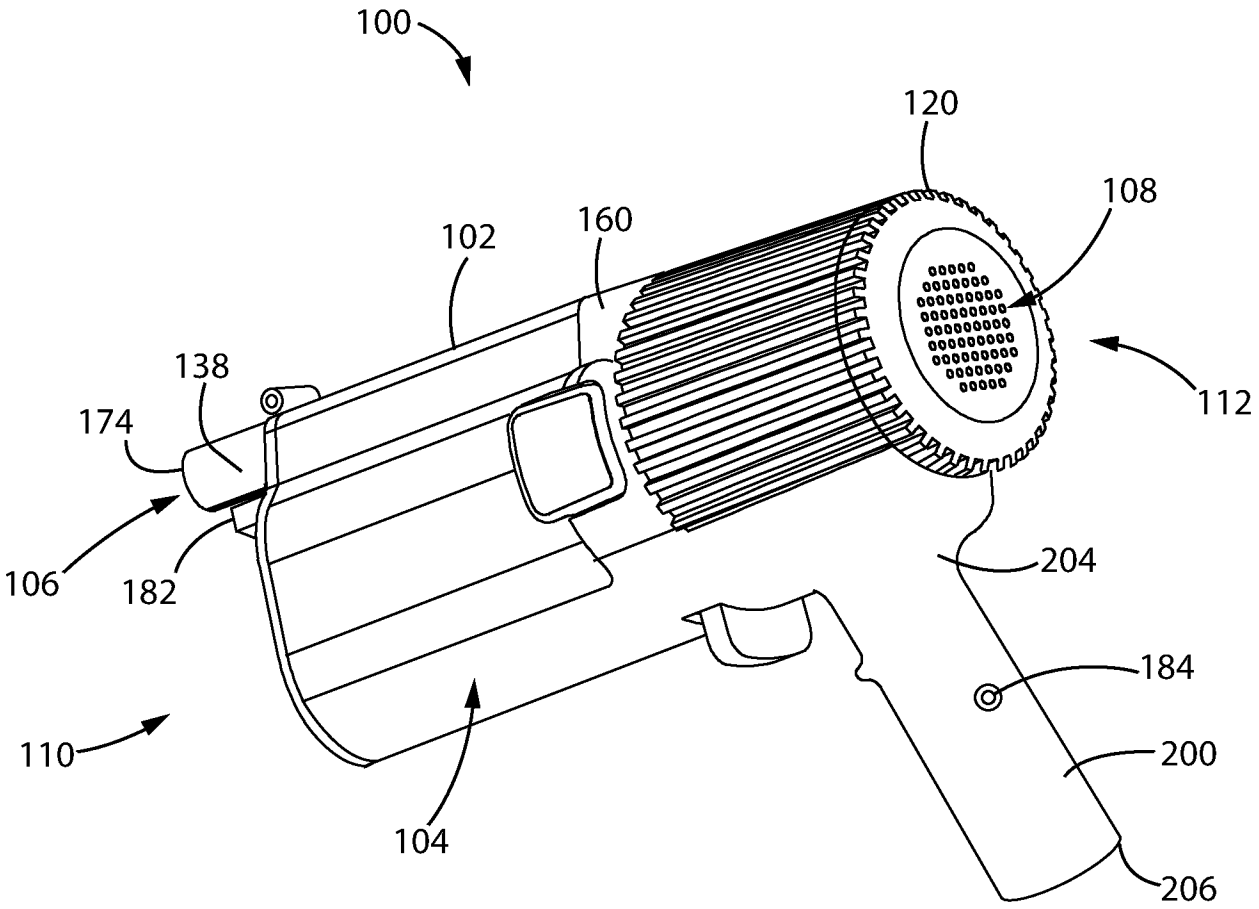
FIG. 38 is a side perspective view of an example hand vacuum cleaner with the handle mounted below the suction motor housing.

Clean air outlet 108 may be provided in any manner that allows the air flow to exit hand vacuum cleaner 100. In the illustrated embodiment of FIGS. 1-4, clean air outlet 108 is provided as part of the main body 102 and configured as a grill. A clean air outlet 108 may be provided on each lateral sides of main body 102. In this embodiment, the grill is oriented so that air exiting clean air outlet 108 travels laterally outward from main body 102. This may ensure that the exhausted air is directed away from a user's hand when they are holding handle 200 rearward of the clean air outlet 108. Alternatively, as exemplified in FIG. 33, clean air outlet 108 may be a grill provided on upper end 114 of hand vacuum cleaner 100 so that the exhausted air travels generally upwardly from upper end 114. Alternatively, as exemplified in FIG. 38, clean air outlet 108 may be a plurality of openings provided at rear end 112 of hand vacuum cleaner 100 so that the exhausted air travels generally rearwardly from rear end 112.

In operation, after activating suction motor 118, dirty air enters hand vacuum cleaner 100 through dirty air inlet 106 and is directed through inlet conduit 138 to cyclone air inlet 136. As exemplified, cyclone air inlet 136 directs the dirty air flow into cyclone chamber 124 in a tangential direction to promote cyclonic motion in cyclone chamber 124. After entering cyclone chamber 124, the air rotates and exits cyclone chamber 124 through cyclone air outlet 140. Dirt particles and other debris is disentrained (i.e., separated) from the dirty air flow as the dirty air flow rotates in cyclone chamber 124 while travelling from cyclone air inlet 136 to cyclone air outlet 140. Some (e.g., the heavier) dirt may be separated from the inflow air stream by gravity due to the air flow rate decreasing as the air enters cyclone chamber 124 and/or a change in the direction of the air flow as it enters or travels through cyclone chamber 124. Additional dirt and debris may be separated by mesh screen 146 of vortex finder 144 due to filtration. At least some of the disentrained dirt particles and debris may be discharged from cyclone chamber 124 through dirt outlet 142 into dirt collection chamber 126 external to cyclone chamber 124, where the dirt particles and debris may be collected and stored until dirt collection chamber 126 is emptied.

From cyclone air outlet 140, the air flow may be directed into pre-motor filter housing 160 where it is drawn through pre-motor filter 162. From the downstream end of pre-motor filter housing 160, the air flow may be directed into suction motor housing 119, drawn through the suction motor 118 and then discharged from hand vacuum cleaner 100 through clean air outlet 108. Prior to exiting clean air outlet 108, the treated air may pass through post-motor filter 172, which may be one or more layers of filter media.

In the illustrated embodiment of FIG. 2, motor axis 122 is substantially perpendicular to cyclone axis 134. As exemplified, suction motor 118 may be positioned so that motor axis 122 intersects pre-motor filter housing 160. Alternatively, as exemplified in FIG. 6, motor axis 122 may be substantially parallel to cyclone axis 134. As described subsequently herein, various alternative positions and orientations of suction motor 118 are possible.

Suction motor housing 119 and pre-motor filter housing 160 may have various positional arrangements. As exemplified in FIG. 2, main body 102 may be configured such that suction motor housing 119 is located rearward of the pre-motor filter housing 160 and, preferably, axially aligned with the pre-motor filter housing 160 such that air exiting pre-motor filter housing 160 may travel generally linearly to suction motor 118. Optionally, as exemplified in FIG. 33, motor axis 122 may be generally co-axial with cyclone axis 134. This may help provide a desirable hand feel to a user. Alternatively, as exemplified in FIG. 7, suction motor 118 may be positioned below pre-motor filter housing 160 when hand vacuum cleaner 100 is oriented with the upper end 114 above the lower end 116. In this configuration, air exiting pre-motor filter housing 160 may be drawn downwardly to suction motor 118.

Handle

Hand vacuum cleaner 100 can include a handle 200. Various options for a handle configuration and positioning are discussed. Any such handle could be used by itself or in combination with one or more of the other aspects set out herein.

Figure 54:
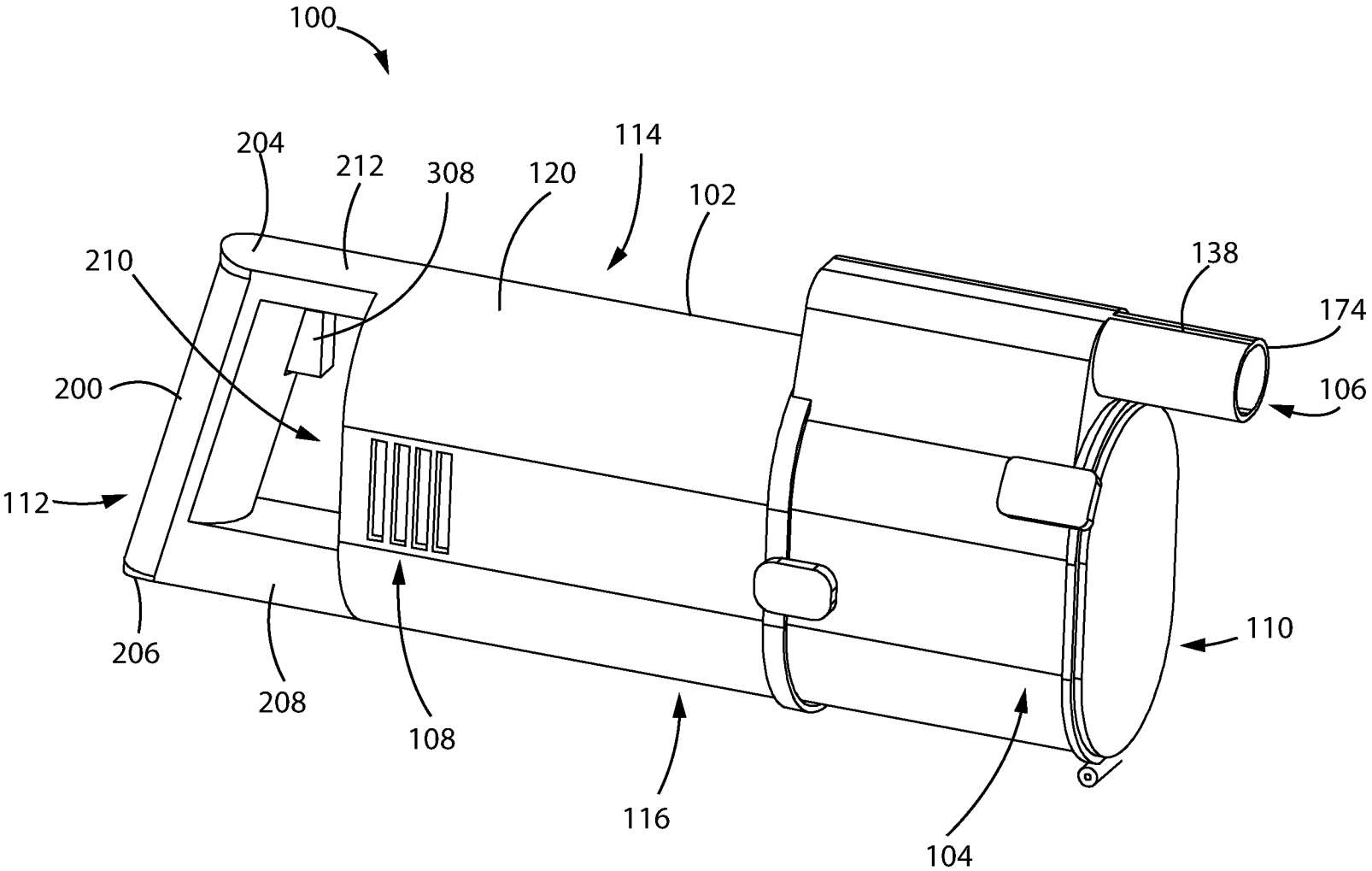
FIG. 54 is side perspective view of an example hand vacuum cleaner with the handle mounted at the rear end of the suction motor housing.
Figure 58:
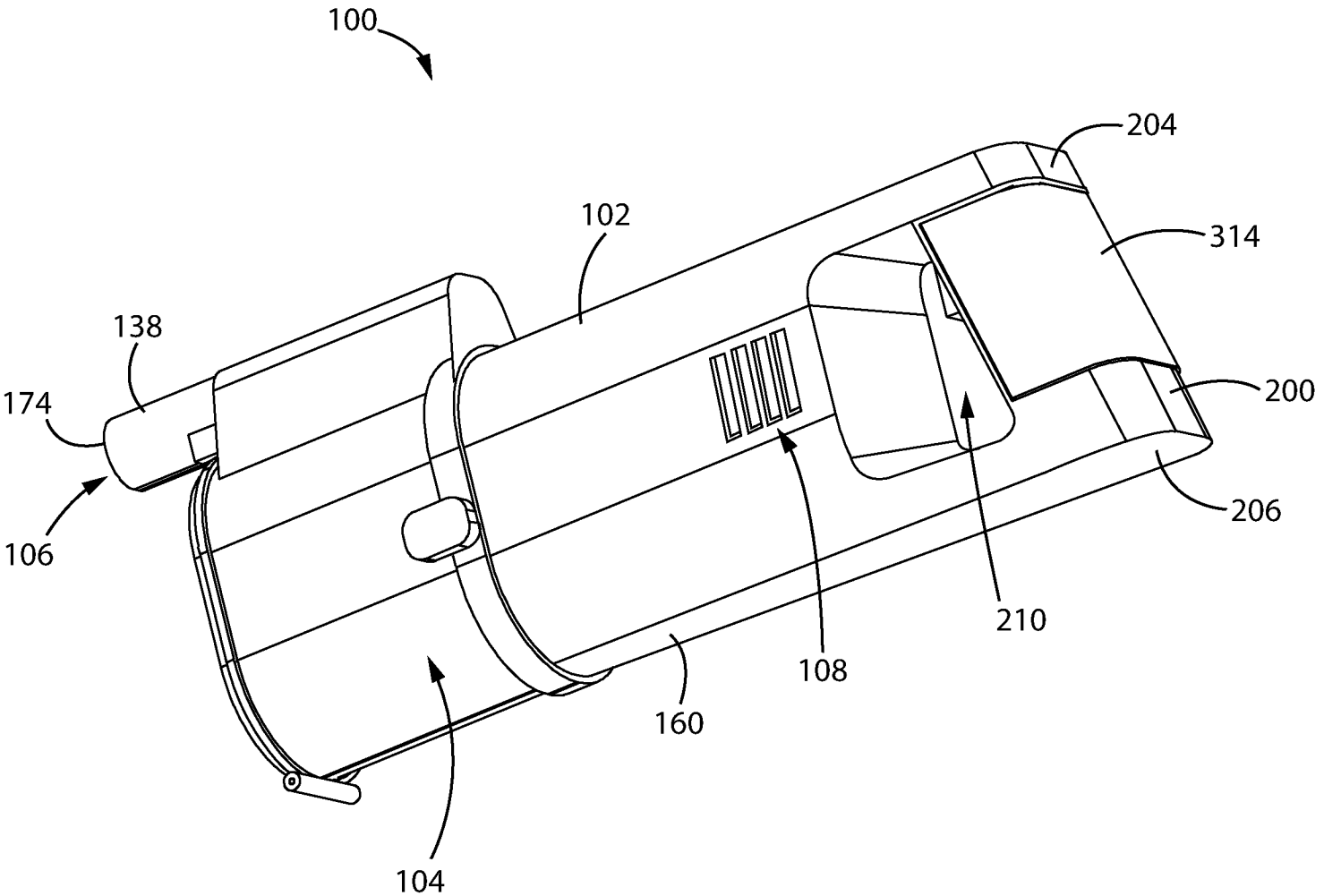
FIGS. 58-59 are side perspective views of other example hand vacuum cleaners with the handle mounted at the rear end of the suction motor housing.

Handle 200 may have various positional arrangements and configurations, which may improve the ergonomics of hand vacuum cleaner 100. As an example, handle 200 may be located at rear end 112 of hand vacuum cleaner 100 (see, e.g., FIGS. 54, 58 and 59). As another example, handle 200 may be located at upper end 114 of hand vacuum cleaner 100 (see, e.g., FIGS. 61 and 63). As yet another example, handle 200 may be located at lower end 116 of hand vacuum cleaner 100 (see, e.g., FIGS. 43, 44 and 48).

Figure 16:
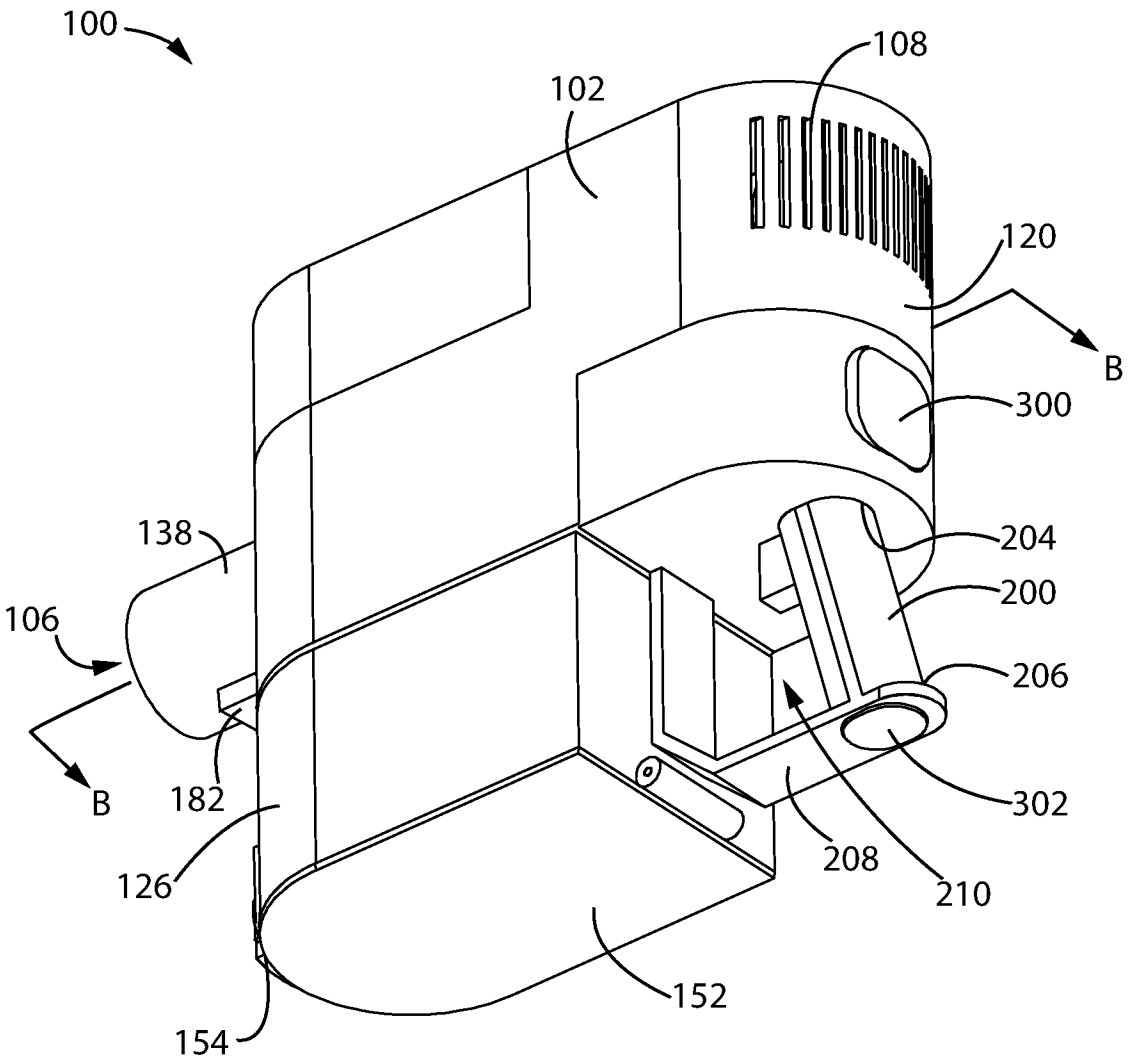
FIG. 16 is a side perspective view of an example hand vacuum cleaner with a removable handle.
Figure 17:
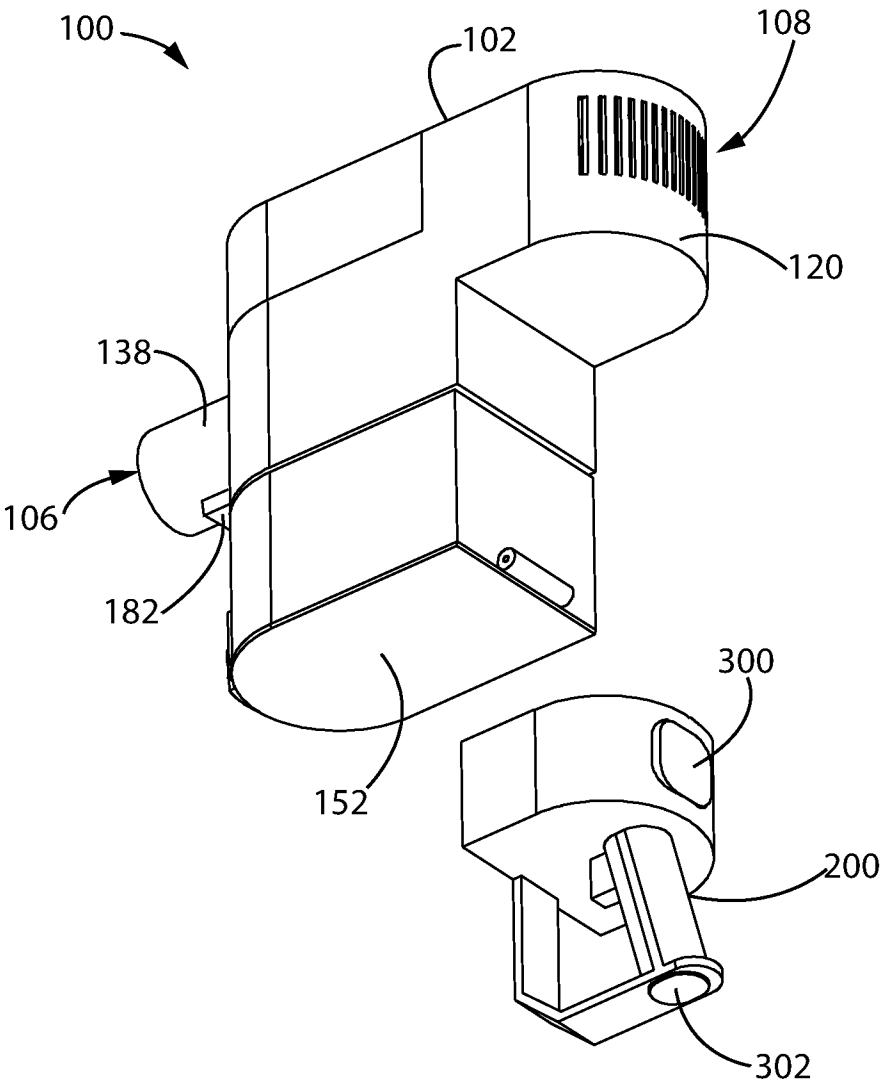
FIG. 17 is a side perspective of the hand vacuum cleaner of FIG. 16 with the handle removed.

Optionally, handle 200 may be removable from main body 102. For example, FIGS. 16-17 exemplify a removable handle 200 mounted below body portion 120. Handle 200 can be removably mounted to main body 102 in any suitable fashion (e.g., dove-tail locking members, clips, etc.). Removing handle 200 may facilitate charging or replacement of energy storage members 300, 302 that are removed with handle 200 (see, e.g., FIG. 17).

The handle 200 may have various configurations. For example, in the illustrated embodiments of FIGS. 1-55, handle 200 is configured as a pistol grip type handle that extends upwardly and forwardly along a handle axis 202 (e.g., FIGS. 2 and 55) between upper and lower handle ends 204, 206, when hand vacuum cleaner 100 is oriented so that upper end 114 is above the lower end 116. It will be appreciated that handle 200 may consist of a pistol grip handle (see for example FIGS. 2, 29 and 54) or it may comprise a pistol grip section (see for example FIG. 62).

Figure 59:
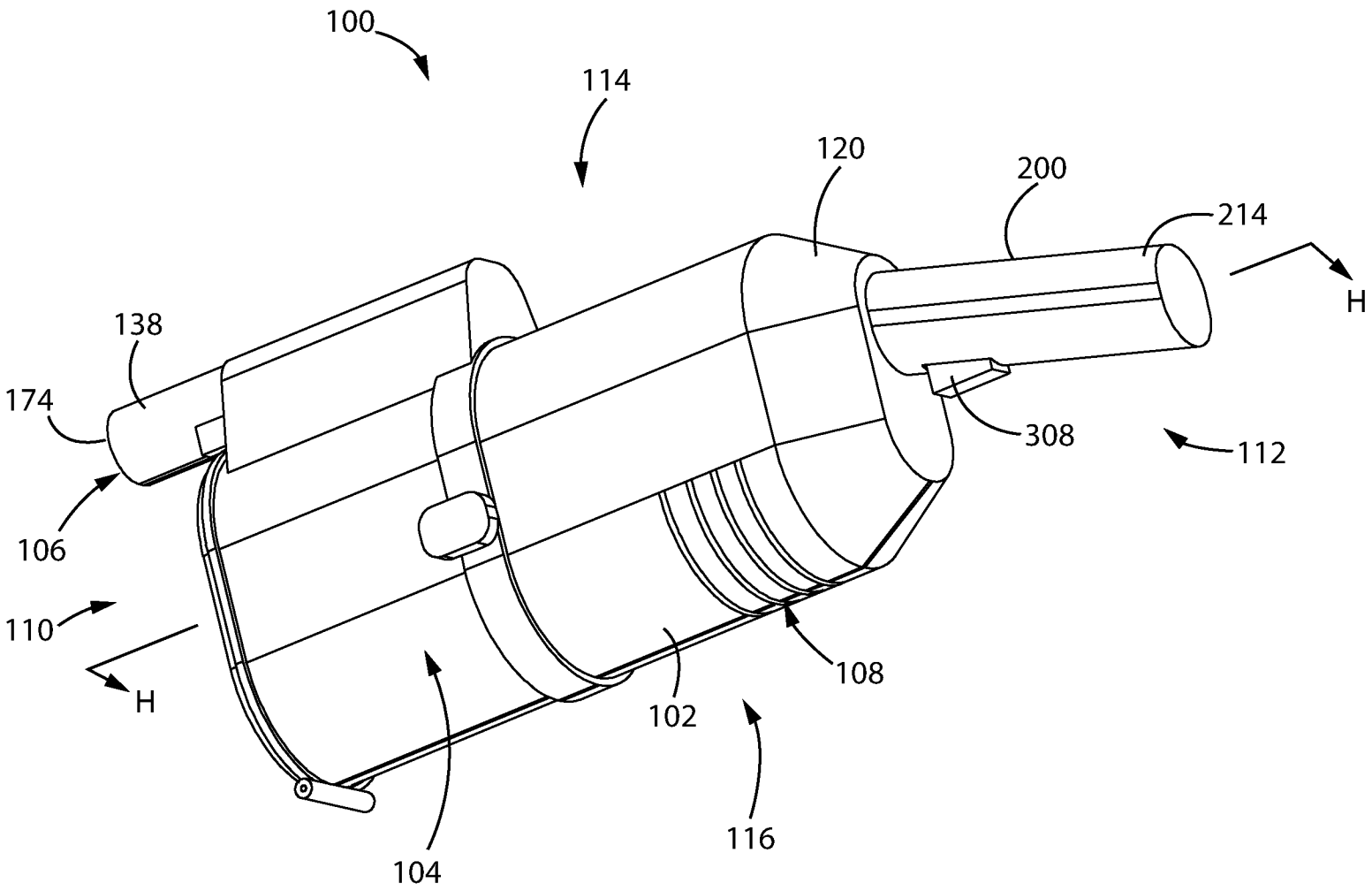
Figure 60:
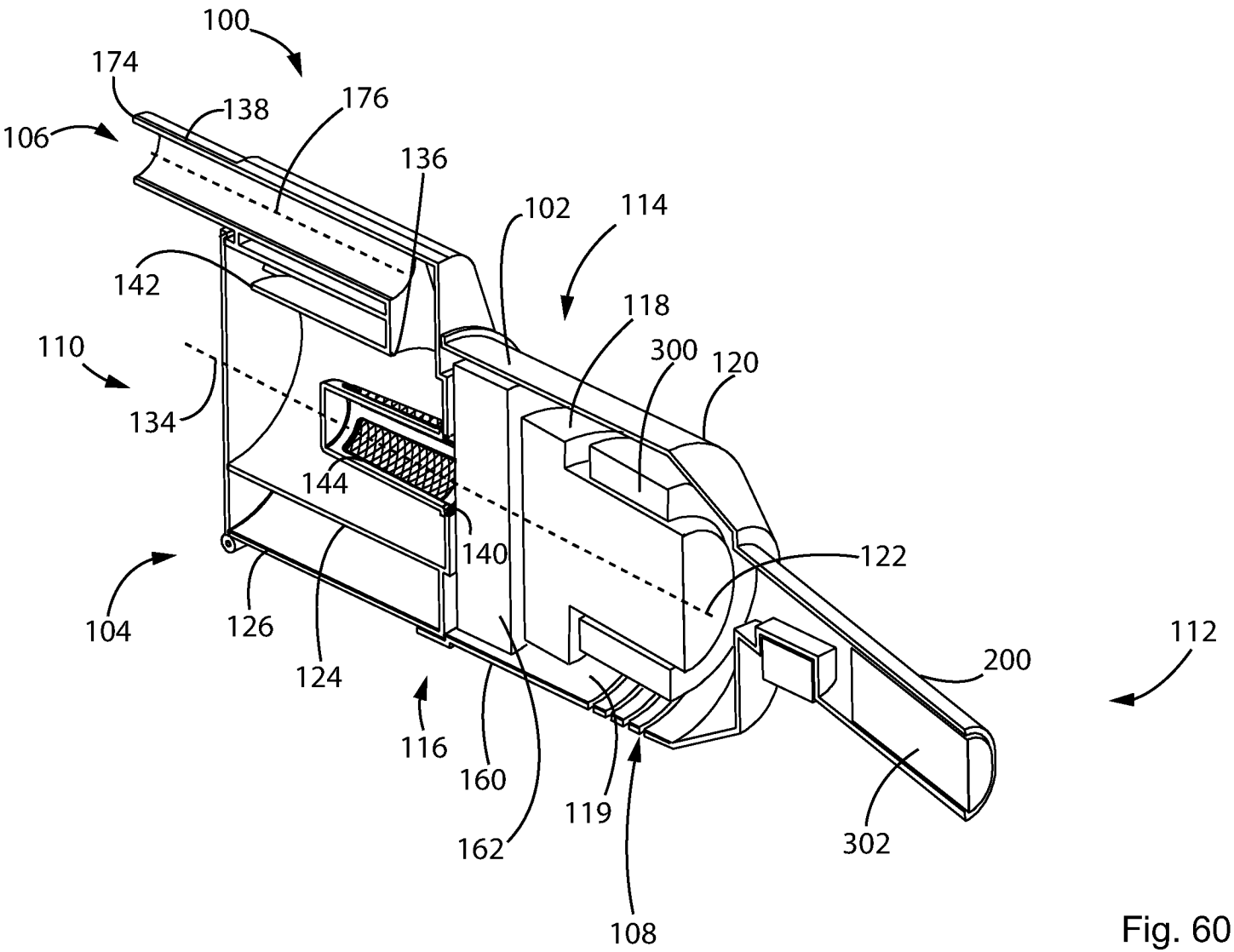
FIG. 60 is a cross-sectional perspective view taken along line H-H of FIG. 59.
Figure 61:
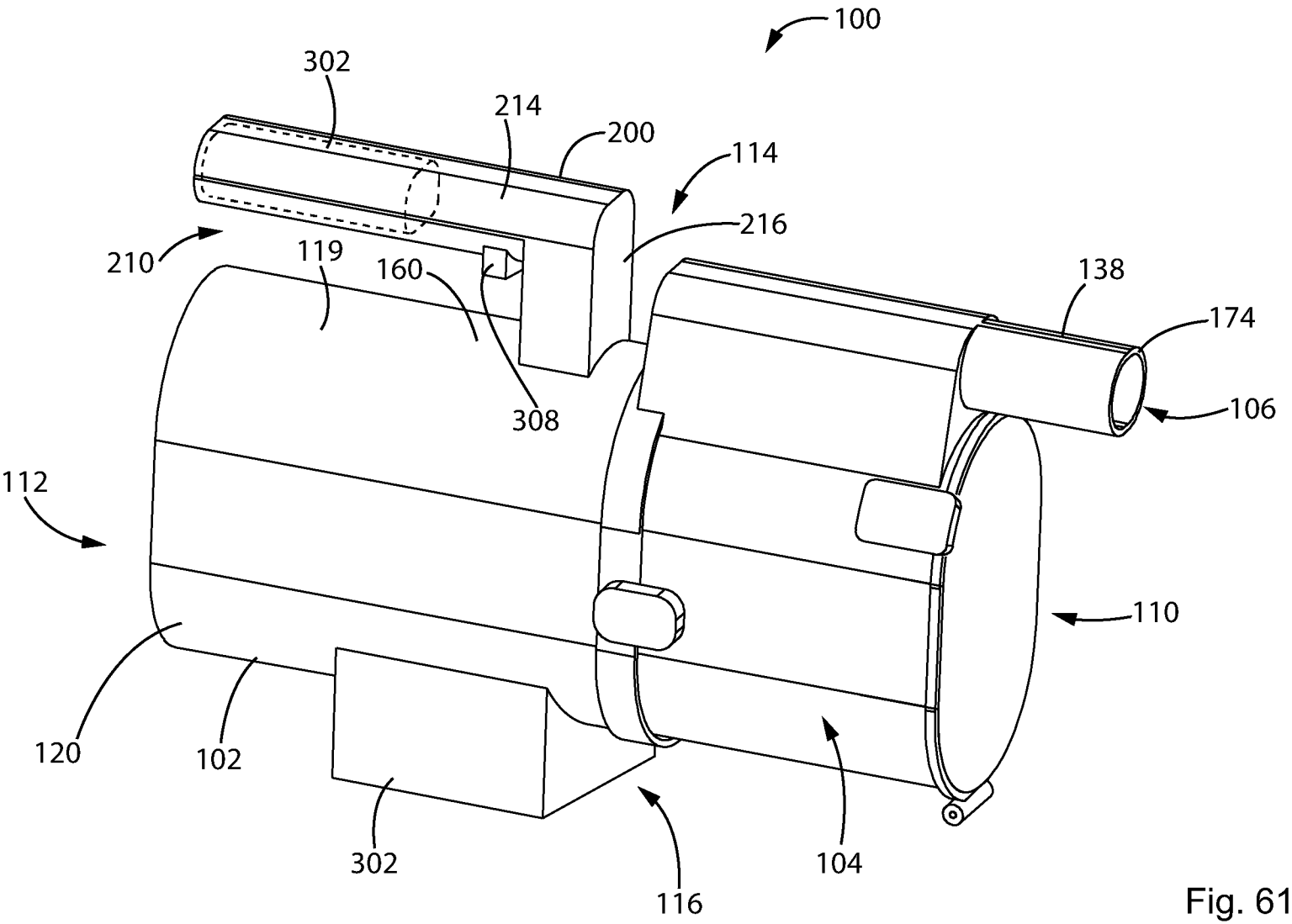
FIGS. 61-63 are side perspective views of example hand vacuum cleaners with the handle mounted to the upper end of the pre-motor filter housing.
Figure 63:
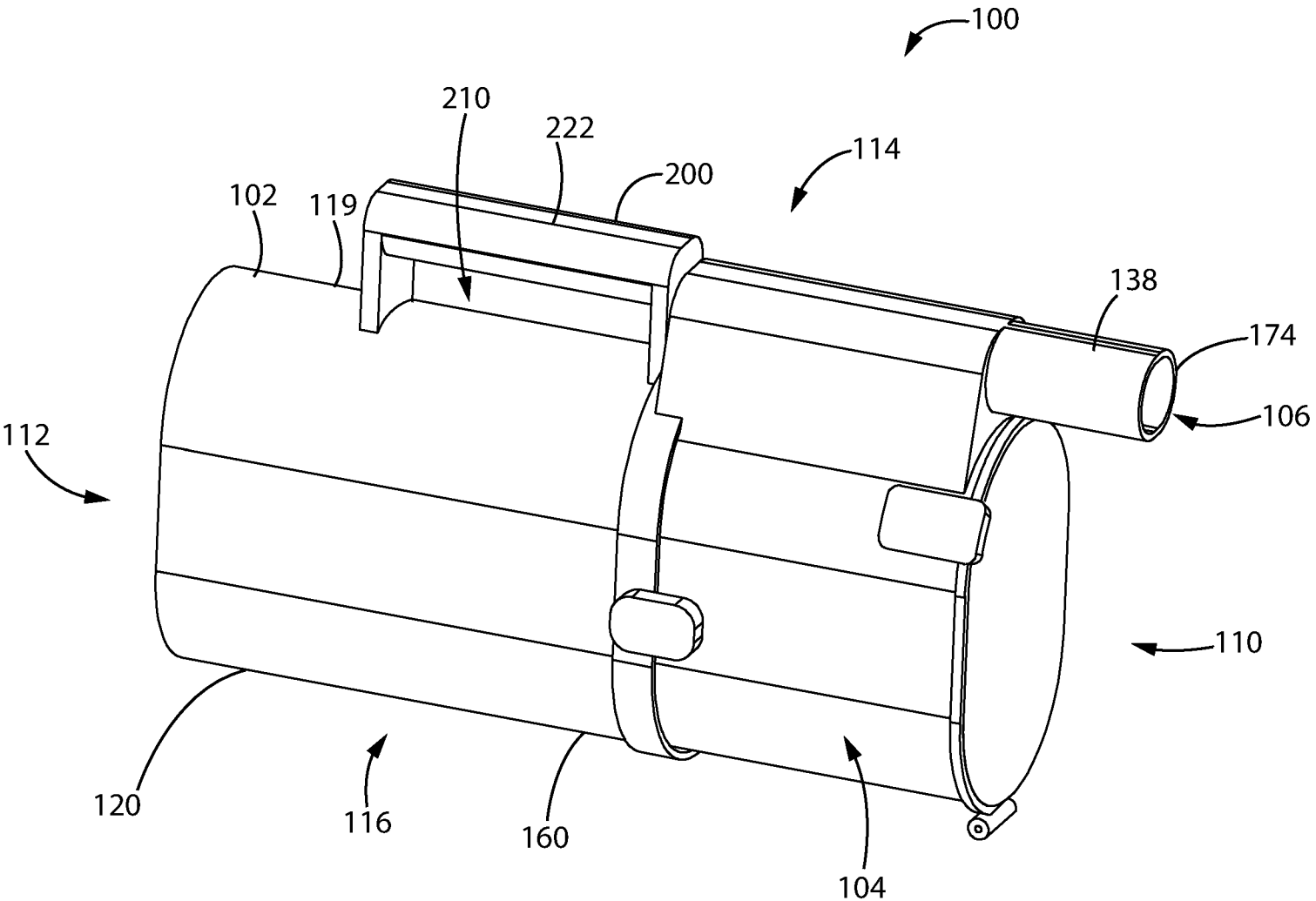
Figure 64:
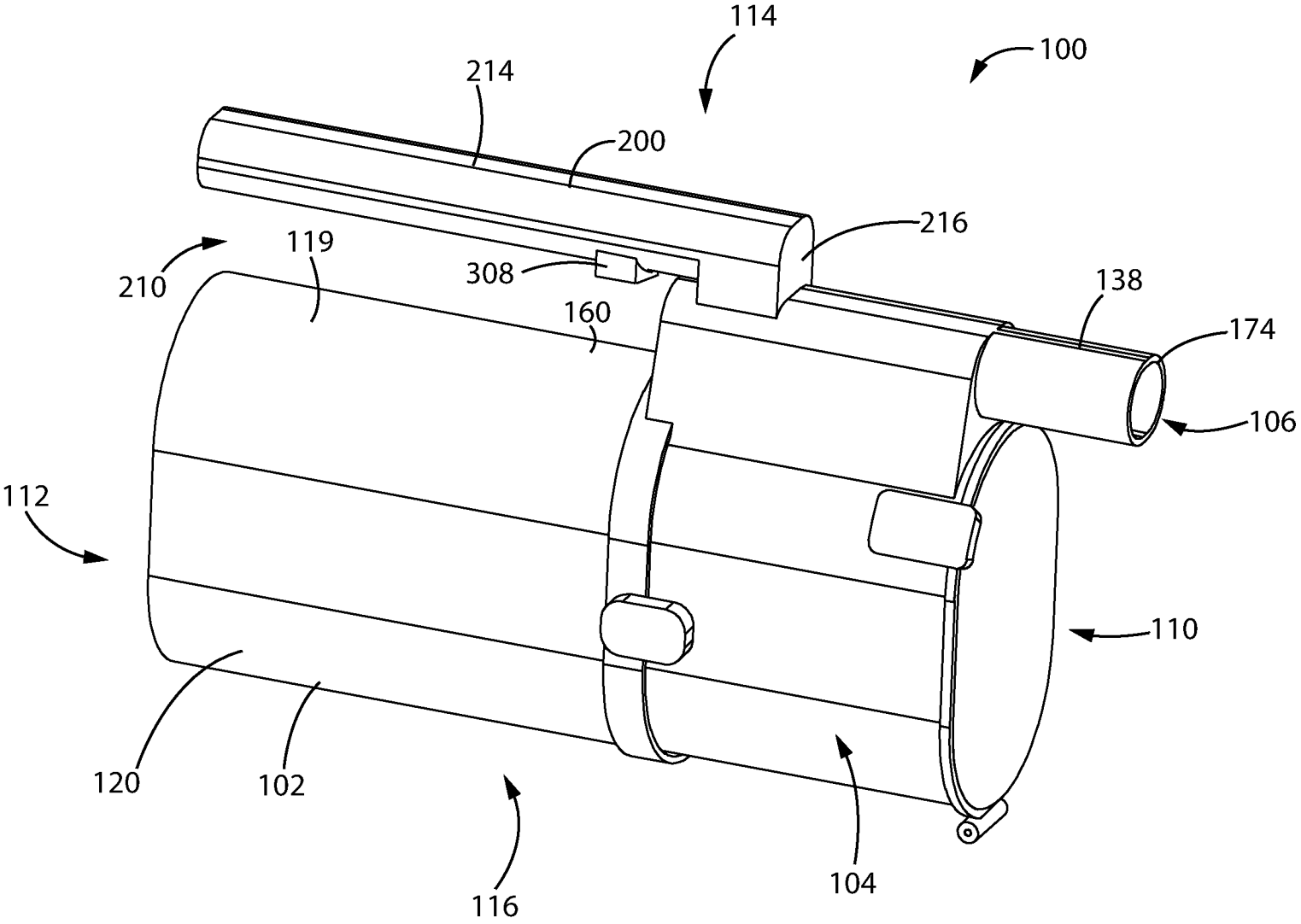
FIGS. 64-65 are side perspective views of example hand vacuum cleaners with the handle mounted to the upper end of the air treatment assembly; and, FIG. 66 is a side perspective view of an example hand vacuum cleaner with the handle mounted to the upper end of the suction motor housing.

As exemplified in FIGS. 59-61, handle 200 may be configured as a stick or linearly extending handle. A linearly extending handle may be mounted to the main body 102 or the air treatment assembly 104. As exemplified in FIG. 59, handle 200 includes a grip portion 214 that extends rearwardly from rear end 112. As exemplified in FIG. 61, grip portion 214 extends rearwardly from the upper end of a mounting portion 216. FIG. 61 shows mounting portion 216 connected to the upper end of pre-motor filter housing 160. FIG. 63 shows the handle mounted to the upper end of the main body. FIG. 64 show mounting portion 216 connected to the upper surface of air treatment assembly 104.

Figure 62:
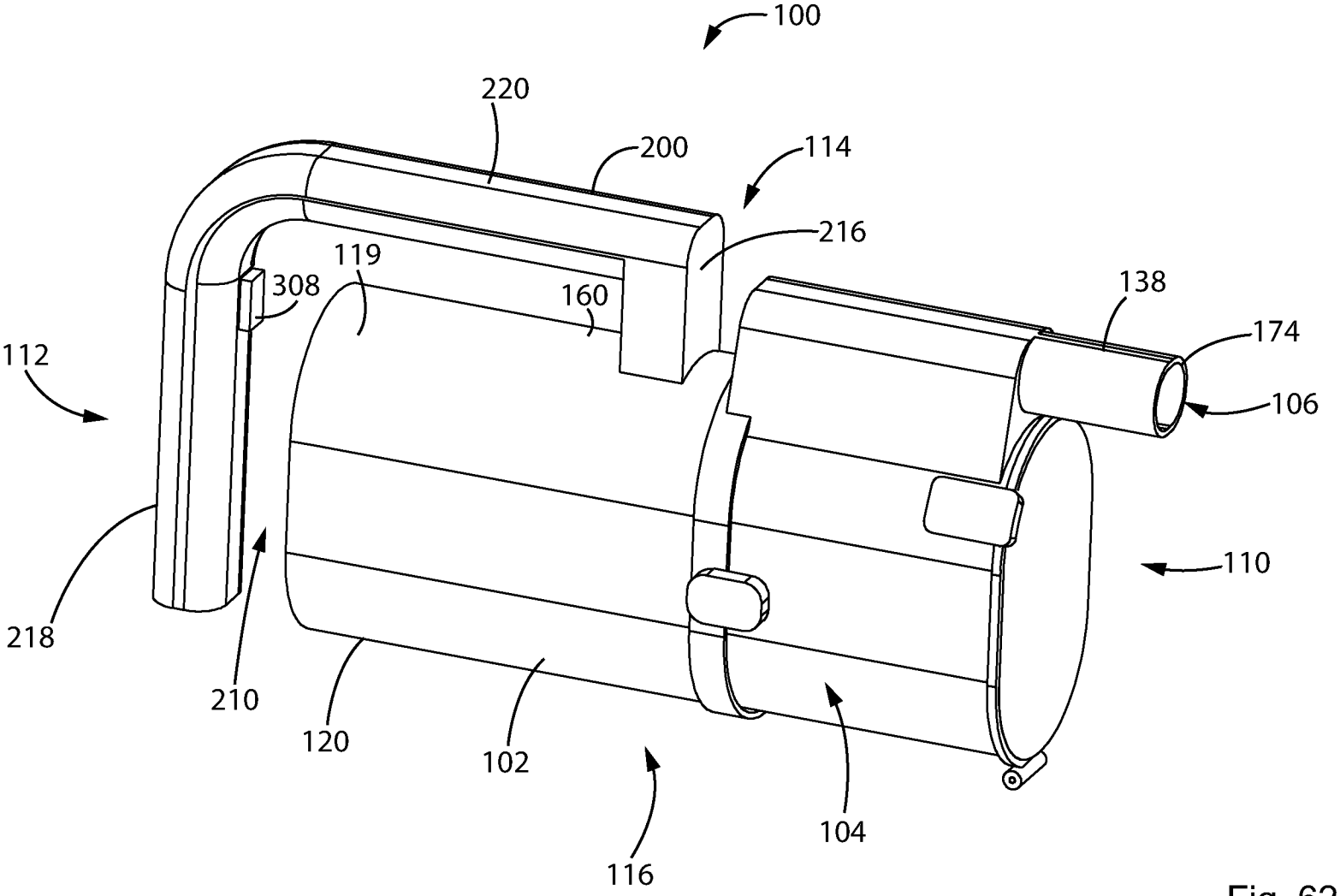
Figure 65:
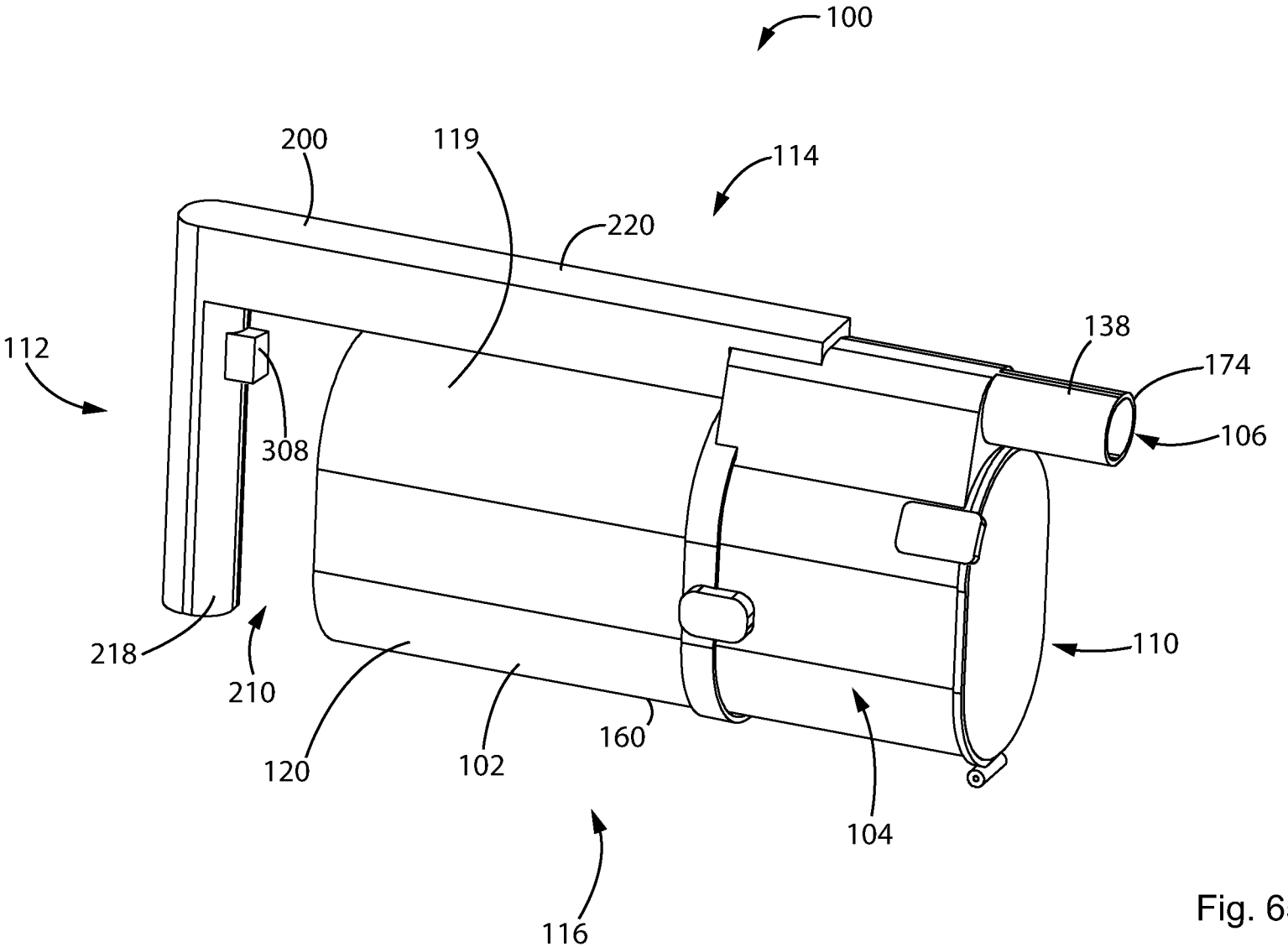
Figure 66:
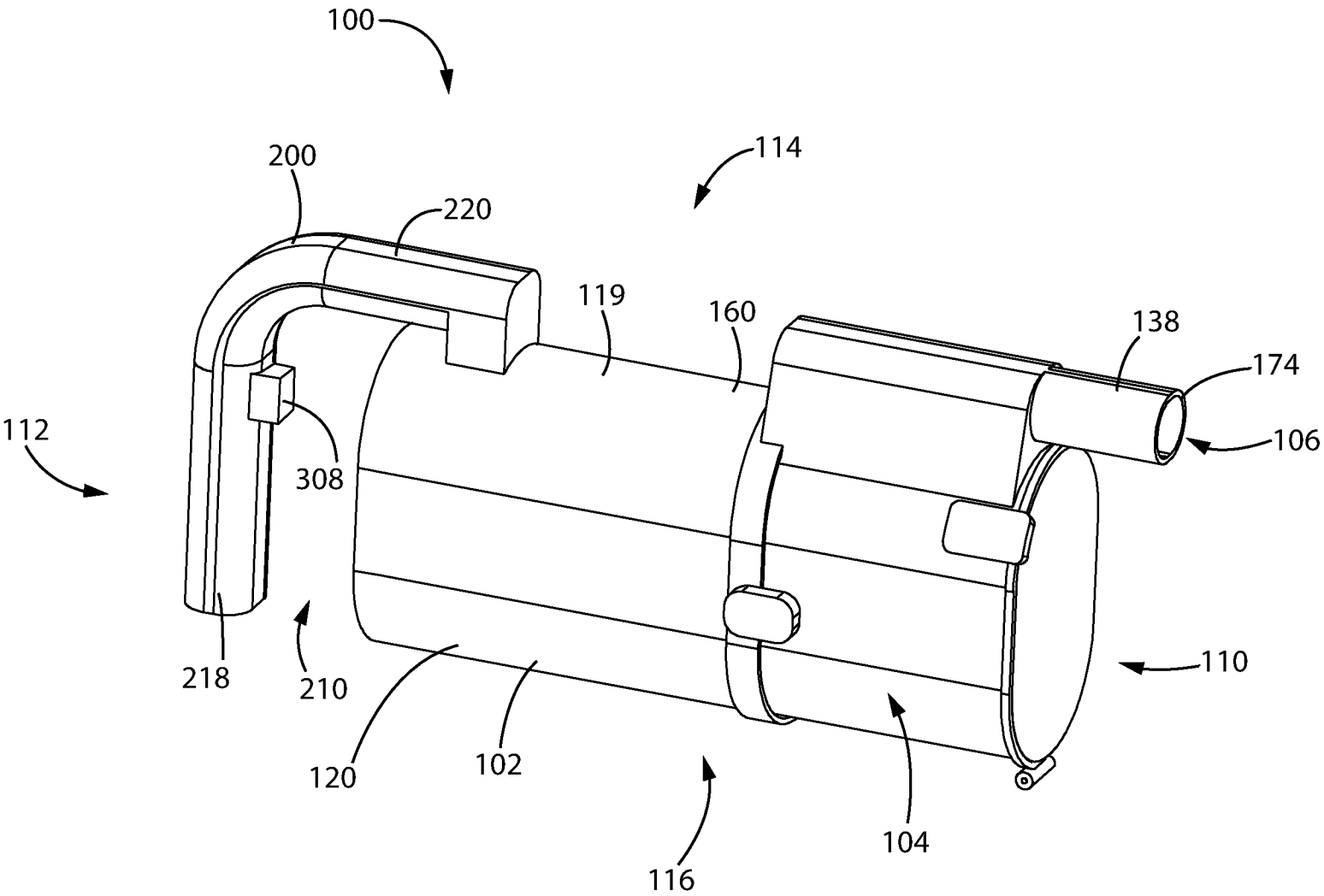

As exemplified in FIGS. 62, 65 and 66, a handle 200 that is mounted to an upper portion of the hand vacuum cleaner may include a pistol grip portion 218 extending downwardly from an upper handle portion 220. As exemplified, pistol grip portion 218 is positioned rearward of main body 102. FIG. 62 shows upper handle portion mounted to the upper end of pre-motor filter housing 160. In this embodiment, a continuous finger grip area 210 is formed (i) between pistol grip portion 218 and the rear end of main body 102 and (ii) between upper handle portion 220 and the upper end of main body 102. FIG. 65 exemplifies upper handle portion 220 mounted to the upper surface of air treatment assembly 104. FIG. 66 exemplifies upper handle portion 220 connected to the upper end of suction motor housing 119. As exemplified in FIGS. 65 and 66, a finger grip area 210 may be formed between pistol grip portion 218 and the rear end of suction motor housing 119.

Although the illustrated embodiments of FIGS. 62, 66 and 66 exemplify a pistol grip portion 218 that extends straight down from upper handle portion 220, pistol grip portion 218 may extend downwardly and rearwardly from upper handle portion 220 (e.g., at an angle between 0 and 40°).

One or more portions of the handle 200 may be attached to the hand vacuum cleaner. The handle may be attached to the hand vacuum cleaner directly or by one or more bridge portions. For example, the upper or lower end, or both the upper and lower ends, of the handle 200 may be attached to the hand vacuum cleaner.

In addition, the handle may be mounted, directly or by one or more bridge portions, to the lower end of the hand vacuum cleaner, the rear end of the hand vacuum cleaner and/or an upper end of the hand vacuum cleaner.

As exemplified in FIG. 2, upper handle end 204 is mounted to the lower side of body portion 120 and a rearwardly extending bridge portion 208 extends from the rear side of air treatment assembly 104 to lower handle end 206. As exemplified in FIG. 29, only the upper handle end 204 is mounted to a lower end of the main body 102. As exemplified in FIG. 55, upper bridge portion 212 and lower bridge portion 208 connect the upper and lower ends of the handle 200 to the rear end wall of the main body 102. As exemplified in FIG. 63, the handle 200 is secured at each end of the hand grip portion. As exemplified in FIG. 60, the handle 200 is attached directly to the rear end wall of the hand vacuum cleaner 100. As exemplified in FIG. 61, the handle 200 is attached to the upper end of the hand vacuum cleaner 100. As exemplified in FIG. 63, handle 200 is configured as a C-shape handle (similar to the handles commonly found at the top of briefcases or toolboxes) and is secured to the upper end of the hand vacuum cleaner by two bridge portions.

Figure 52:
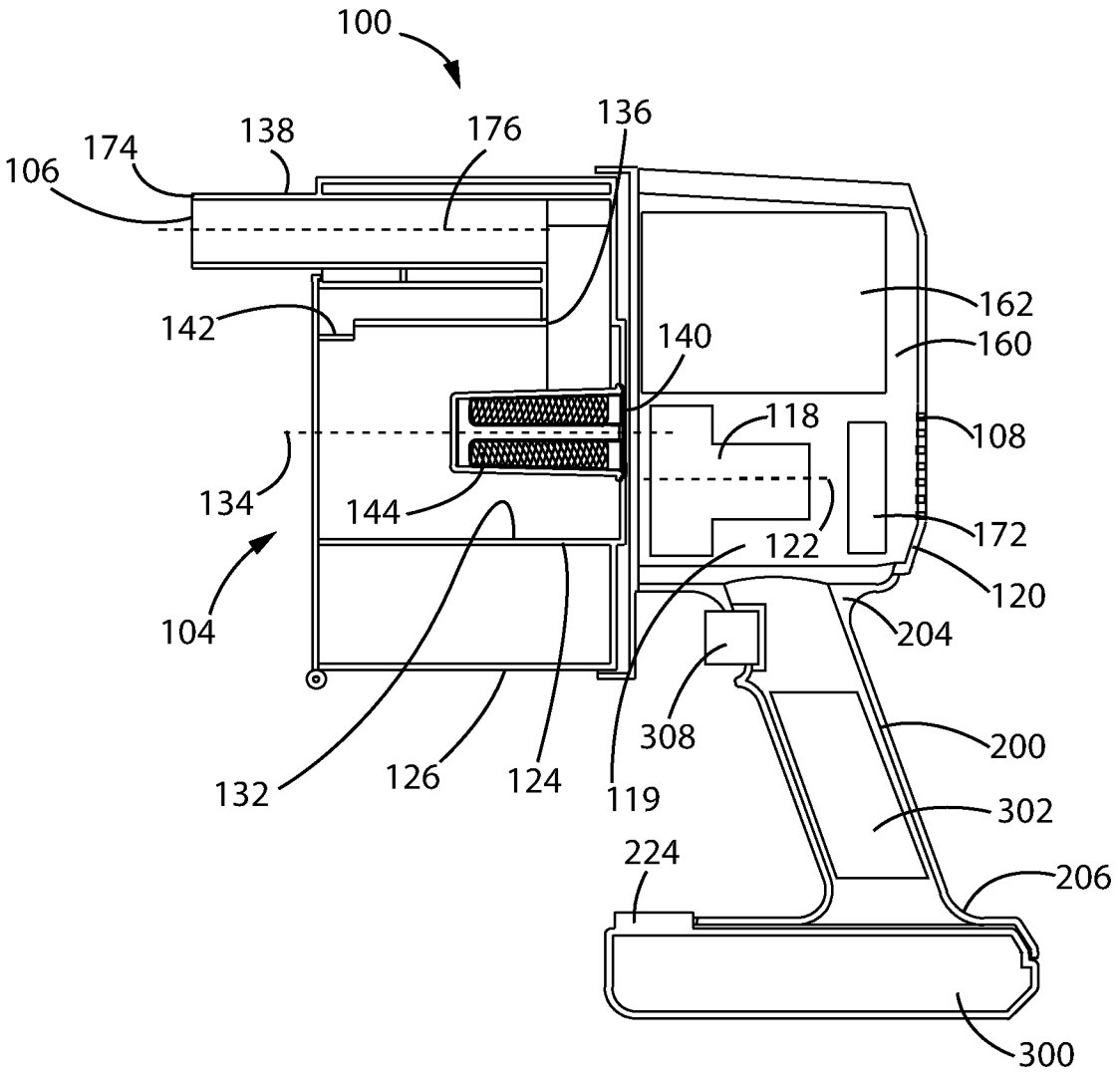
FIG. 52 is a cross-sectional view of another example hand vacuum cleaner with the pre-motor filter and the suction motor above a pistol grip handle and with an energy storage member positioned at the lower end of the handle.

The handle, which may be a pistol grip handle 200, may be mounted at various locations to the lower end 116 of hand vacuum cleaner 100. For example, upper handle end 204 may be mounted to the lower side of pre-motor filter housing 160 (see, e.g., FIGS. 29 and 33, 34). Alternatively, upper handle end 204 may be mounted to the lower side of air treatment assembly 104 (see, e.g., FIGS. 40, 44 and 47). Alternatively, upper handle end 204 may be mounted to the lower surface of suction motor housing 119 (see, e.g., FIGS. 39, 42 and 52).

Figure 39:
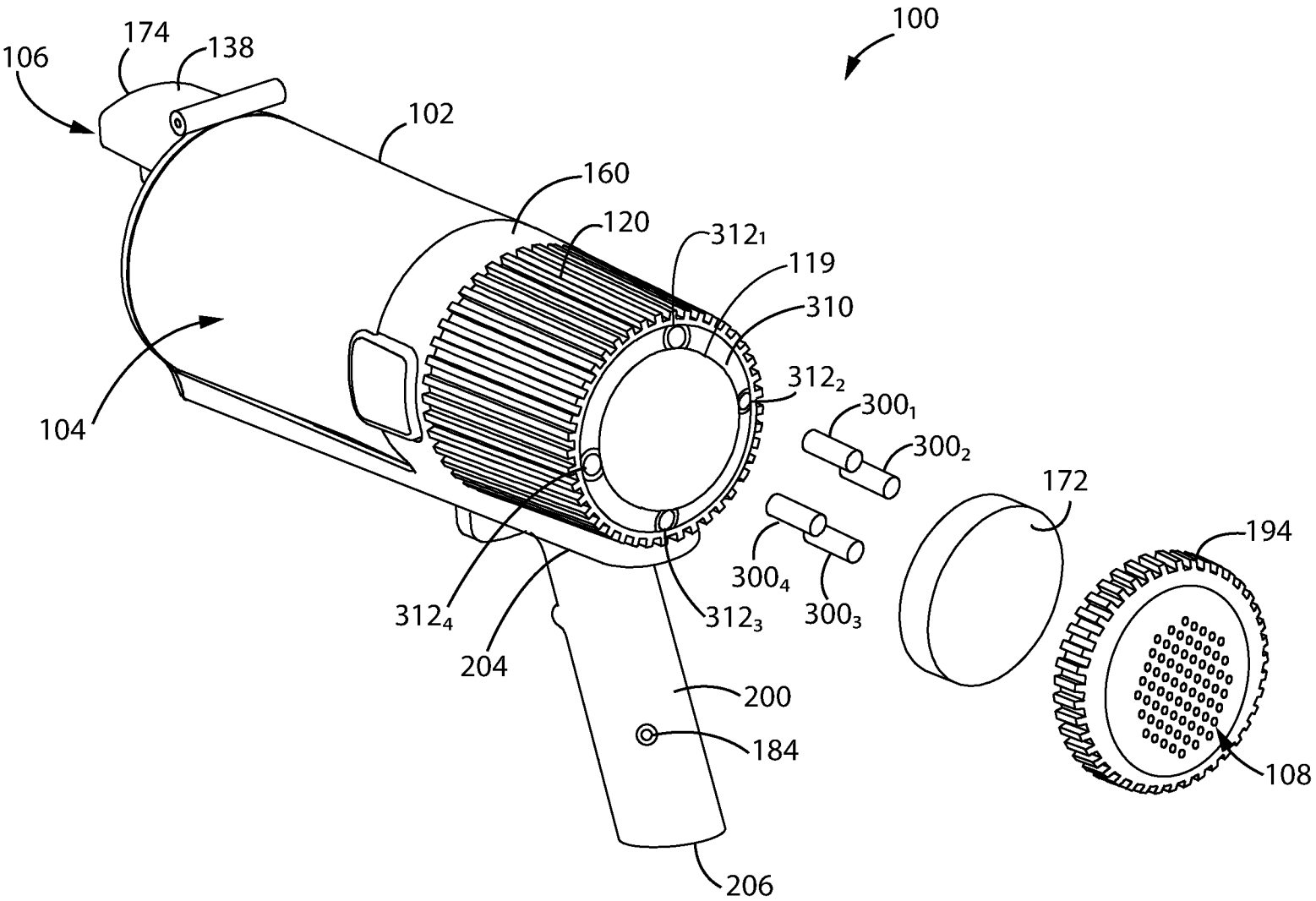
FIG. 39 is a partially exploded perspective view of the hand vacuum cleaner of FIG. 38 with multiple batteries positionable radially outward of the suction motor.
Figure 40:
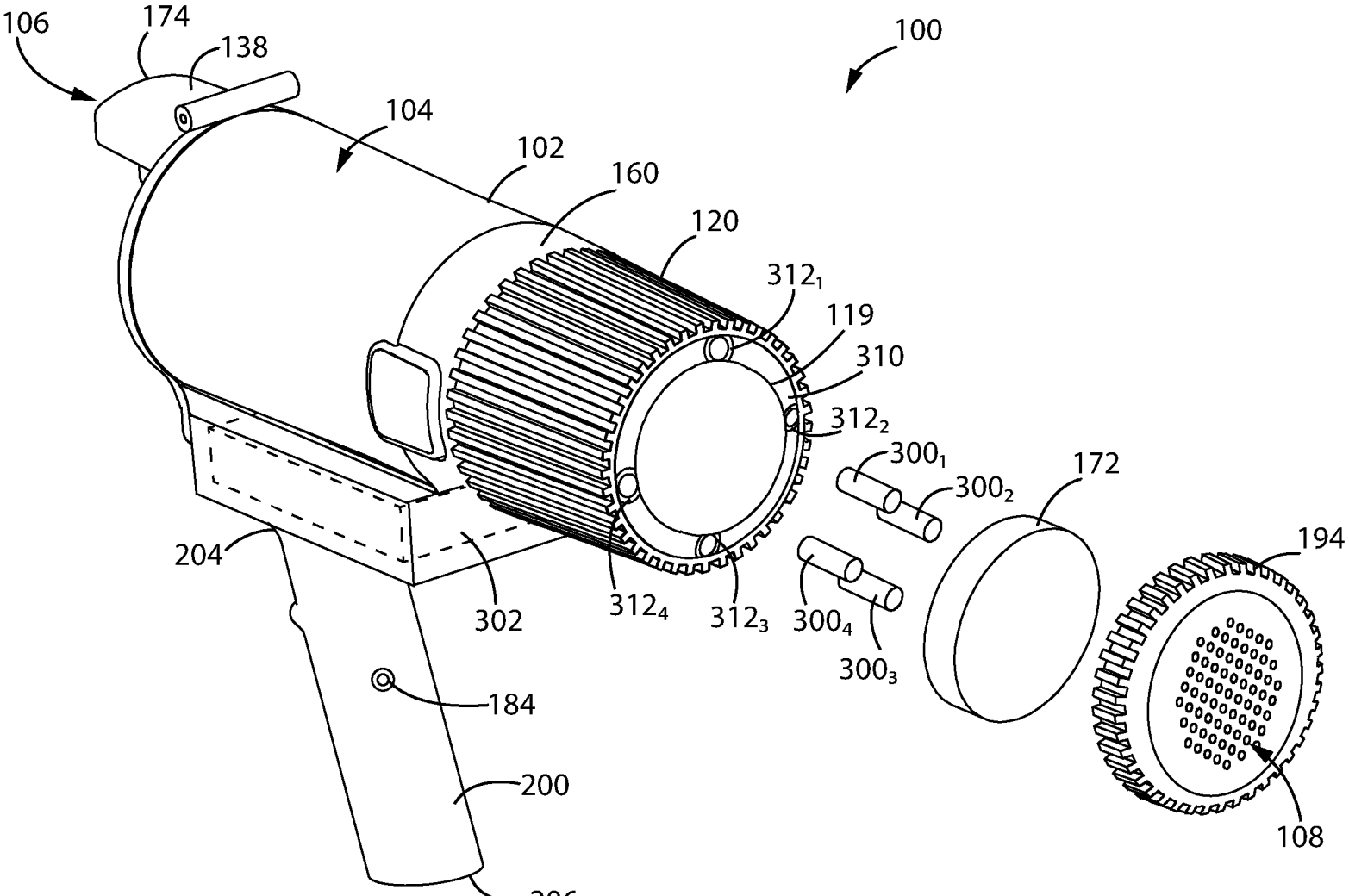
FIG. 40 is a partially exploded perspective view of an example hand vacuum cleaner with the handle mounted below the air treatment assembly.
Figure 42:
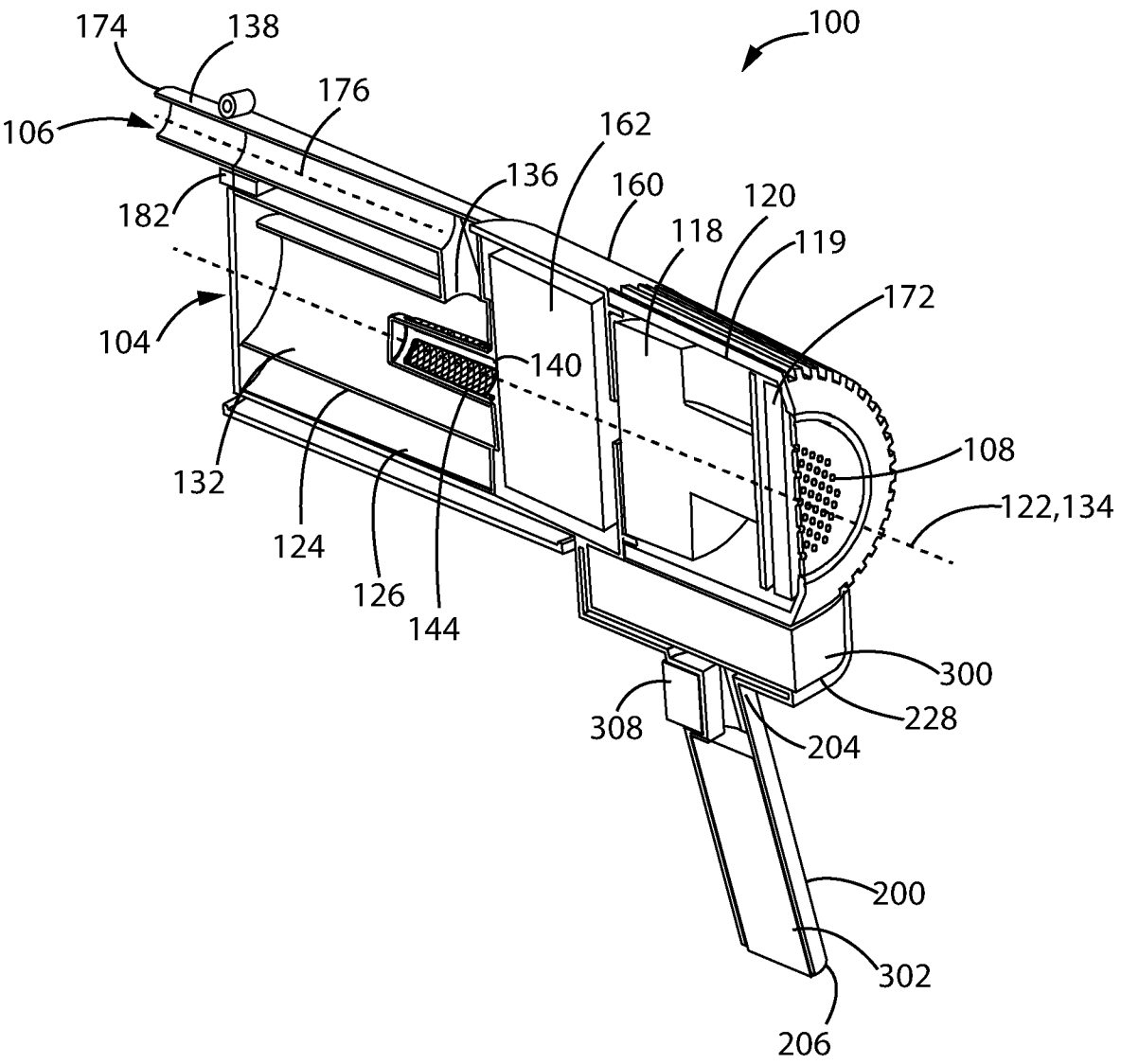
FIG. 42 is a cross-sectional perspective view taken along line E-E of FIG. 41.

In some embodiments, handle 200 may be mounted at a location that is radially outward of suction motor housing 119 (e.g., see FIGS. 39, 42 and 66). Alternatively, handle 200 may be mounted at rear end 112 of hand vacuum cleaner 100. As exemplified in FIGS. 59 and 60, handle 200 may be configured as a stick-type handle that extends rearwardly and downwardly from the rear surface of body portion 120. In an alternative embodiment (not shown), stick type handle 200 may extend substantially perpendicularly from the rear surface of body portion 120.

The handle may be mounted at various locations to upper end 114 of hand vacuum cleaner 100. For example, handle 200 may be mounted to the upper end of pre-motor filter housing 160 (see, e.g., FIGS. 61-63). Alternatively, handle 200 may be mounted to the upper side of air treatment assembly 104 (see, e.g., FIGS. 64-65). Alternatively, handle 200 may be mounted to the upper end of suction motor housing 119 (see, e.g., FIG. 66).

A finger grip area may be provided between the handle (the hand grip portion) and the hand vacuum cleaner (the main body and/or the air treatment assembly). As exemplified in FIG. 2, an enclosed finger grip area 210 for receiving the fingers of a user is formed between handle 200 and the rear side of air treatment assembly 104. It will be appreciated that bridge portion 208 need not be provided and therefore the finger grip area 210 may be open.

Figure 55:
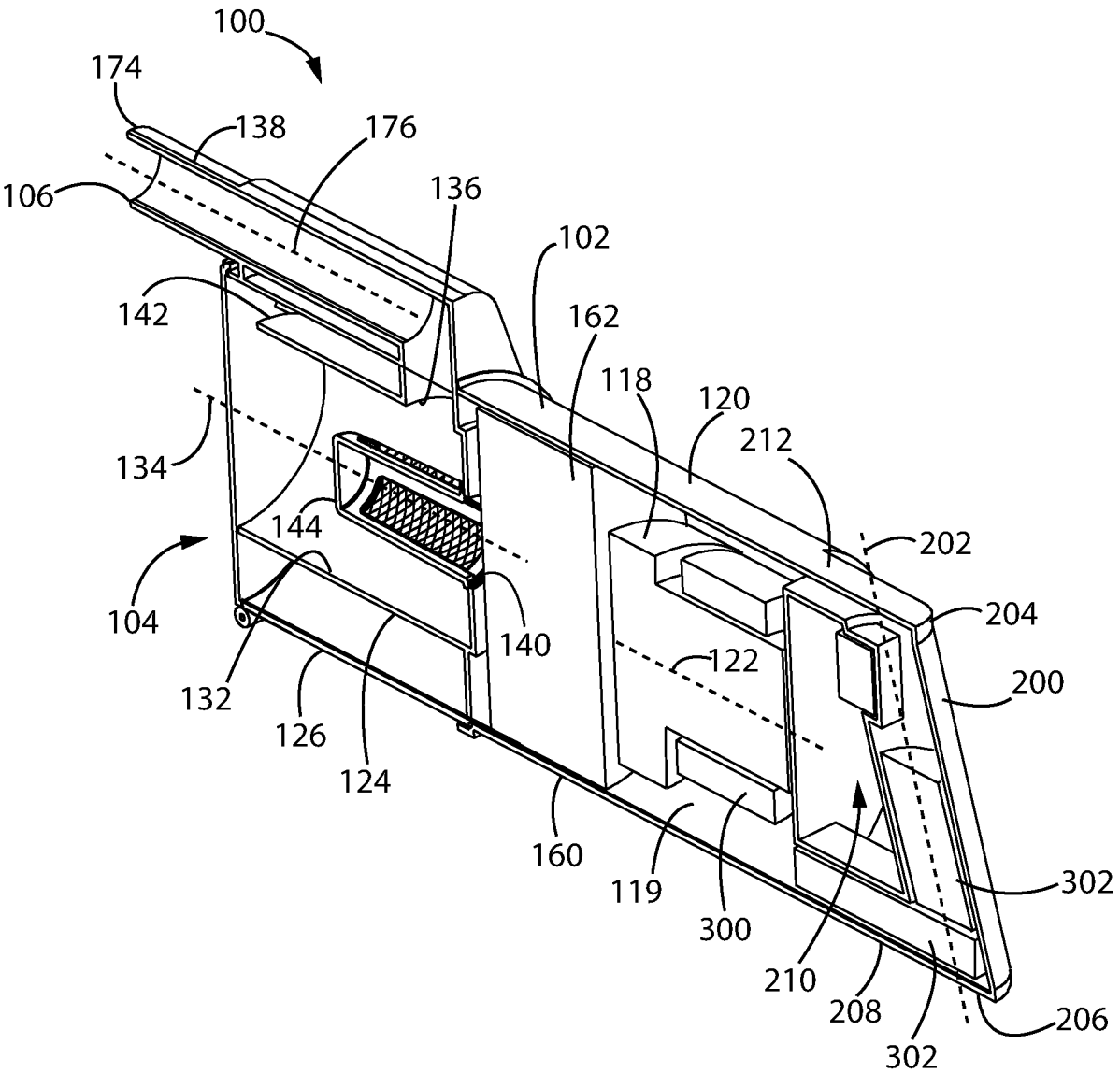
FIG. 55 is a cross-sectional perspective view of the hand vacuum cleaner of FIG. 54.

As exemplified in FIG. 55, spaced apart and rearwardly extending bridge portions 208, 212 extend from the rear side of body portion 120 to lower handle end 206 and upper handle end 204, respectively. In this configuration, finger grip area 210 for receiving the fingers of a user is formed between handle 200 and the rear side of body portion 120. As exemplified in FIG. 55, body portion 120 may be positioned forward of finger grip area 210.

As exemplified in FIGS. 61 and 64, a finger grip area 210 may be formed between grip portion 214 and the hand vacuum cleaner, e.g., between the upper ends of suction motor housing 119 and pre-motor filter housing 160. In the illustrated embodiment of FIG. 63, a finger grip area 210 is formed between a grip portion 222 of handle 200 and the upper ends of suction motor housing 119 and pre-motor filter housing 160.

Power

Hand vacuum cleaner 100 can include one or more energy storage packs 300, 302. A hand vacuum cleaner using any aspect discussed herein may have one or more energy storage members.

Power may be supplied to suction motor 118 and other electrical components of hand vacuum cleaner 100 from one or more energy storage members. Energy storage member may include, for example, batteries, supercapacitors or the like. The energy storage member may be provided in one or more energy storage packs 300, 302, which comprise one or more batteries, supercapacitors or the like. As used herein, "energy storage pack" 300, 302 may refer to a single energy storage member or a plurality of energy storage members that are secured together, such as by an energy storage member housing. Any such energy storage member housing known in the art may be used.

The energy storage members may be permanently mounted in hand vacuum cleaner 100 and rechargeable in-situ, and/or removable from hand vacuum cleaner 100 (e.g., one or more of the energy storage packs may be removable mounted to the hand vacuum cleaner. Alternatively, or in addition, power may be supplied to suction motor 118 by an electrical cord (e.g., see electrical cord 306 of FIG. 13) connected to hand vacuum cleaner 100. The electrical cord can be connected to mains power at a standard wall electrical outlet.

In the illustrated embodiment of FIGS. 1-4, power is supplied to suction motor 118 by a first energy storage pack 300. As exemplified in FIG. 2, an optional second or supplemental energy storage pack 302 may be provided. In some embodiments, multiple supplemental energy storage packs 302 may be provided (e.g., see the illustrated embodiment of FIG. 20 in which two supplemental energy storage packs 302 are provided). One or more supplemental energy storage packs 302 may be provided to, for example, increase the power supplied to suction motor 118 and/or lengthen the duration hand vacuum cleaner 100 can operate with without recharging.

Figure 19:
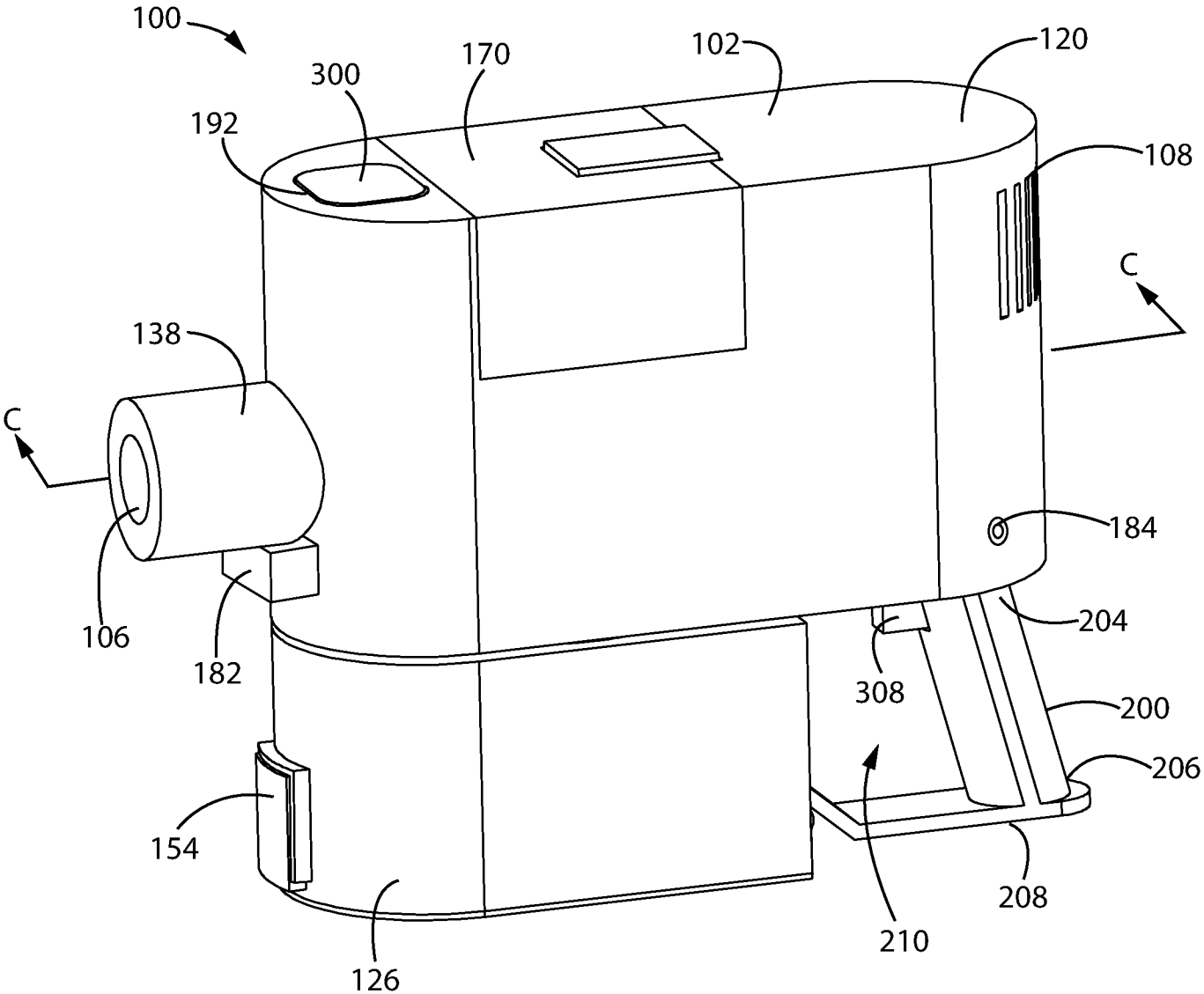
FIG. 19 is a side perspective view of an example hand vacuum cleaner with an energy storage member positioned forward of the suction motor.
Figure 20:
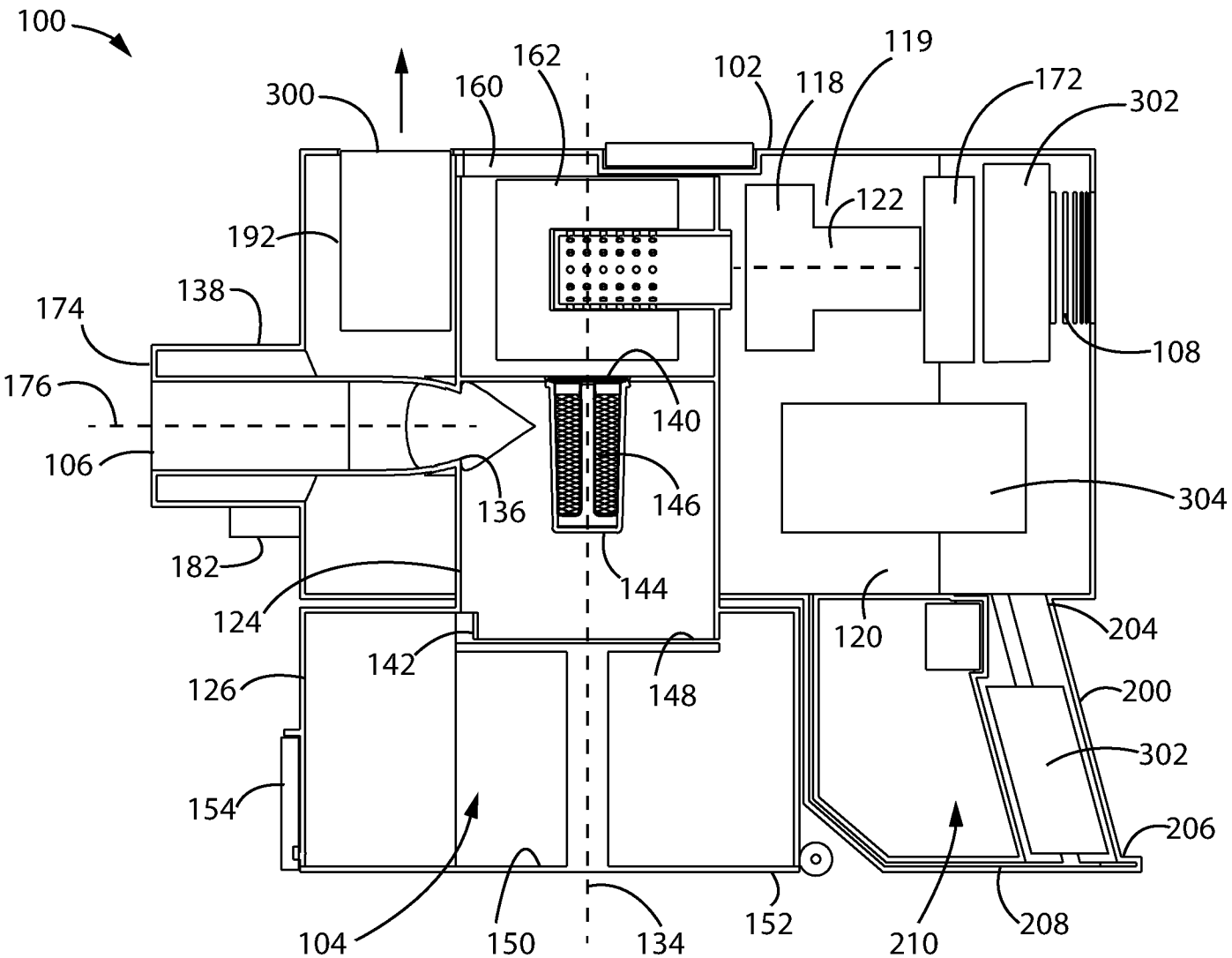
FIG. 20 is a cross-sectional view taken along line C-C of FIG. 19.

Removing first and/or second energy storage packs 300, 302 may facilitate the replacement of discharged batteries within first and second energy storage packs 300, 302. Energy storage packs may be removable connected to hand vacuum cleaner 100 in any suitable fashion. As an example, FIG. 2 shows recesses 188, 190 provided in body portion 120 for receiving corresponding first and second energy storage packs 300, 302. As indicated by the arrows, first energy storage pack 300 is removable upwardly from recess 188, and second energy storage pack 302 is removable rearwardly from recess 190. As another example, FIGS. 19 and 20 show a recess 192 provided forward of pre-motor filter housing 160 for receiving first energy storage pack 300. As indicated by the arrow, first energy storage pack 300 is removable upwardly from recess 192.

Figure 6:
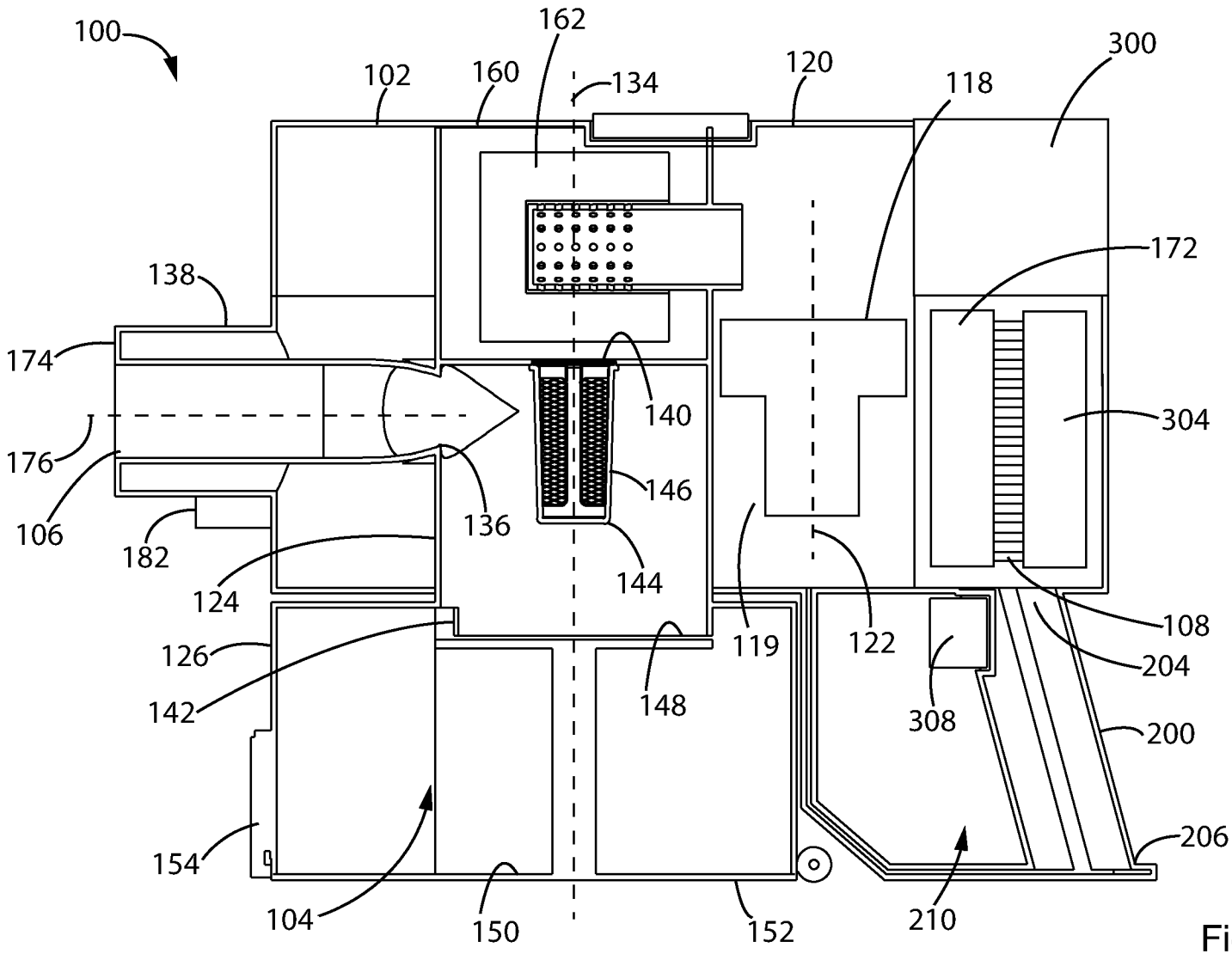
FIGS. 6-12 are cross-sectional views of other example hand vacuum cleaners with an energy storage member positioned above the handle and/or the finger gap.

Alternatively, as exemplified in FIG. 6, first energy storage pack 300 may connect directly to the exterior of body portion 120 (i.e., not received within a body recess). In the illustrated embodiment, top and rear surfaces of first energy storage pack 300 form part of the exterior of hand vacuum clearer 100 when first energy packs 300 is connected. In alternative embodiments, as exemplified in FIG. 9, first and second energy packs 300, 302 may be permanently connected to hand vacuum cleaner 100.

In the illustrated embodiment of FIG. 2, hand vacuum cleaner 100 includes an optional onboard power supply 304. Power supply 304 is electrically connected to first and second energy storage packs 300, 302. Power supply 304 converts direct current (received from mains power) into alternating current and then supplies that alternating current to first and second energy storage members 300, 302. Preferably, power supply 304 is permanently connected to hand vacuum cleaner 100. For example, FIG. 2 shows power supply 304 fully housed in body portion 120. In some embodiments, power supply 304 may be removable from hand vacuum cleaner 100.

Figure 30:
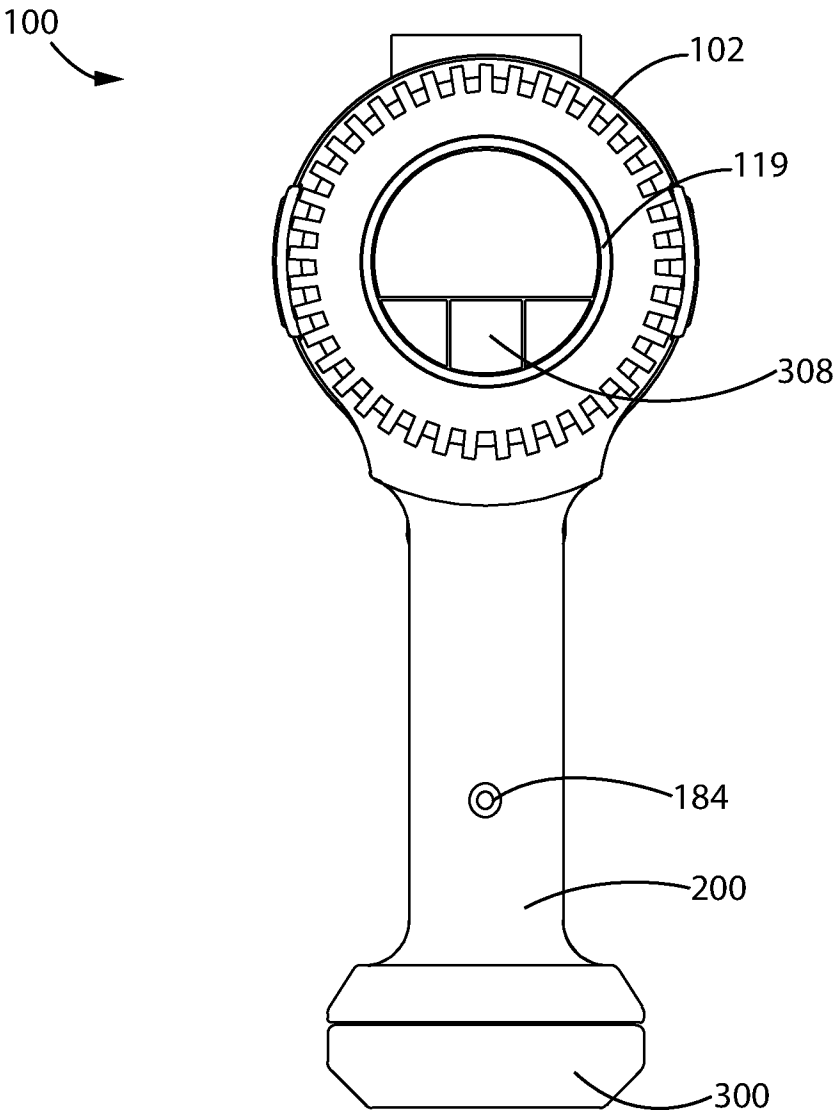
FIG. 30 is a rear view of the hand vacuum clearer of FIG. 28.

First and second energy storage packs 300, 302 may be recharged in-situ by connecting one end of an electrical cord to cord port 184 (FIG. 1) while the other end of the electrical cord is connected to mains power at a standard wall electrical outlet. Cord port 184 may be provided in any suitable location, although it may be convenient to locate cord port 184 proximate the energy storage member(s). As an example, FIG. 1 shows cord port 184 provided on body portion 120 proximate rear end 112 of hand vacuum cleaner 100. As another example, FIG. 30 shows cord port 184 provided on the rear side of handle 200. As exemplified in FIG. 13, cord port 184 is located at lower handle end 206.

Figure 13:
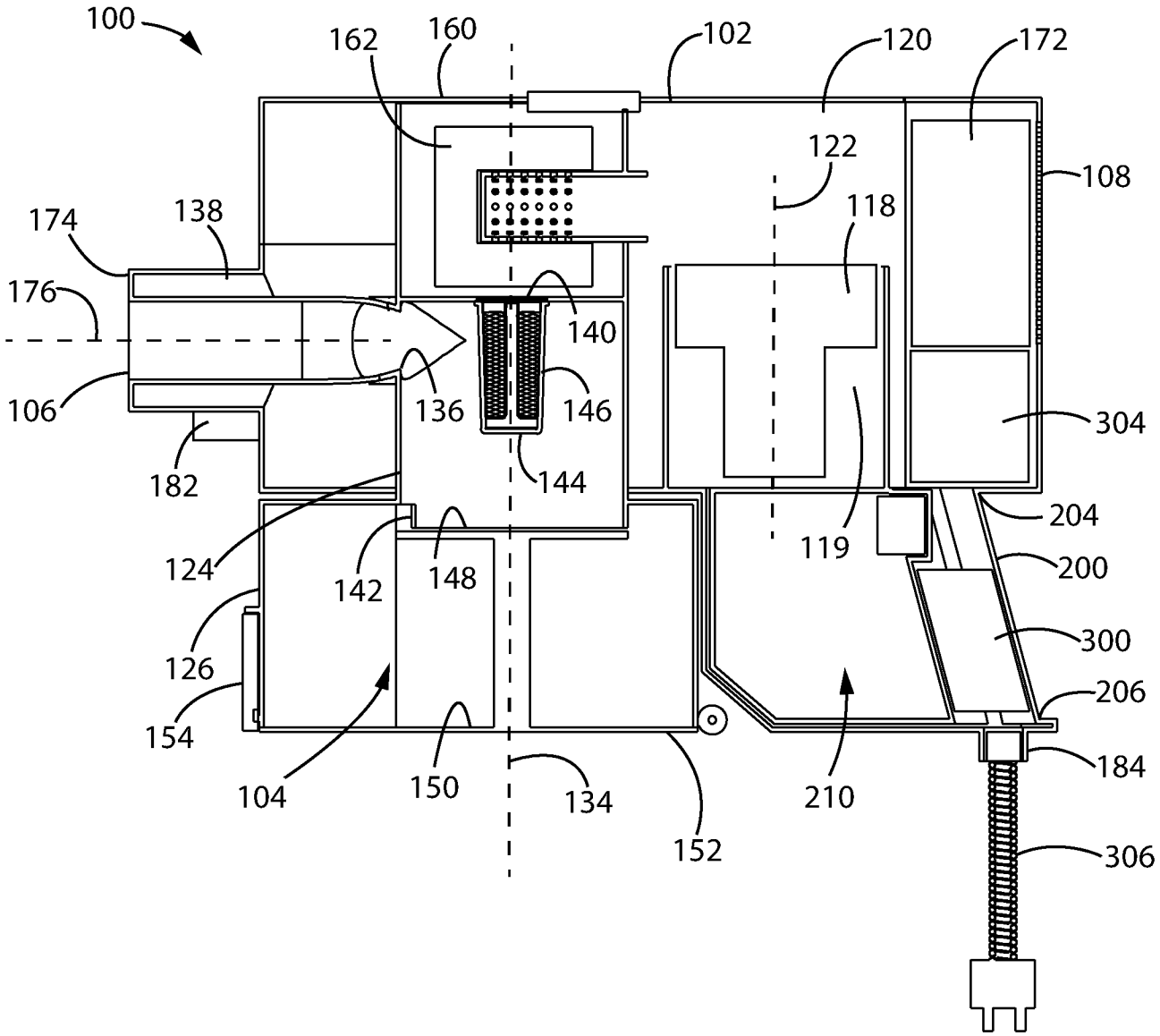
FIG. 13 is a cross-sectional view of an example hand vacuum cleaner connected to a removable power cord.

As exemplified in FIG. 13, cord port 184 may be connected to a removable electrical cord 306 (e.g., female socket member of cord port 184 mates with male socket member of electrical cord 306). Electrical cord 306 can be connected to recharge one or more of the on-board energy storage members. Alternatively, electrical cord 306 can be connected to supply power to suction motor 118 and other electrical components of hand vacuum cleaner 100 (e.g., for corded use).

Figure 14:
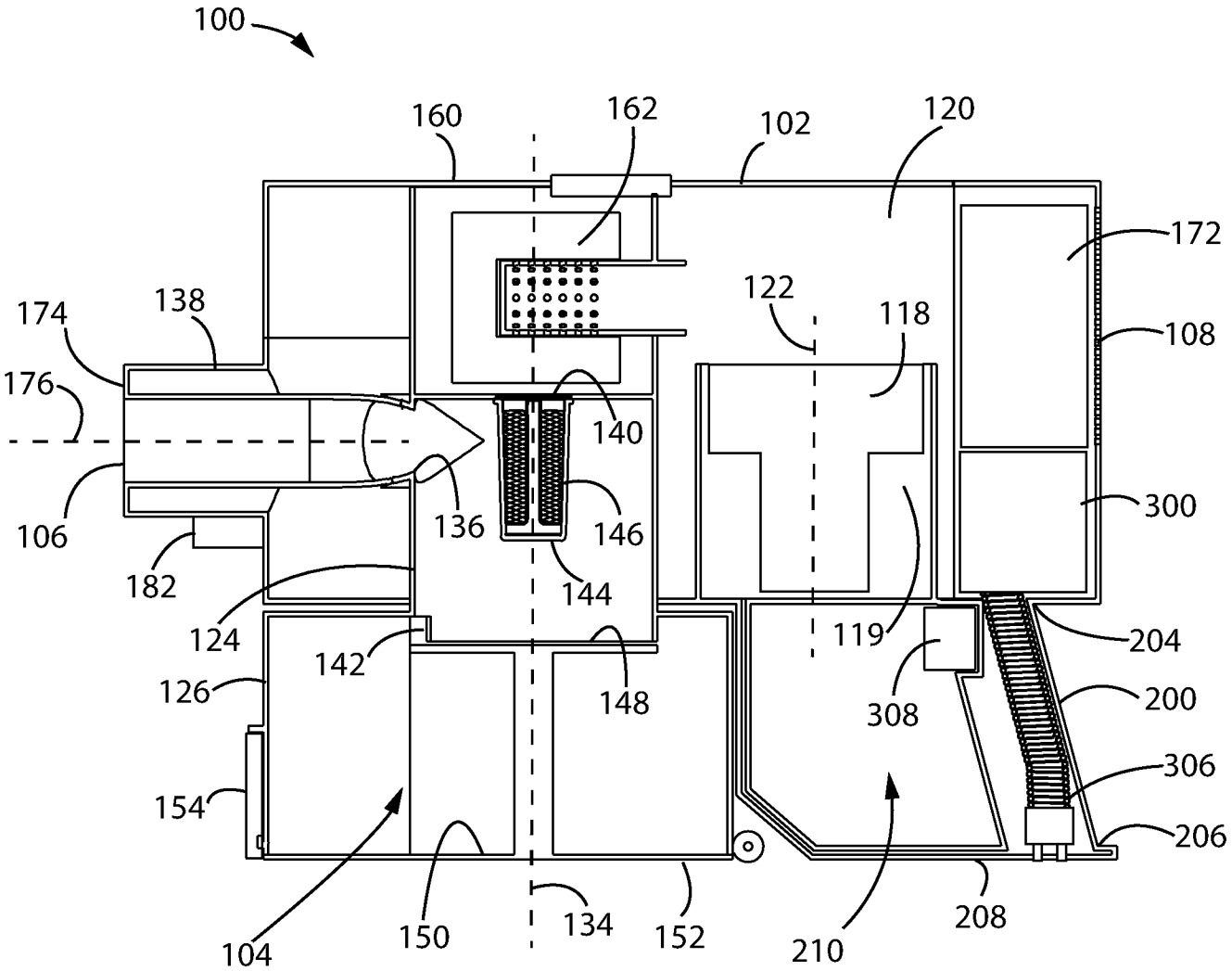
FIG. 14 is a cross-sectional view of an example hand vacuum cleaner with an extendable power cord housed in the handle.
Figure 15:
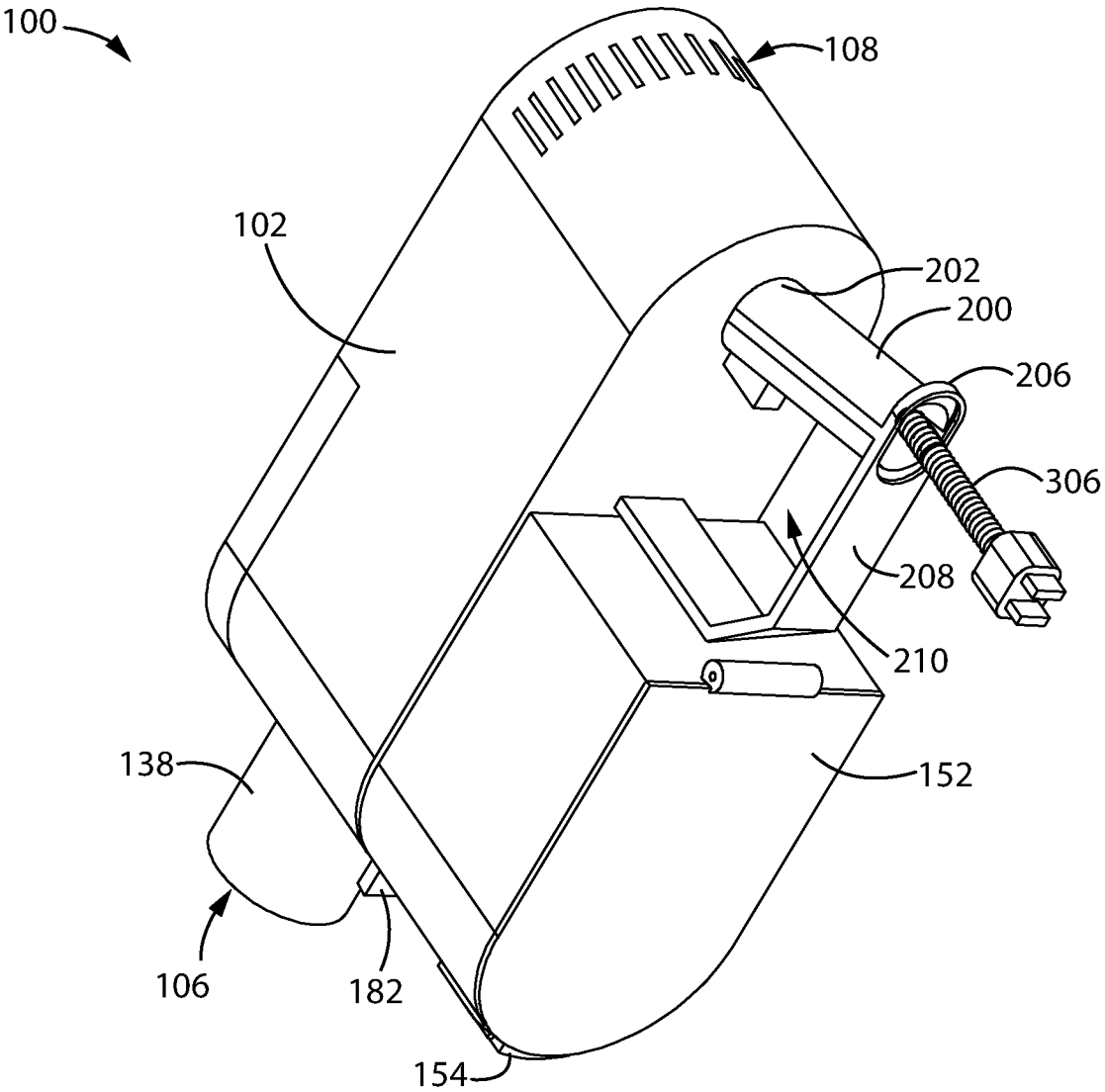
FIG. 15 is a bottom perspective view of the hand vacuum cleaner of FIG. 14 with the power cord extended from the lower end of the handle.

Optionally, as exemplified in FIGS. 14-15, electrical cord 306 may be housed in handle 200. As shown in FIG. 15, electrical cord 306 can be extended from lower handle end 206 so that it can be connected to mains power at a wall electrical outlet. Preferably, it is its "non-extended" state, electrical cord 306 is fully housed in handle 200 (i.e., no part of electrical cord 306 sticks out from lower handle end 206). In the illustrated embodiment, electrical cord 306 is a resilient coiled wire that returns to its natural state when a supplied tension is removed. Optionally, electrical cord may be a low voltage cord (e.g., 9V). In such a case, a power supply may be provided remotely (such as in a wall plug) so as to provide low voltage power to electrical cord 306. It will be appreciated that, in such an embodiment, the hand vacuum cleaner may not include a power supply 304.

In alternative embodiments, a cord reel (not shown) may be provided to facilitate retraction of electrical cord 306 back into handle 200.

Electrical cord 306 may be electrically connected (either directly or indirectly) to any (or all) of energy storage packs 300, 302 and/or power supply 304. As exemplified in FIG. 14, electrical cord 306 is directly connected to first energy storage pack 300. As exemplified in FIGS. 21-23, electrical cord 306 is directly connected to power supply 304.

Hand vacuum cleaner 100 may include a power switch 308 that is provided to selectively control the operation of the suction motor (e.g., either on/off or variable power levels or both), for example by establishing a power connection between energy storage pack 300, 302 and suction motor 118. Power switch 308 may be provided in any suitable configuration and location, including a button, rotary switch, sliding switch, trigger-type actuator, and the like. As an example, the illustrated embodiment of FIG. 2 shows power switch 308 provided as a trigger-type actuator. As another example, the illustrated embodiment of FIG. 30 shows power switch 308 provided as a button located on rear end of suction motor housing 119.

As described subsequently, first and second energy storage packs 300, 302 and power supply 304 may have various positional arrangements, which may improve the ergonomics of the hand vacuum cleaner 100 (e.g., reduced weight, better weight balance, or greater portability).

Position of Handle 200

Hand vacuum cleaner 100 may have a handle 200 positioned on a lower end of the main body 102 such that main body 102 may overlie part or all of finger grip area 210 and/or handle (e.g., upper handle end 204). A hand vacuum cleaner using any aspect discussed herein may have a main body 102 that overlies part or all of finger grip area 210 and/or the handle. For example, at least 50% (e.g., 50%, 60%, 70%, 80%, 90%, or more) of main body 102 may overlie upper handle end 204.

As used herein, Element A is said to "overlie" Element B if, when viewed from, e.g., a top plan view with hand vacuum cleaner 100 oriented upper end 114 above lower end 116, at least a portion of the length of element A (in the forward/rearward direction) overlaps the length of Element B (in the forward/rearward direction). For example, if it is said that 50% of element A overlies Element B, it means that 50% of Element A's length overlaps Element B when viewed from the top plan. "Overlie" does not necessarily mean directly overlie. For example, Element A still overlies element B even when an Element C is positioned between Elements A and B. Accordingly, in the embodiment of FIG. 2, body portion 120 overlies all of the upper end of the handle 200 and all of the finger grip area 210.

Position of First Energy Storage Pack 300

A hand vacuum cleaner using any aspect discussed herein may have a first energy storage pack 300 positioned at any location discussed herein.

First energy storage pack 300 may be provided in various positions. For example, first energy storage pack 300 may be positioned in body portion 120 (see, e.g., FIGS. 2, 7, 9, and 49). The following discussion sets out various possible positions of first energy storage pack 300 with respect to other components of the hand vacuum cleaner. While the position of first energy storage pack 300 with respect to other components is discussed separately with respect to each other component, it will be appreciated that any embodiment of a hand vacuum cleaner may utilize the positioning of the first energy storage pack 300 with respect one or more of the other components discussed herein.

First energy storage pack 300 may be removably mounted to the hand vacuum cleaner. Removing first energy storage pack 300 may facilitate replacement of an expired battery with a charged one. Alternately, first energy storage pack 300 may be permanently connected to the hand vacuum cleaner.

First energy storage pack 300 may be positioned rearward of the air treatment assembly, e.g., in main body 102, or forward of cyclone chamber 124 (see, e.g., FIGS. 20-26) and in such a position, it may be mounted in the air treatment assembly or a portion of the main body 102.

With respect to pre-motor filter housing 160, first energy storage pack 300 may be positioned directly or indirectly rearward of pre-motor filter housing 160 (a horizontal plane may extend through the pre-motor filter 162 and the first energy storage pack 300 as exemplified in FIGS. 6, 49, 55, 56 and 60) and may be located partially or fully above or below thereof, directly or indirectly forward of pre-motor filter housing 160 (see, e.g., FIGS. 20-26) and may be located partially or fully above or below thereof, directly or indirectly above pre-motor filter housing 160 (see, e.g., FIG. 27), directly or indirectly below pre-motor filter housing 160. For example, first energy storage pack 300 may be located rearward and vertically spaced from pre-motor filter housing 160 (see, e.g., FIG. 42).

Optionally, first energy storage pack 300 may be positioned partially or fully in handle 200 (see, e.g., FIG. 13), and may be removably positionable therein.

Optionally, first energy storage pack 300 may be positioned at lower handle end 206 (e.g., see FIGS. 28, 33, 34, 50, and 52). First energy storage pack 300 may be mounted to lower handle end 206 in any suitable manner. As exemplified in FIG. 28, first energy storage pack 300 may be removably mounted to lower handle end 206 via a locking member 224. For example, first energy storage pack 300 may be removably mounted to lower handle end 206 using dove-tail mounting members, mechanical fasteners such as screws, etc.

Figure 36:
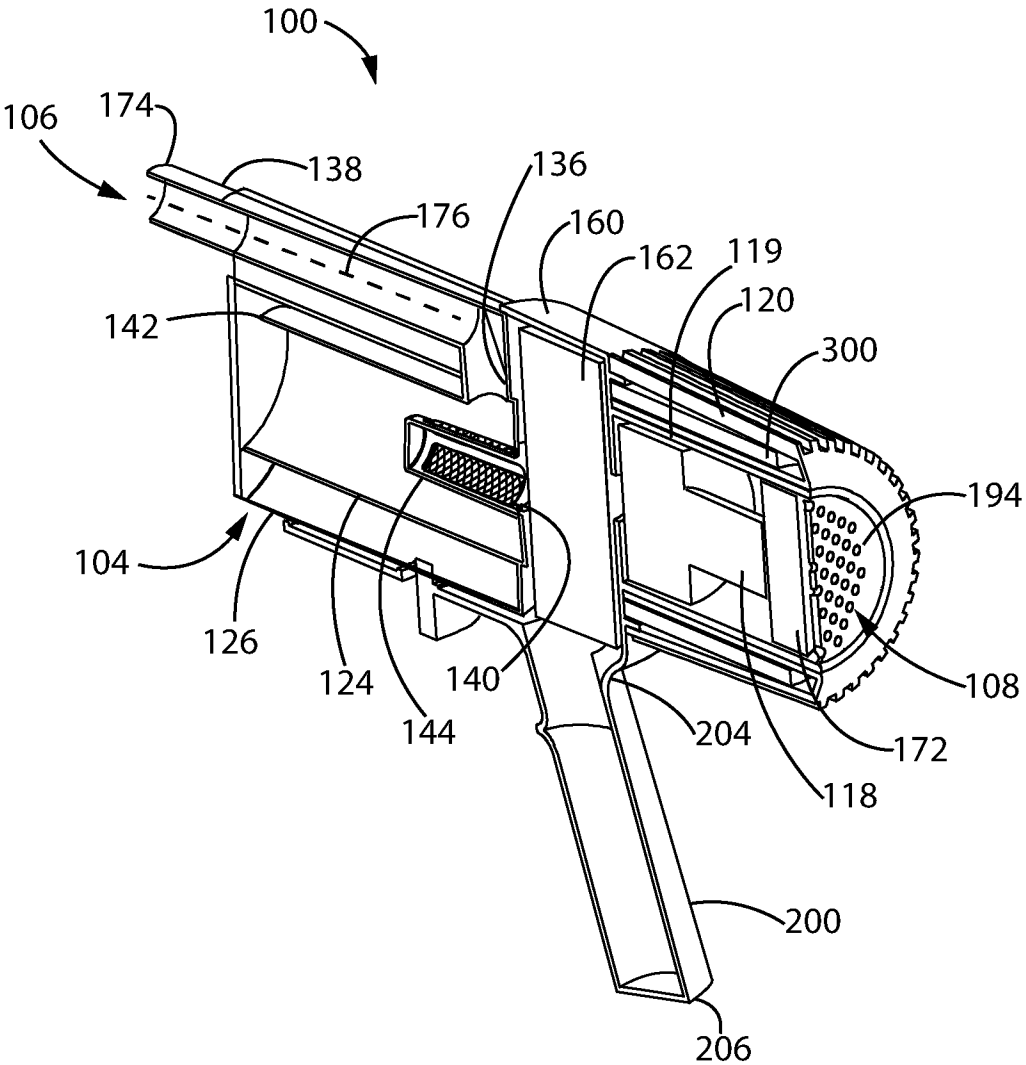
FIG. 36 is a cross-sectional perspective view of an example hand vacuum cleaner with an annular battery surrounding the suction motor.

Optionally, first energy storage pack 300 may be positioned above handle 200. For example, it may be provided in main body 102 at a lower end thereof directly overlying the upper end of the handle (e.g., see FIG. 2), in main body 102 at an upper end thereof overlying part or all of the upper end of the handle and/or the finger grip area (e.g., see FIGS. 6-12, 14), rearward of the handle (e.g., see FIGS. 36 and 49) or underlying the handle (e.g., see FIG. 57).

Figure 41:
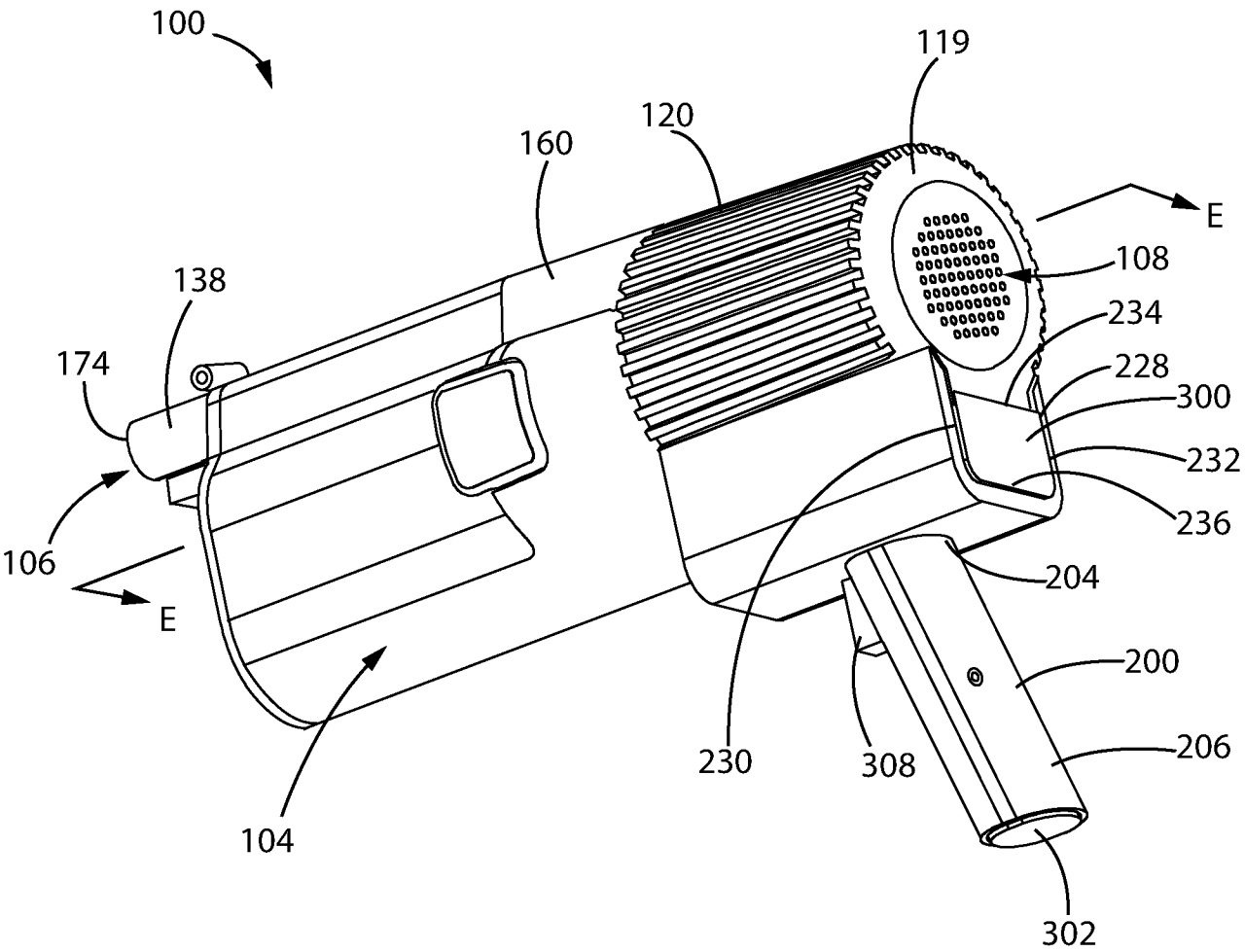
FIG. 41 is a side perspective view of an example hand vacuum cleaner with a recess provided at the upper end of the handle for removably receiving an energy storage member.

Optionally, first energy storage pack 300 may be positioned exterior to the main body 102, e.g., between upper handle end 204 and suction motor housing 119 (e.g., see FIGS. 41 and 43) and/or between upper handle end 204 and pre-motor filter housing 160 and/or between upper handle end 204 and the air treatment assembly.

Figure 11:
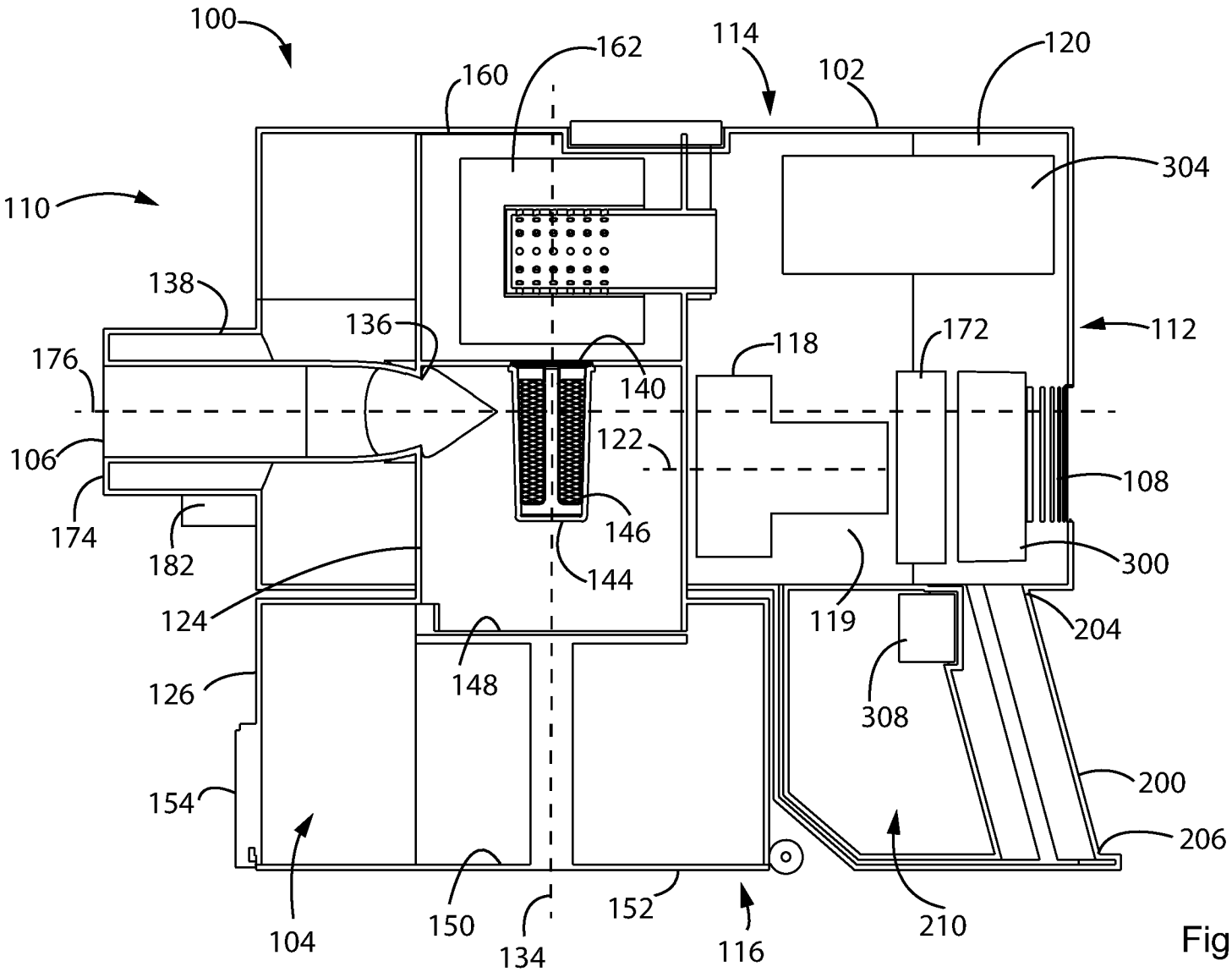

Regardless of whether first energy storage pack 300 is internal or external the main body, at least a portion of first energy storage pack 300 may overlie upper handle end 204 (see, e.g., FIGS. 2, 6-8, 11, 12, 14, 18, and 41-44). For example, at least 50% (e.g., 50%, 60%, 70%, 80%, 90%, or more) of first energy storage pack 300 may overlie upper handle end 204. As an example, the illustrated embodiment of FIG. 6 shows about 50% of first energy storage pack 300 overlying upper handle end 204. As another example, the illustrated embodiment of FIG. 11 shows 100% of first energy storage pack 300 overlying upper handle end 204.

Figure 10:
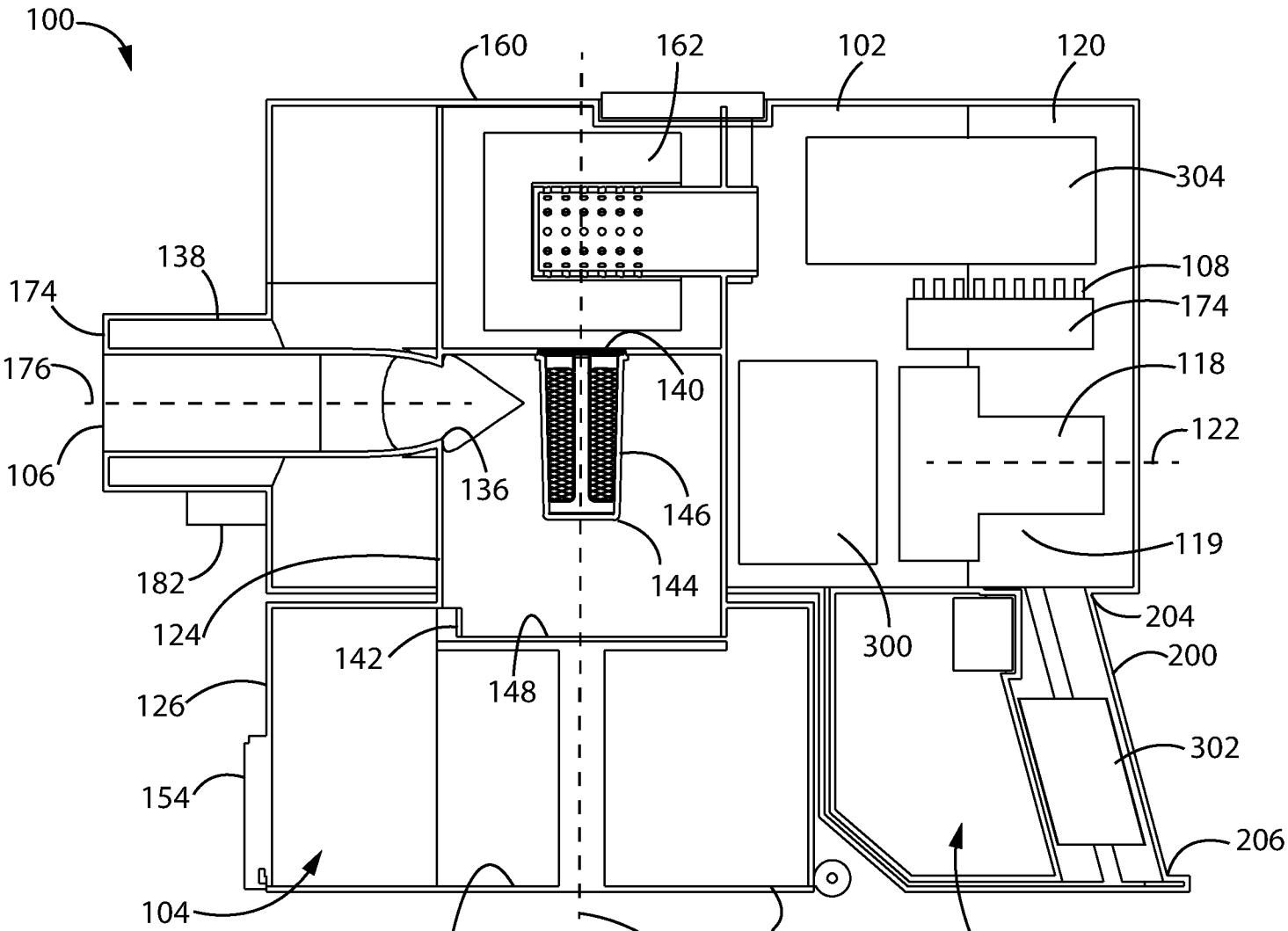
Figure 12:
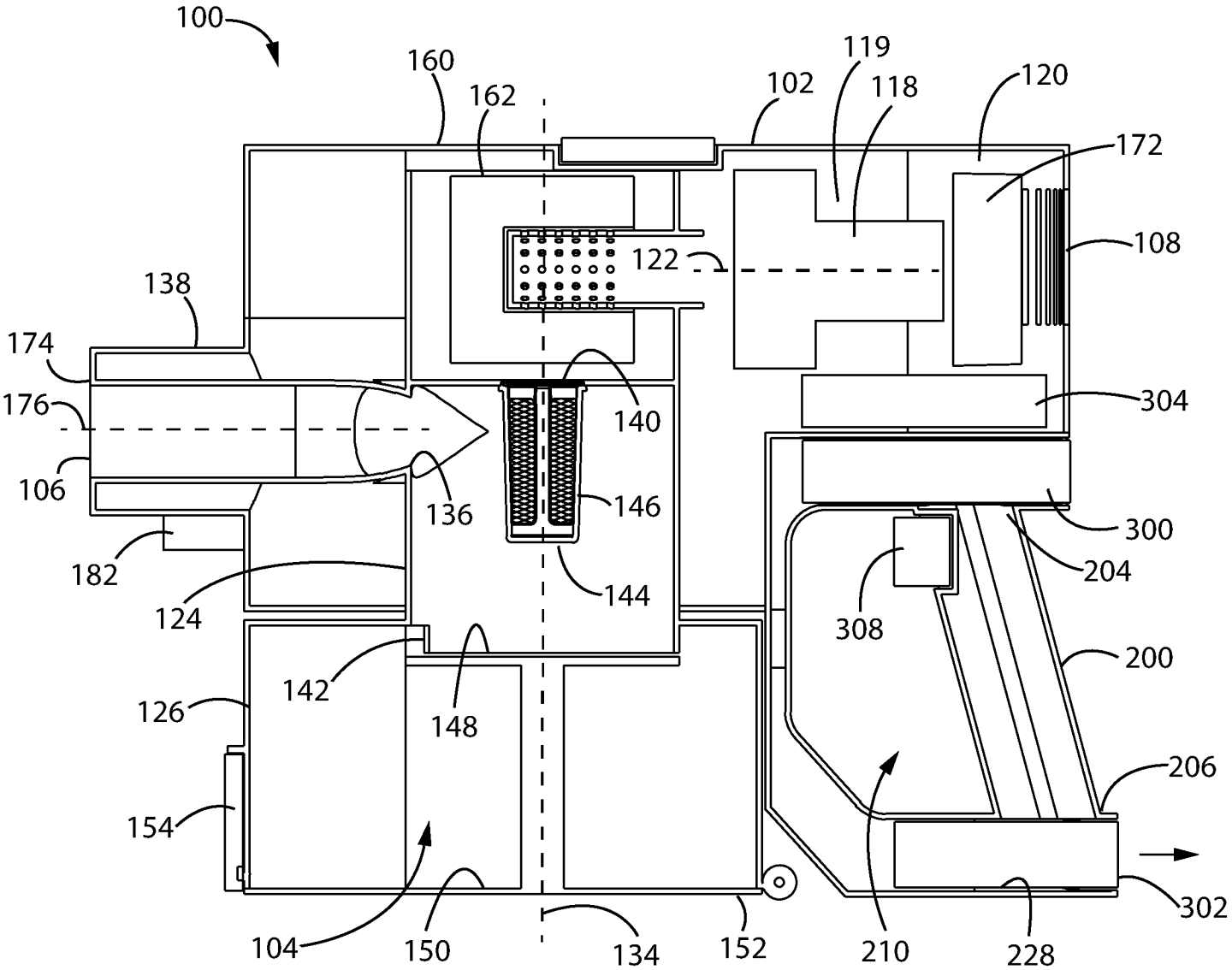
Figure 18:
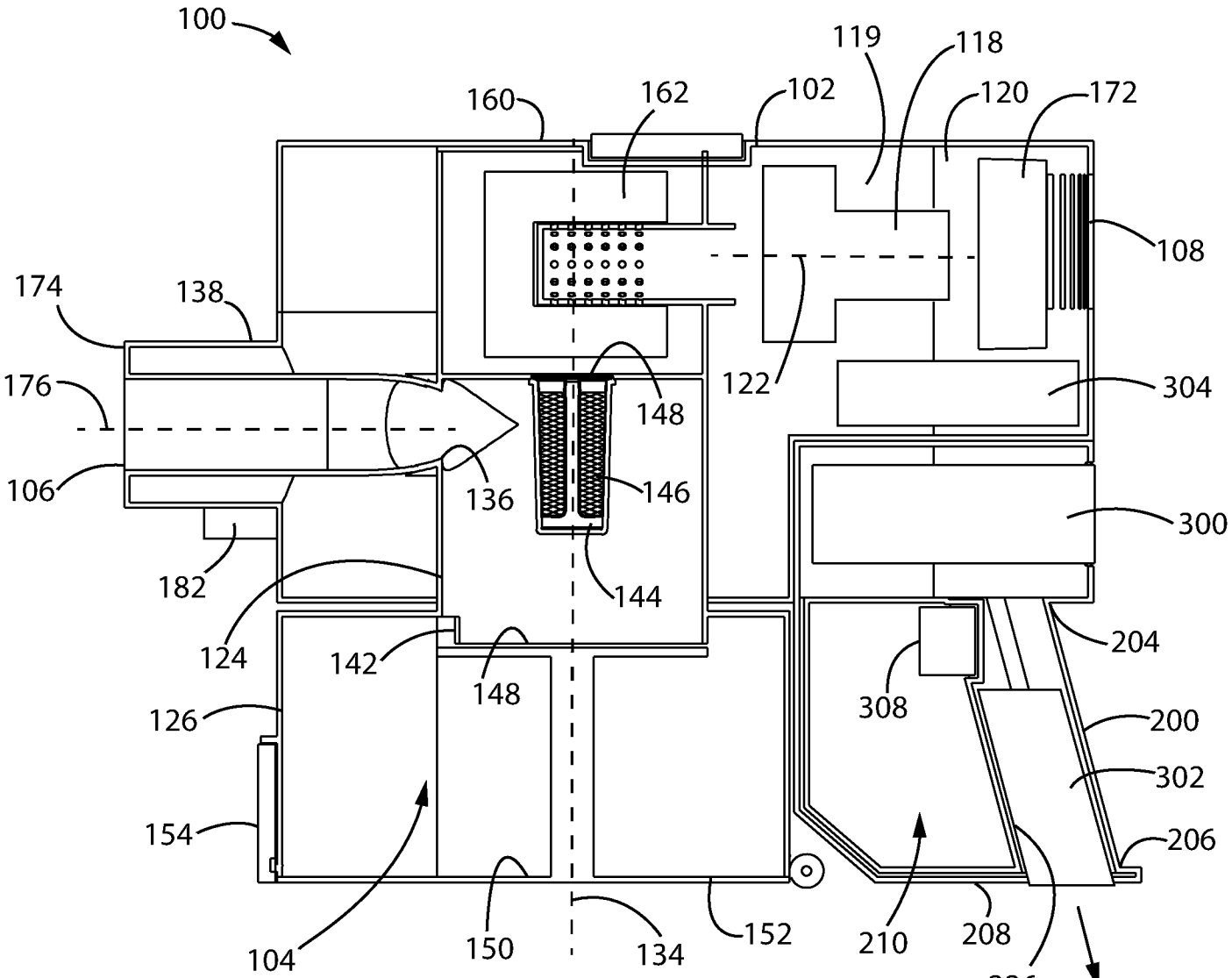
FIG. 18 is a cross-sectional view taken along line B-B of FIG. 16.

Alternately, or in addition, at least a portion of first energy storage pack 300 may overlie finger grip area 210 (see, e.g., FIGS. 10, 12 and 18). For example, at least 50% (e.g., 50%, 60%, 70%, 80%, 90%, or more) of first energy storage pack 300 may overlie finger grip area 210. As an example, the illustrated embodiment of FIG. 18 shows about 50% of first energy storage pack 300 overlying finger grip area 210.

Figure 44:
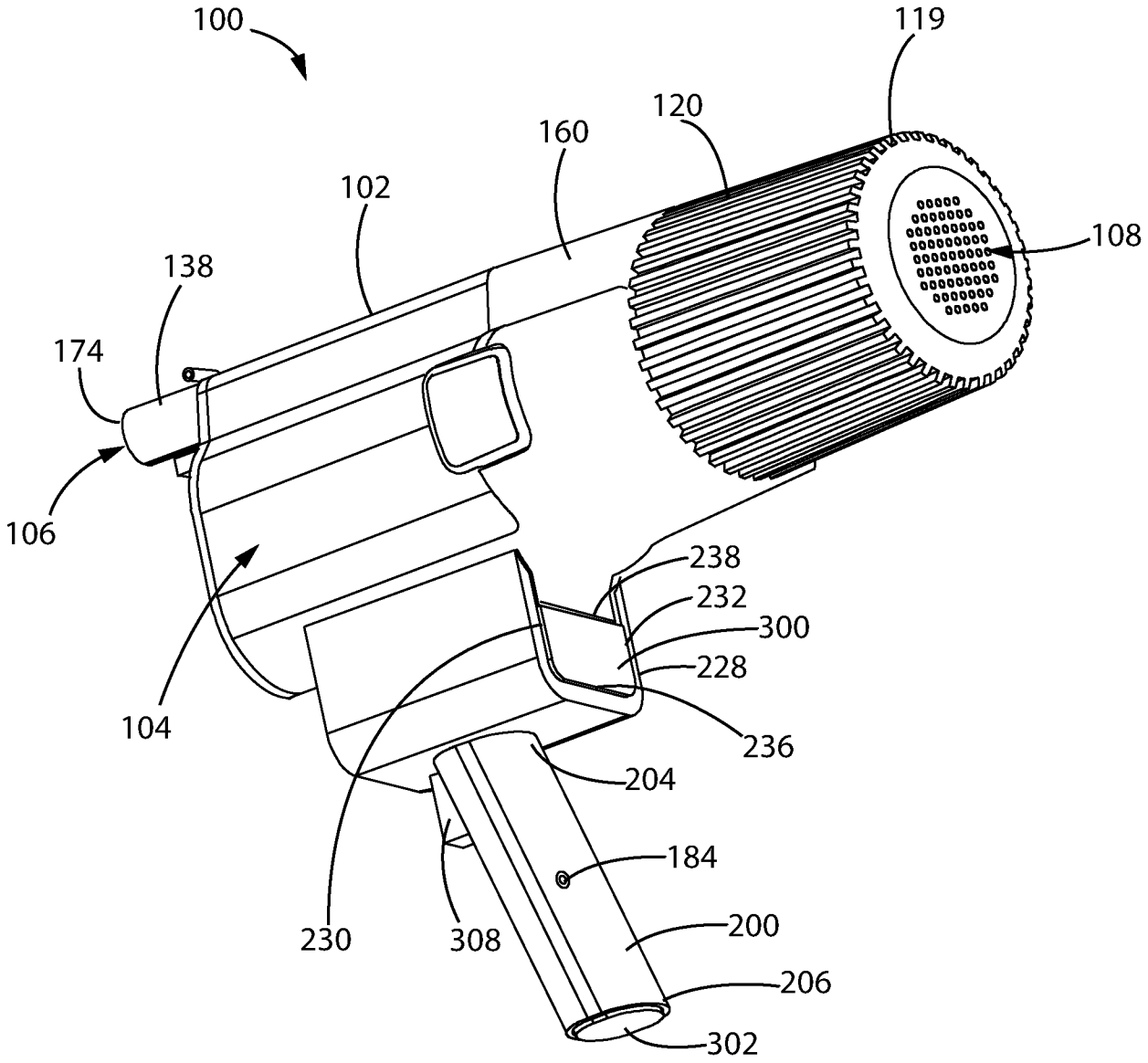
Figure 45:
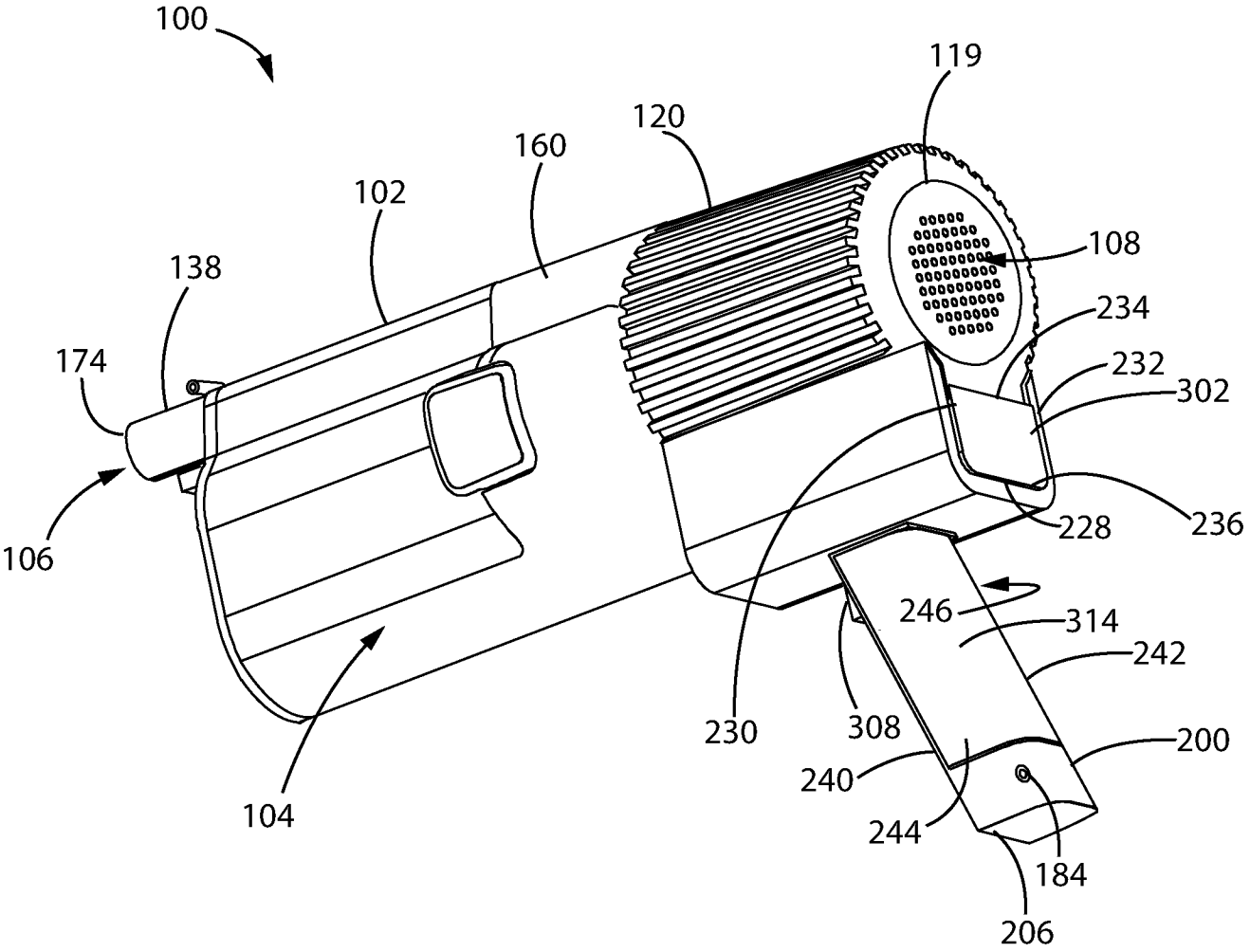
FIG. 45 is a side perspective view of an example hand vacuum cleaner with a removable battery pack mounted to the handle.
Figure 46:
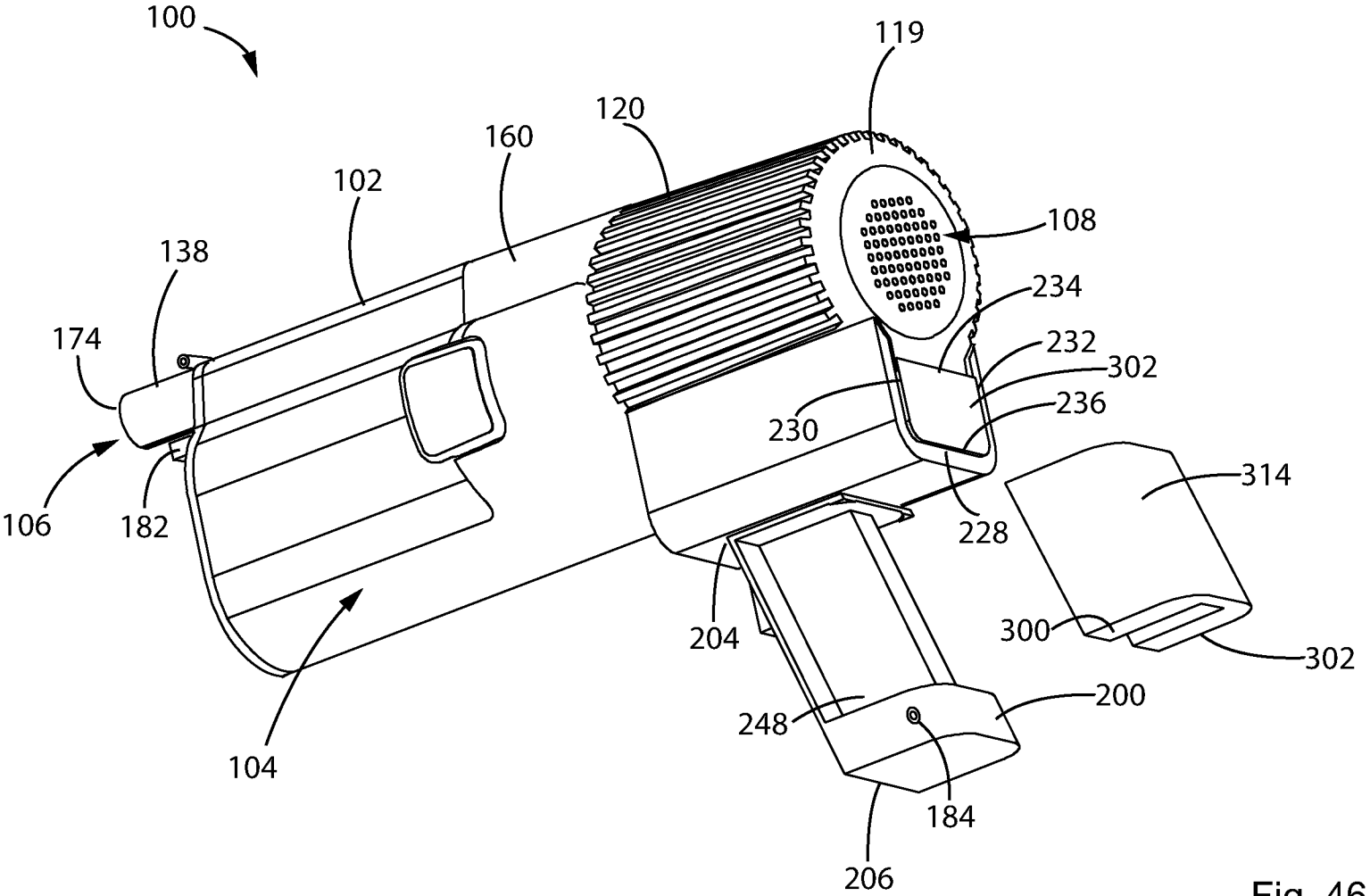
FIG. 46 is a side perspective view of the hand vacuum cleaner of FIG. 45 with the battery pack removed from the handle.
Figure 47:
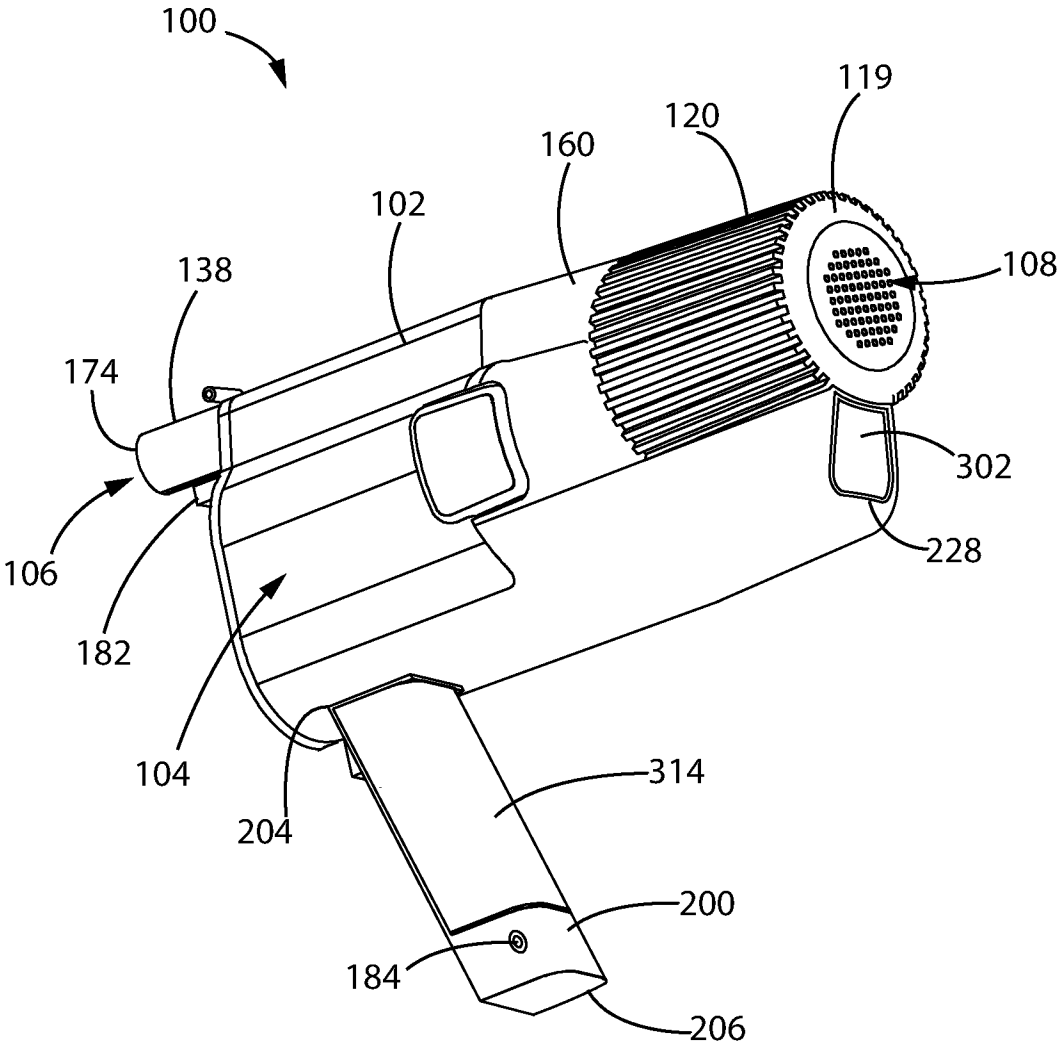
FIG. 47 is a side perspective view of another example hand vacuum cleaner with a removable battery pack mounted to the handle.

Hand vacuum cleaner 100 may include an energy storage member recess 228. A recess 228 may be provided if the first energy storage pack 300 is removably mountable to the hand vacuum cleaner. The recess may be provided in the main body 102, the air treatment assembly or as part of the handle. As exemplified in FIGS. 41-47, recess 228 is provided at upper handle end 204. As shown in FIGS. 41-44, energy storage member recess 228 removable receives first energy storage pack 300. As shown in FIGS. 45-47, energy storage member recess 228 removable receives second energy storage pack 302. As exemplified, upper handle end 204 may have first and second spaced apart struts 230, 232 which are mounted to body portion 120. In the illustrated embodiments of FIGS. 41 and 43, energy storage member recess 228 is provided between first and second spaced apart struts 230, 232, a lower surface 234 of body portion 120, and an upper surface 236 of handle 200. In the illustrated embodiment of FIG. 44, energy storage member recess 228 is provided between first and second spaced apart struts 230, 232, a lower surface 238 of air treatment assembly 104, and an upper surface 236 of handle 200.

Figure 7:
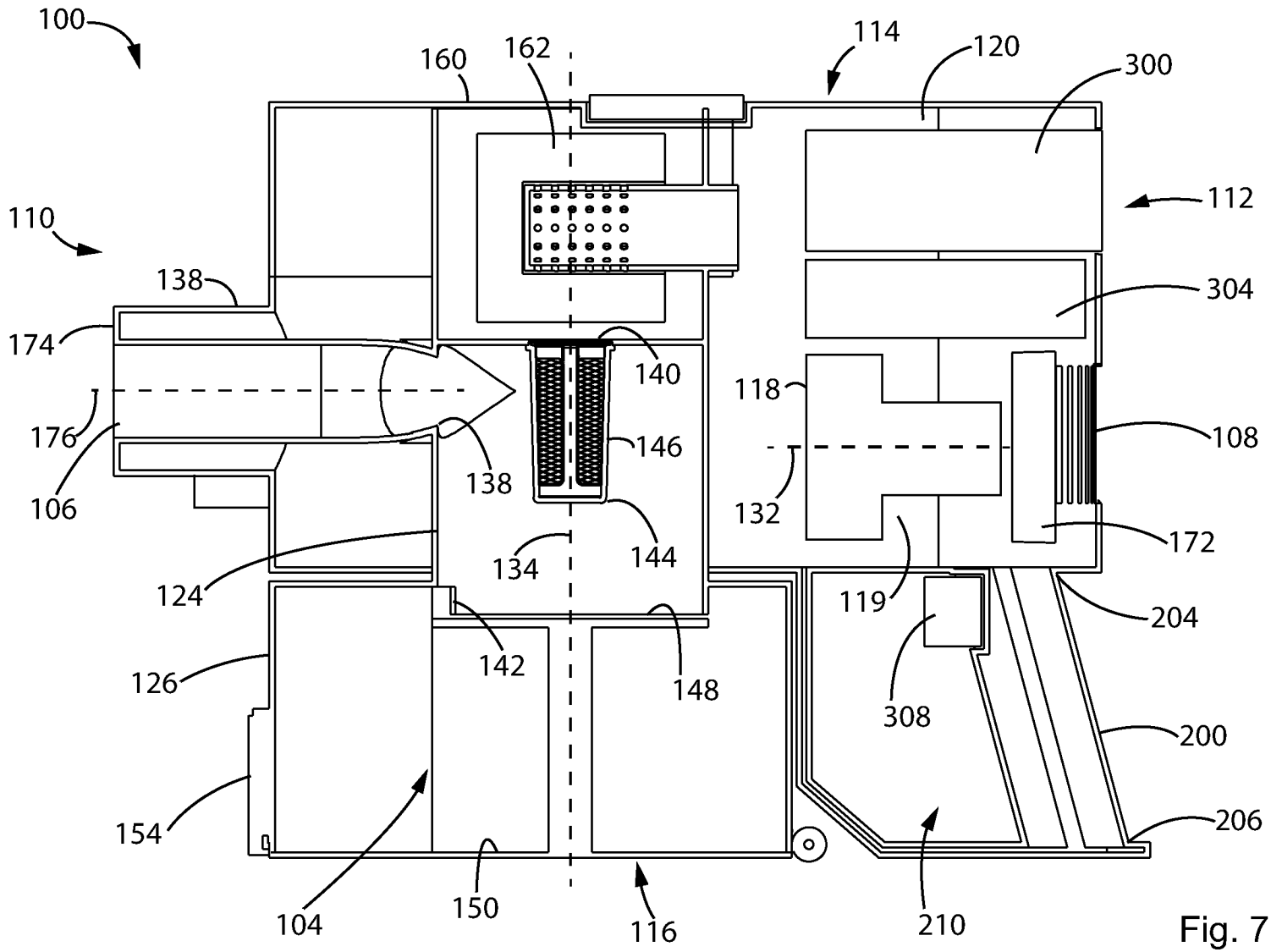
Figure 8:
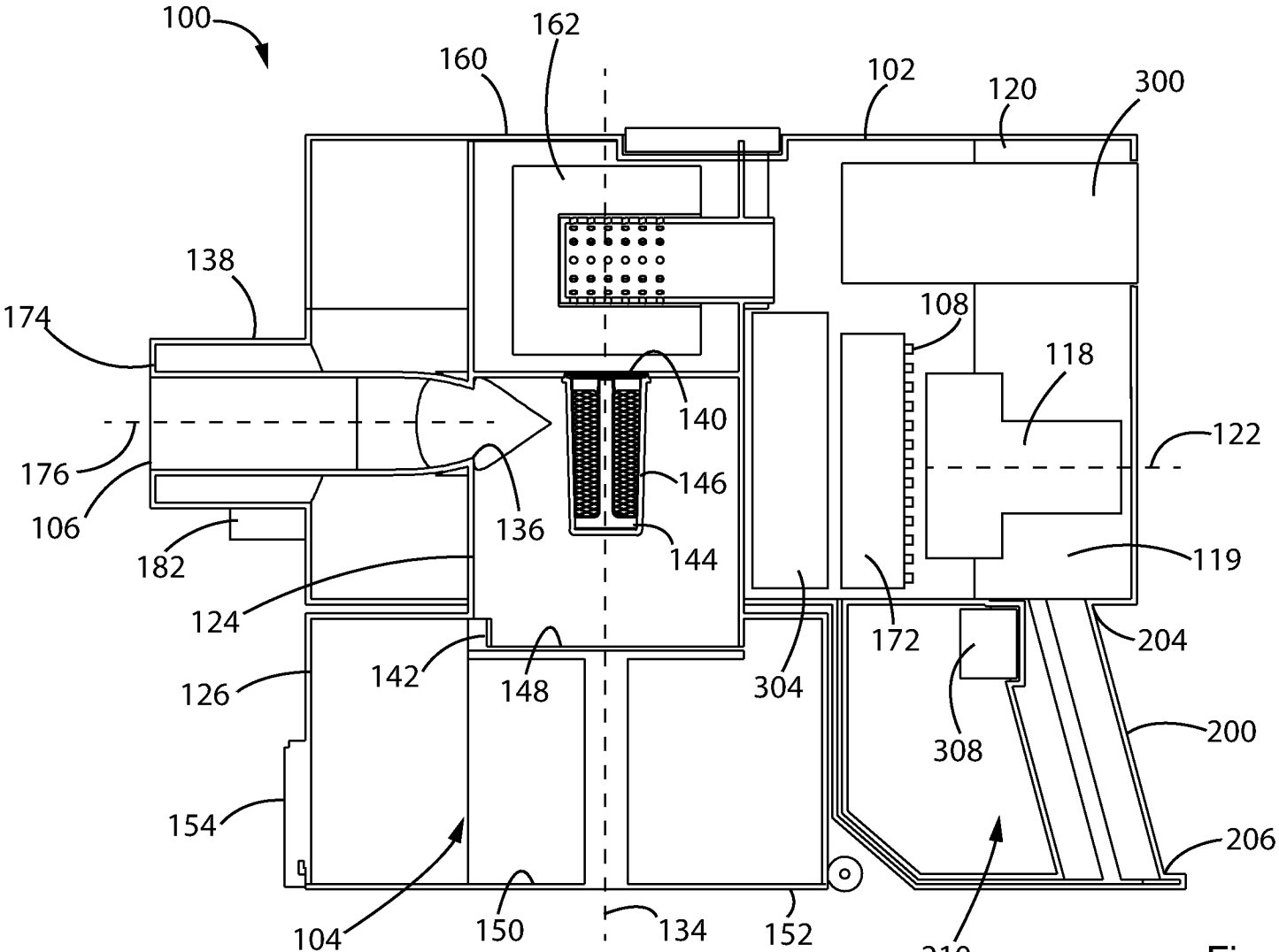

With respect to suction motor 118, first energy storage pack 300 may be positioned directly or indirectly rearward of suction motor 118 such that a horizontal axis (e.g., suction motor axis 122) extends through suction motor 118 and first energy storage pack 300 (see, e.g., FIGS. 2, 6, 11 and 14) and may be located partially or fully above or below thereof, directly or indirectly forward of suction motor 118 and optionally directly or indirectly forward of at least a portion of the air treatment member (see, e.g., FIGS. 20-27) and may be located partially or fully above or below thereof, indirectly below suction motor 118 (see, e.g., FIGS. 18, 33, 49, 56, and 57), directly below suction motor 118 (see, e.g., FIGS. 42, 55 and 56), indirectly above suction motor 118 (see, e.g., FIG. 7) or directly above suction motor 118 (see, e.g., FIG. 8). For example, suction motor 118 may be located exterior to the main body 102 and below the suction motor 118 (e.g., see FIGS. 12, 13 and 18), in the main body rearward of the air treatment member and directly rearward of suction motor 118 (see, e.g., FIG. 14), in the main body directly or indirectly rearward of the air treatment member and indirectly rearward of suction motor 118 (see, e.g., FIG. 11), rearward of and vertically spaced from suction motor 118 (see, e.g., FIGS. 6, 12, 13 and 53), in the main body rearward of the air treatment member and indirectly forward of suction motor 118 (see, e.g., FIG. 9), or in the main body rearward of the air treatment member and directly forward of suction motor 118 (see, e.g., FIG. 10), It will be appreciated that at least a portion of first energy storage pack 300 may overlie or underlie suction motor 118 (see, e.g., FIGS. 7 and 8). In some embodiments, at least 50% (e.g., 50%, 60%, 70%, 80%, 90%, or more) of first energy storage pack 300 may overlie suction motor 118. As an example, the illustrated embodiment of FIG. 7 shows about 75% of first energy storage pack 300 overlying suction motor 118.

Figure 35:
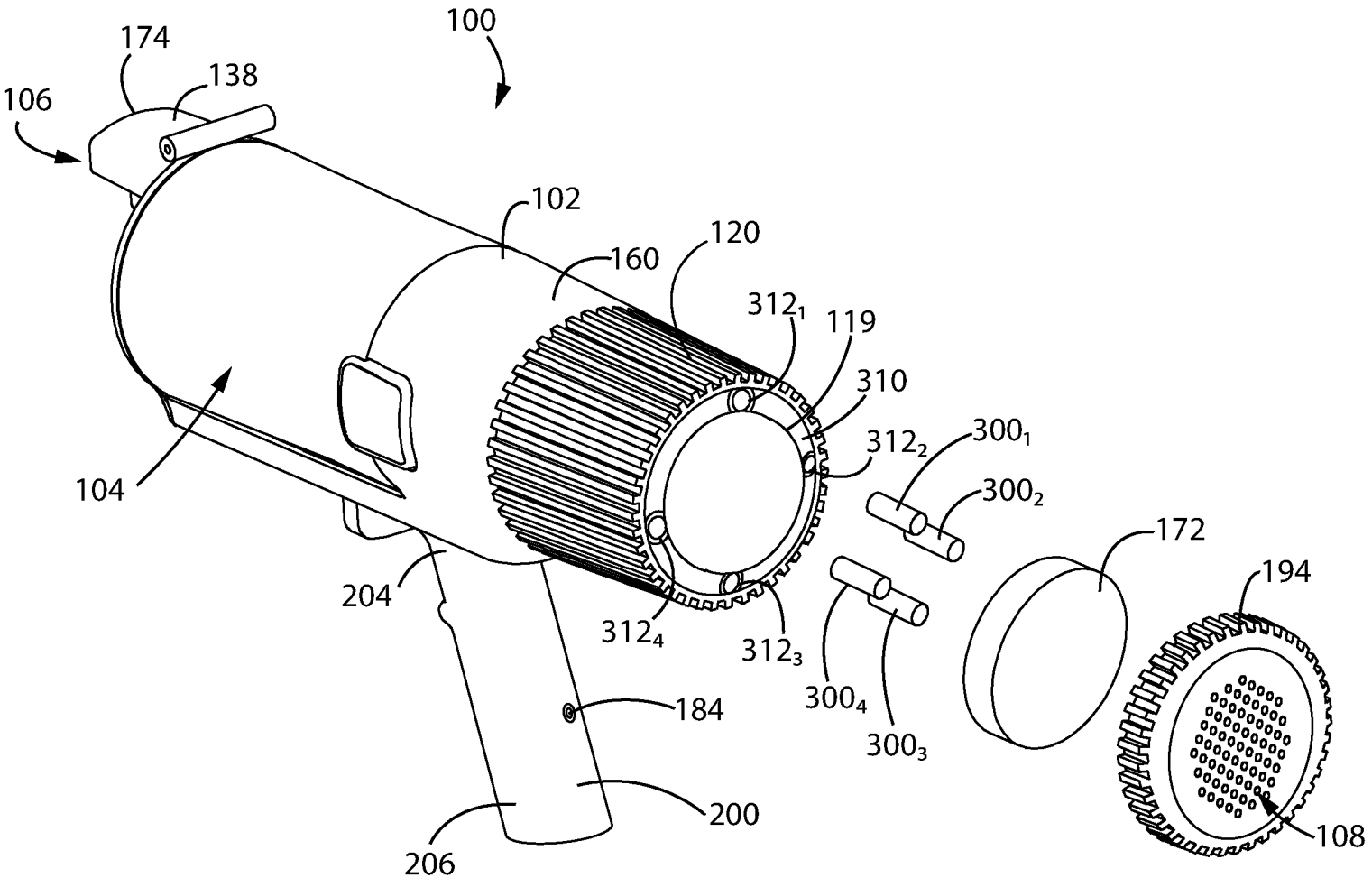
FIG. 35 is a partially exploded perspective view of an example hand vacuum cleaner with multiple batteries positionable radially outward of the suction motor.

Optionally, part or all of first energy storage pack 300 is positioned radially outwardly of suction motor 118. In the illustrated embodiment of FIGS. 35, 39 and 40, four first energy storage members $300_1$, $300_2$, $300_3$, $300_4$ (e.g., "AA" batteries) are positionable radially outwardly of suction motor housing 119. As exemplified, an annular battery housing 310 is positioned surrounding suction motor housing 119. Annular battery housing 310 as illustrated has four evenly distributed battery recesses $312_1$, $312_2$, $312_3$, $312_4$. Each battery recess $312_1$, $312_2$, $312_3$, $312_4$ of annular battery housing 310 receives a corresponding battery $300_1$, $300_2$, $300_3$, $300_4$. Accordingly, when batteries $300_1$, $300_2$, $300_3$, $300_4$ are received within corresponding battery recesses $312_1$, $312_2$, $312_3$, $312_4$, battery $300_1$ is positioned above suction motor housing 119, battery $300_3$ is positioned below suction motor housing 119, and batteries $300_2$, $300_4$ are positioned on opposed lateral sides of suction motor housing 119. It will be appreciated that many other configurations are possible, including a greater or fewer number of batteries 300 and/or battery recesses 312.

If part or all of first energy storage pack 300 is positioned radially outwardly of suction motor 118, then first energy storage pack 300 may surround part or all of suction motor 118. For example, as exemplified in FIGS. 36-37, first energy member 300 has an annular configuration that is sized to fit around suction motor housing 119. As exemplified in FIG. 37, annular first energy storage pack 300 may be removed (e.g., for charging, replacement, etc.) by removing rear housing lid 194. In alternative embodiments, annular first energy storage pack 300 may not be removable (i.e., it permanently surrounds suction motor housing 119).

Figure 37:
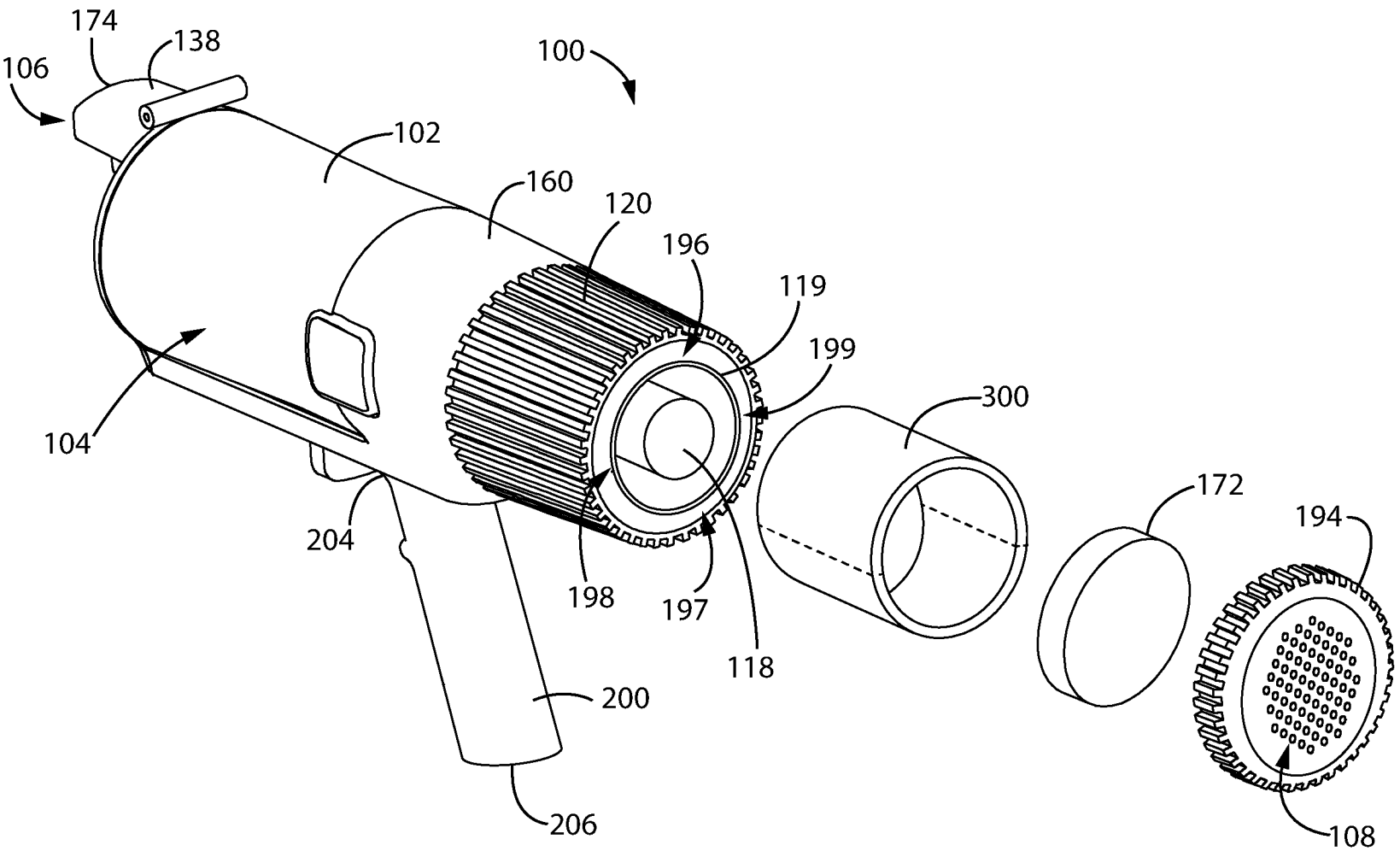
FIG. 37 is a partially exploded perspective view of the hand vacuum cleaner of FIG. 36.

Referring still to the illustrated embodiment of FIG. 37, suction motor housing 119 has an upper end 196, a lower end 197, a first lateral side 198 extending between upper and lower ends 196, 197, and a second lateral side 199 that is opposed to first lateral side 198 and that extends between upper and lower ends 196, 197. When positioned surrounding suction motor housing 119, annular first energy storage pack 300 is positioned radially outwardly of each of upper end 196, lower end 197, first lateral side 198 and second lateral side 199 of suction motor housing 119.

As indicated by the broken lines in FIG. 37, first energy storage pack 300 may alternatively be provided in a semi-annular configuration. When positioned surrounding suction motor housing 119, semi-annular first energy storage pack 300 is positioned radially outwardly of at least two of upper end 196, lower end 197, first lateral side 198 and second lateral side 199 of suction motor housing 119.

It will be appreciated that first energy storage pack 300 may be made of any number of segments which, collectively, are partially or fully annular. Accordingly, first energy storage pack 300 may be comprised of 2, 3, 4 or more arcuate sections. These arcuate sections may surround or partially surround suction motor 118 and they may be continuous (e.g., the two semi-circular arcuate portions of FIG. 37 that abut) or they may be angularly spaced apart around suction motor 118.

If a second energy storage pack is provided, as discussed subsequently, first energy storage pack 300 may be positioned directly or indirectly forward of second energy storage member 302 (see, e.g., FIGS. 20-27) and may be located partially or fully above or below thereof, directly or indirectly rearward of second energy storage member 302 (see, e.g., FIG. 20 if reference number 300 denotes the second energy storage member and reference number 302 denotes the first energy storage member) and may be located partially or fully above or below thereof, directly above second energy storage pack 302 (see, e.g., FIG. 2) or indirectly above second energy storage pack 302 (see, e.g., FIGS. 9, 10, 12, 18, 21 and 22) and may optionally be located partially or fully forward or rearward thereof. Alternatively, first energy storage pack 300 may be positioned directly or indirectly below second energy storage pack 302 (e.g., FIG. 2 if reference number 300 denotes the second energy storage member and reference number 302 denotes the first energy storage member) and may be located partially or fully forward or rearward thereof.

At least a portion of first energy storage pack 300 may overlie second energy storage pack 302 (see, e.g., FIGS. 2, 12, and 18). In some embodiments, at least 50% (e.g., 50%, 60%, 70%, 80%, 90% or more) of first energy storage pack 300 may overlie second energy storage pack 302. As an example, the illustrated embodiment of FIG. 12 shows about 75% of first energy storage pack 300 overlying second energy storage pack 302.

With respect to power supply 304, first energy storage pack 300 may be positioned directly or indirectly forward of power supply 304 (see, e.g., FIGS. 20-26) and may be located partially or fully above or below thereof, directly or indirectly rearward of power supply 304 (see, e.g., FIG. 8) and may be located partially or fully above or below thereof, directly or indirectly below power supply 304 (see, e.g., FIGS. 9-13, 18) or directly or indirectly above power supply 304 (see, e.g., FIGS. 2, 6-8, and 20-24).

At least a portion of first energy storage pack 300 may overlie power supply 304 (see, e.g., FIGS. 2, 6, and 7). For example, at least 50% (e.g., 50%, 60%, 70%, 80%, 90%, or more) of first energy storage pack 300 may overlie power supply 304. As an example, the illustrated embodiment of FIG. 7 shows about 100% of first energy storage pack 300 overlying power supply 304.

Figure 27:
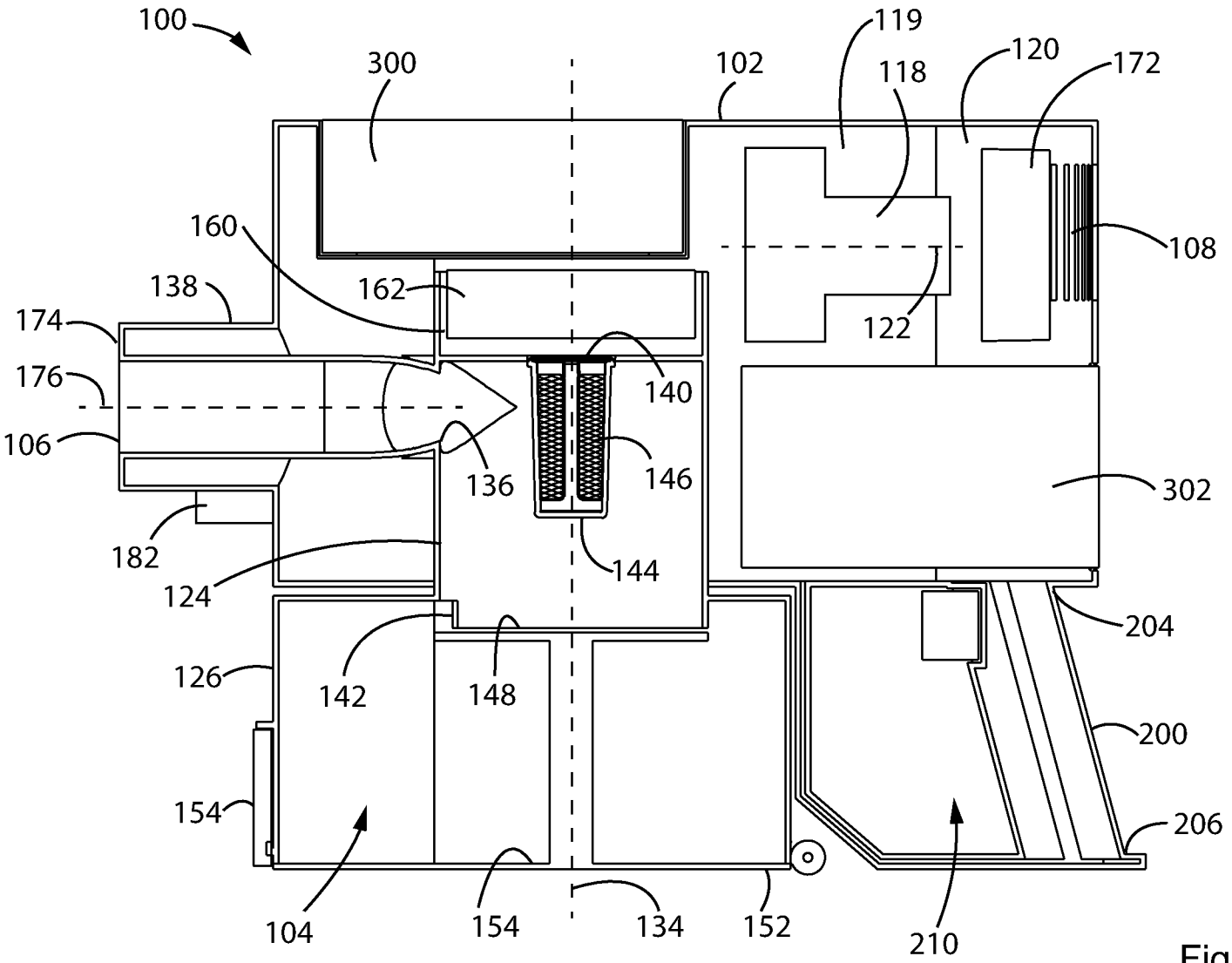

At least a portion of first energy storage pack 300 may overlie cyclone chamber 124 (see, e.g., FIG. 27). For example, at least 50% (e.g., 50%, 60%, 70%, 80%, 90%, or more) of first energy storage pack 300 may overlie cyclone chamber 124. As an example, the illustrated embodiment of FIG. 27 shows about 75% of first energy storage pack 300 overlying cyclone chamber 124.

At least a portion of first energy storage pack 300 may overlie air treatment assembly 104 (see, e.g., FIGS. 20-27).

For example, at least 50% (e.g., 50%, 60%, 70%, 80%, 90%, or more) of first energy storage pack 300 may overlie air treatment assembly 104. As an example, the illustrated embodiment of FIG. 20 shows about 100% of first energy storage pack 300 overlying air treatment assembly 104 (as noted above, air treatment assembly 104 includes dirt collection chamber 126).

Position of Second Energy Storage Pack 302

A hand vacuum cleaner using any aspect discussed herein may have one or more second energy storage packs 302 positioned at any location discussed herein. While the position of second energy storage pack 302 with respect to other components is discussed separately with respect to each other component, it will be appreciated that any embodiment of a hand vacuum cleaner may utilize the positioning of second energy storage pack 302 with respect to one or more of the other components discussed herein.

For example, second energy storage pack 302 may be positioned in body portion 120 (see, e.g., FIGS. 2 and 20-27), below pre-motor filter housing 160 (e.g., see FIG. 61) or second energy storage member 304 may be mounted to the lower surface of suction pre-motor filter housing 160 (see, e.g., FIG. 61).

As with first energy storage pack 300, second energy storage pack 302 may be removably mounted to the hand vacuum cleaner. Removing second energy storage pack 302 may facilitate replacement of an expired battery with a charged one. Alternately, second energy storage pack 302 may be permanently connected to the hand vacuum cleaner.

A second energy storage pack 302 may be positioned directly or indirectly forward of air treatment assembly 104 (e.g., FIG. 20 if reference number 300 denotes the second energy storage member and reference number 302 denotes the first energy storage member) and may be located partially or fully above or below thereof and, optionally directly or indirectly forward of cyclone chamber 124 (e.g., FIG. 20 if reference number 300 denotes the second energy storage member and reference number 302 denotes the first energy storage member) and may be located partially or fully above or below thereof.

A second energy storage pack 302 may be positioned in handle 200 (see, e.g., FIGS. 9, 10, 18, 42, 44, 49, 51, 52, 53, 55, 60 and 61). As exemplified in FIG. 18, handle 200 may have an energy storage member cavity 226 sized to receive removable a second energy storage pack 302. As indicated by the arrow, a second energy storage pack 302 is removable downwardly from energy storage member cavity 226.

Figure 43:
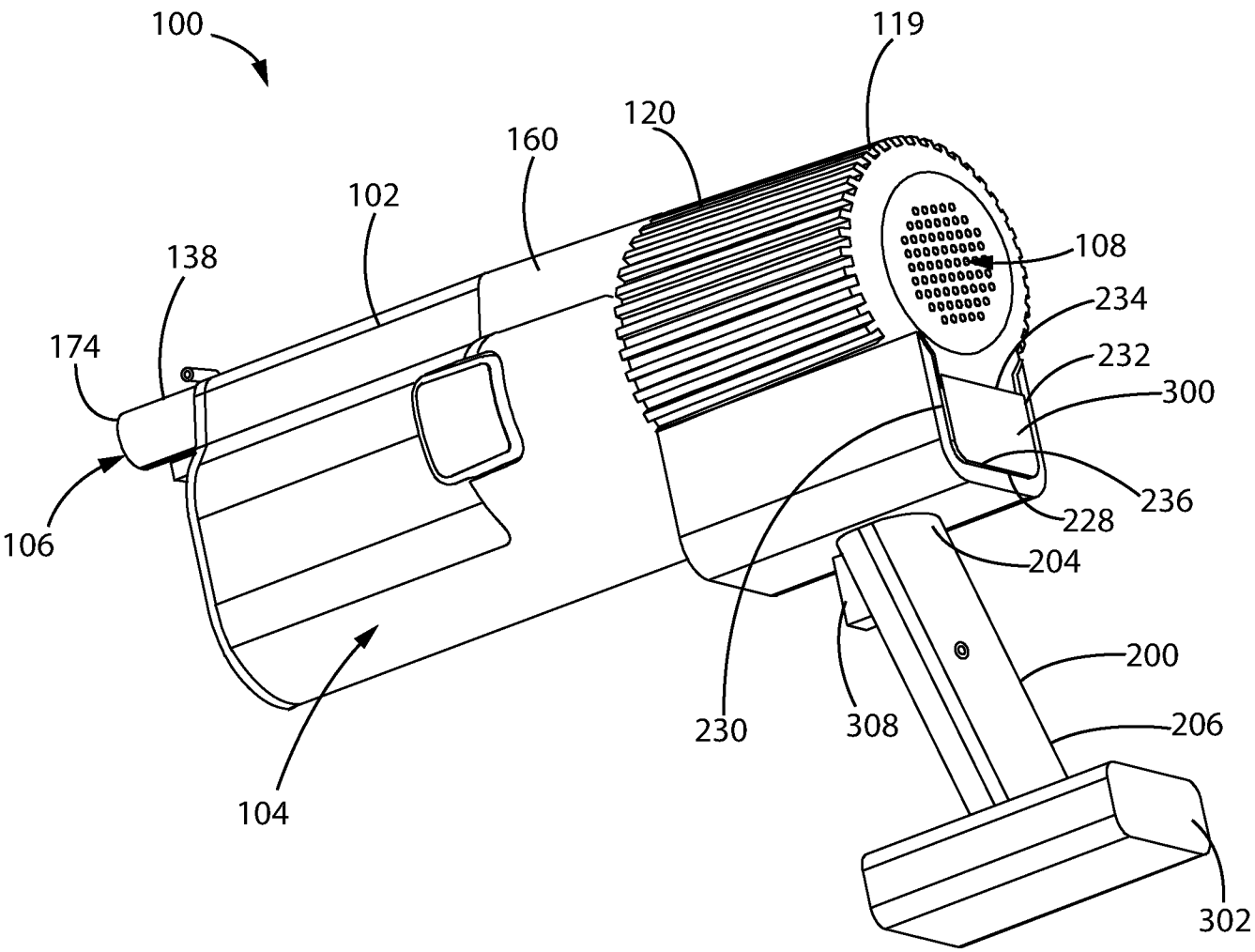
FIGS. 43-44 are side perspective views of other example hand vacuum cleaners with a recess provided at the upper end of the handle for removably receiving an energy storage member.

A second energy storage pack 302 may be positioned at lower handle end 206 (e.g., see FIGS. 12, 43 and 55). Second energy storage pack 302 may be mounted to lower handle end 206 in any suitable manner. As exemplified in FIG. 12, second energy storage pack 302 may be removably received within a recess 228 provided at the lower handle end 206. As indicated by the arrow, second energy storage pack 302 is removable rearwardly from recess 228.

Figure 29:
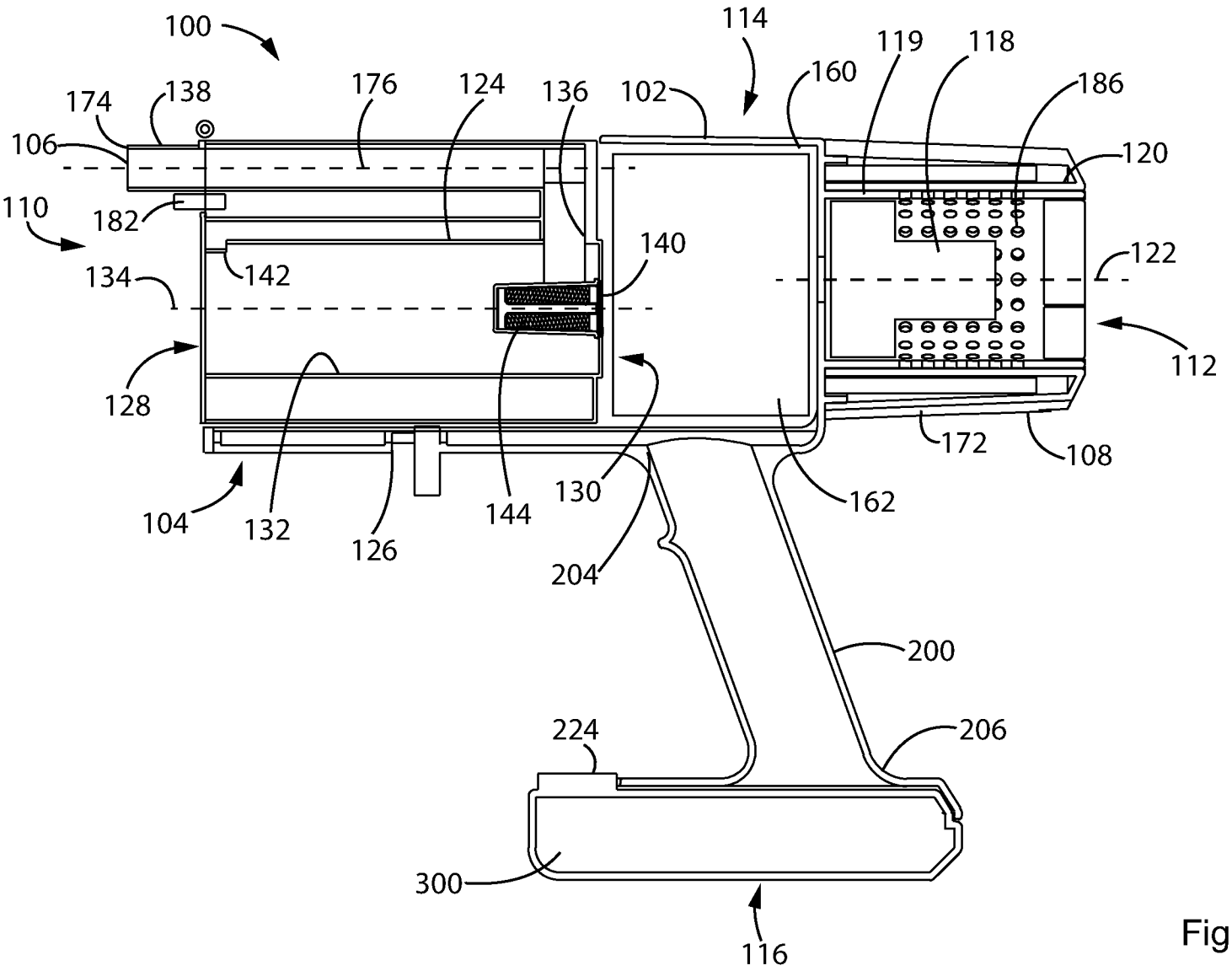
FIG. 29 is a cross-sectional view taken along line D-D of FIG. 28.

It will be appreciated that if first energy storage pack 300 is located elsewhere, then a second energy storage pack may be provided at the lower end of the handle as exemplified with first energy storage pack in FIG. 29.

If two second energy storage packs 302 are provided, they may be located adjacent each other. For example, as exemplified in FIG. 55, one second energy storage pack 302 is positioned at lower handle end 206 in bridge 208 and the other second energy storage pack 302 is positioned in handle 200. They may be positioned in different parts of the hand vacuum cleaner (e.g., see FIG. 20 wherein one second energy storage pack 302 is provided in handle 3200 and another is provided in main body 102). Alternately, two second energy storage packs 302 may be provided in the same part of the hand vacuum cleaner, e.g., both may be in main body 102.

As with first energy storage pack 300, a second energy storage pack 302 may be positioned above handle 200 (e.g., see FIGS. 2, 20-26, 40 and 46) or between upper handle end 204 and air treatment member (e.g., see FIG. 40) or between upper handle end 204 and suction motor housing 119 (e.g., see FIG. 46).

At least a portion of a second energy storage pack 302 may overlie upper handle end 204 (see, e.g., FIGS. 2 and 20-25). In some embodiments, at least 50% (e.g., 50%, 60%, 70%, 80%, 90%, or more) of a second energy storage pack 302 may overlie upper handle end 204. As an example, the illustrated embodiment of FIG. 20 shows 100% of a second energy storage pack 302 overlying upper handle end 204.

Figure 21:
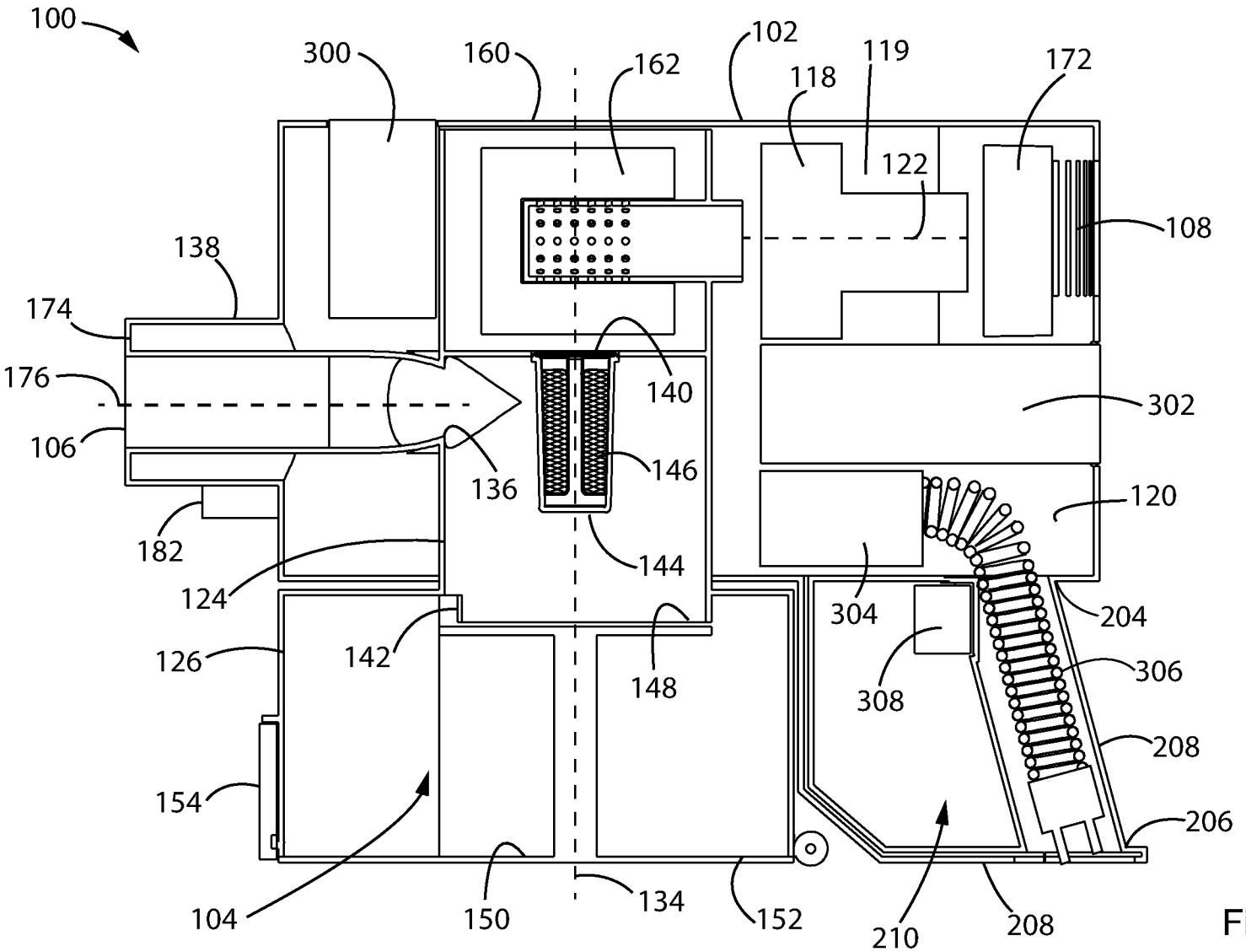
FIGS. 21-27 are cross-sectional views of other example hand vacuum cleaners with an energy storage member positioned forward of the suction motor.

Alternately, or in addition, at least a portion of a second energy storage pack 302 may overlie finger grip area 210 (see, e.g., FIGS. 2 and 21-26). In some embodiments, at least 50% (e.g., 50%, 60%, 70%, 80%, 90%, or more) of a second energy storage pack 302 may overlie finger grip area 210. As an example, the illustrated embodiment of FIG. 21 shows about 50% of a second energy storage pack 302 overlying finger grip area 210.

With respect to suction motor 118, a second energy storage pack 302 may be positioned directly or indirectly rearward of suction motor 118 (see, e.g., FIGS. 18 and 20) and may be located partially or fully above or below thereof, directly or indirectly forward of suction motor 118 (see, e.g., FIG. 26) and may be located partially or fully above or below thereof, directly or indirectly below suction motor 118 (see, e.g., FIGS. 2, 9, 10, 12, 18, 21, and 22) or directly or indirectly above suction motor 118 (see, e.g., FIGS. 23-25).

Figure 23:
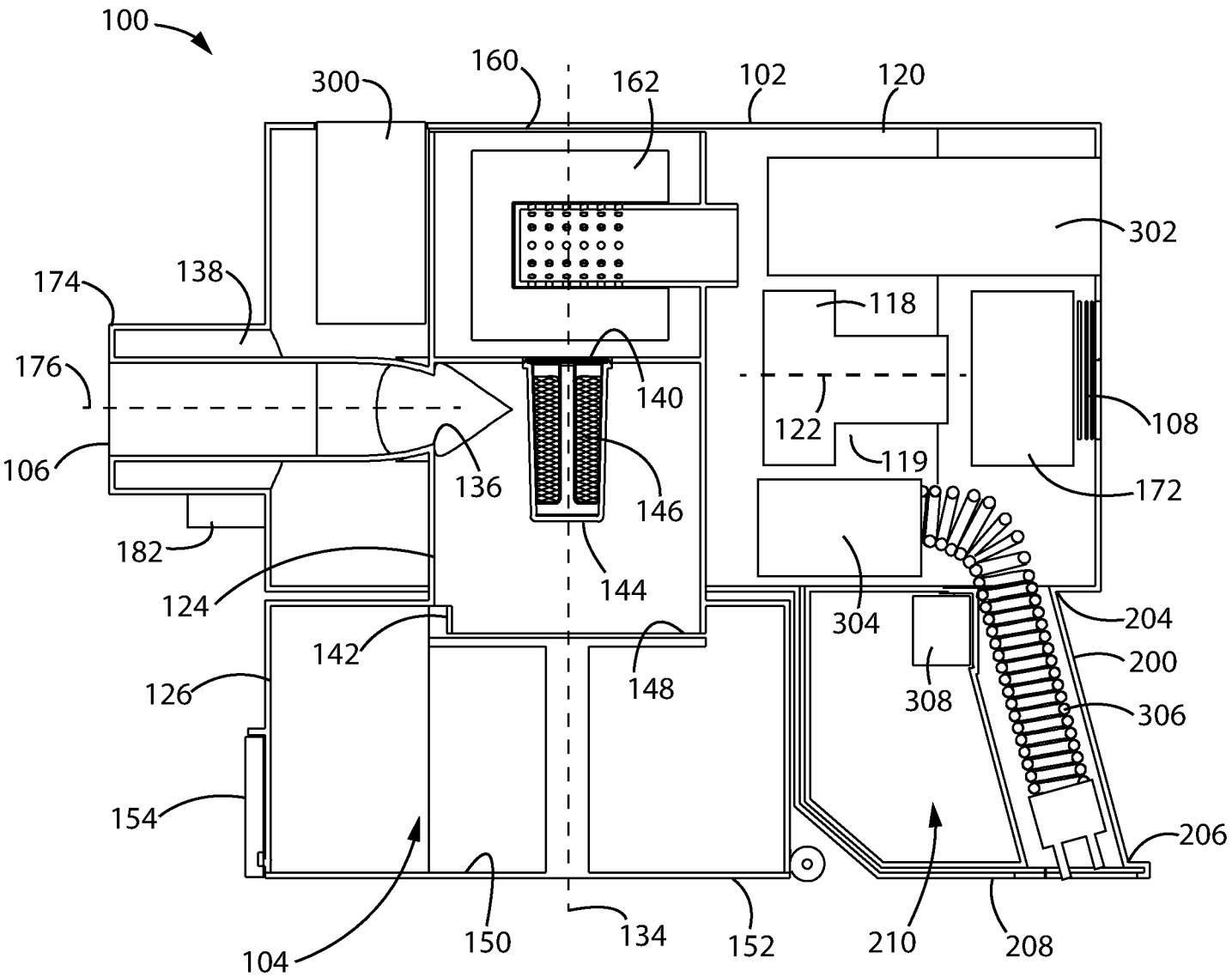
Figure 24:
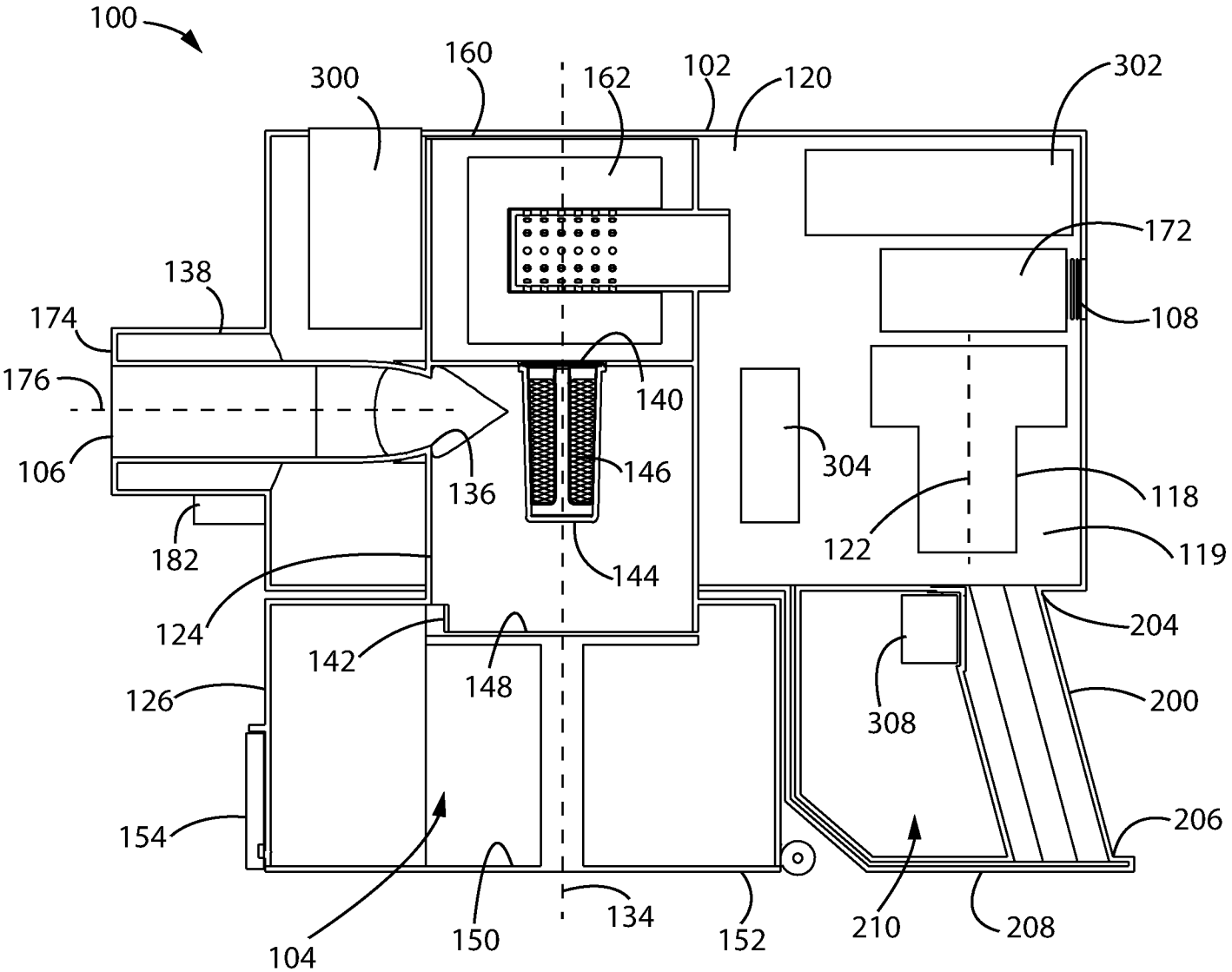
Figure 25:
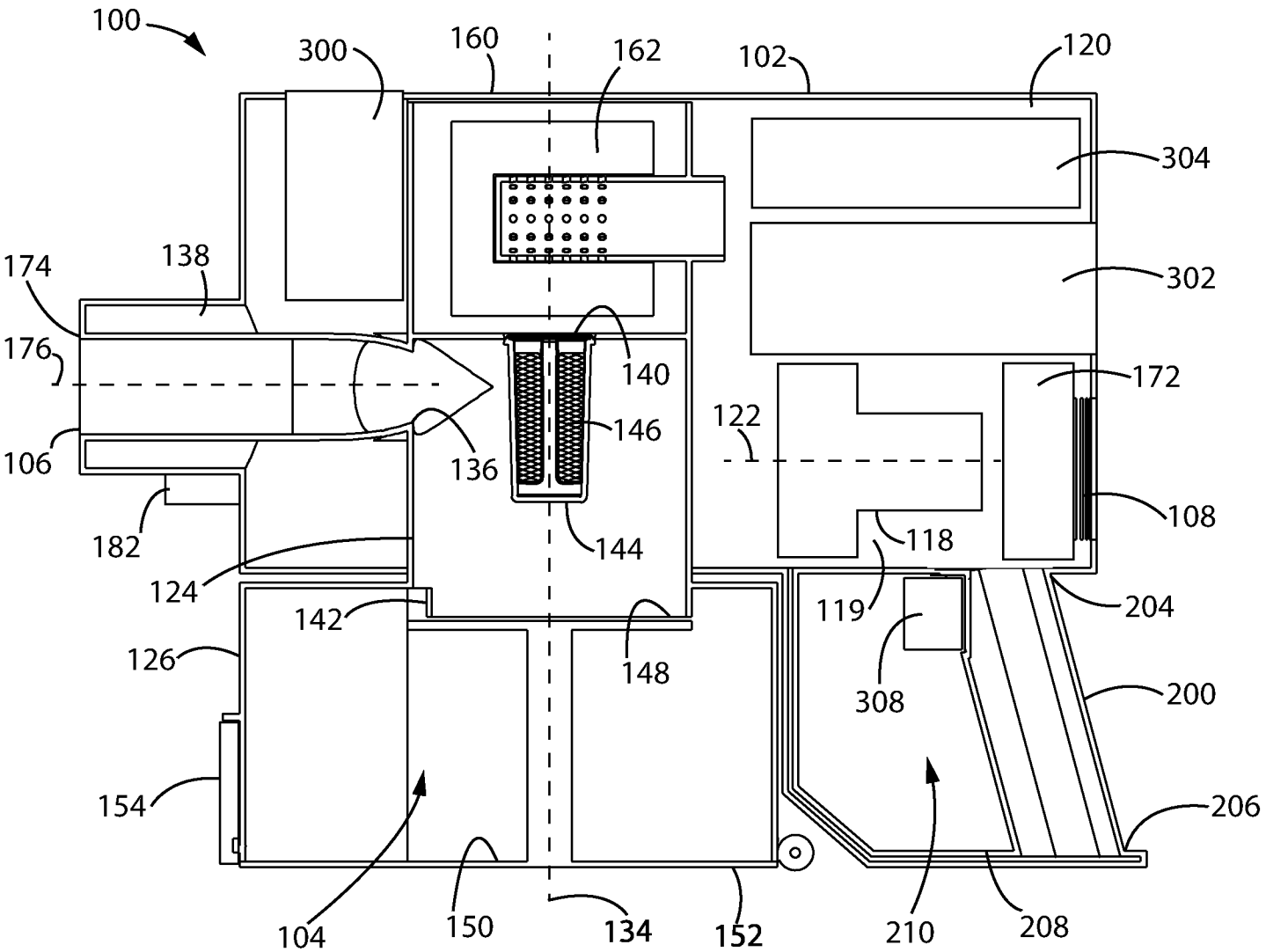

At least a portion of a second energy storage pack 302 may overlie suction motor 118 (see, e.g., FIGS. 23-25). In some embodiments, at least 50% (e.g., 50%, 60%, 70%, 80%, 90%, or more) of second energy storage pack 302 may overlie suction motor 118. As an example, the illustrated embodiment of FIG. 23 shows about 50% of second energy storage pack 302 overlying suction motor 118.

A second energy storage pack 302 may be positioned directly or indirectly rearward of first energy storage pack 300 (see, e.g., FIGS. 20-27) and may be located partially or fully above or below thereof, directly or indirectly forward of first energy storage pack 300 (e.g., FIG. 20 if reference number 300 denotes the second energy storage member and reference number 302 denotes the first energy storage member) and may be located partially or fully above or below thereof, directly or indirectly below first energy storage pack 300 (see, e.g., FIGS. 2, 9, 10, 12, 18, 21 and 22) or directly or indirectly above first energy storage pack 300 (e.g., FIG. 2 if reference number 300 denotes the second energy storage member and reference number 302 denotes the first energy storage member).

At least a portion of a second energy storage pack 302 may overlie first energy storage pack 300 (e.g., FIG. 12 if reference number 300 denotes the second energy storage member and reference number 302 denotes the first energy storage member). In some embodiments, at least 50% (e.g., 50%, 60%, 70%, 80%, 90%, or more) of second energy storage pack 302 may overlie first energy storage pack 300.

With respect to power supply 304, a second energy storage pack 302 may be positioned directly or indirectly rearward of power supply 304 (see, e.g., FIG. 24) and may be located partially or fully above or below thereof, directly or indirectly forward of power supply 304 (see, e.g., FIG. 26) and may be located partially or fully above or below thereof, directly or indirectly below power supply 304 (see, e.g., FIGS. 9, 10, 12, 18, 25 and 49) or directly or indirectly above power supply 304 (see, e.g., FIGS. 2, 20-24).

At least a portion of second energy storage pack 302 may overlie power supply 304 (see, e.g., FIGS. 2 and 20-23). In some embodiments, at least 50% (e.g., 50%, 60%, 70%, 80%, 90%, or more) of second energy storage pack 302 may overlie power supply 304. As an example, the illustrated embodiment of FIG. 21 shows 50% of second energy storage pack 302 overlying power supply 304.

First and Second Energy Storage Packs 300, 302 on Opposed Lateral Sides of Handle 200

A hand vacuum cleaner using any aspect discussed herein may have first and second energy storage members 300, 302 provided on opposed lateral sides of handle 200.

In the illustrated embodiment of FIGS. 45-46, pistol grip handle 200 has a front side 240 that receives the fingers of a user, a rear side 242 that receives the palm of a user, and first and second lateral sides 244, 246 which each extends between front side and rear sides 240, 242. First energy storage pack 300 is provided on first lateral side 244 of handle 200 and a second energy storage pack 302 is provided on second lateral side 246 of handle 200.

As exemplified in FIG. 46, first energy storage pack 300 and second energy member 302 are provided in a single removable battery pack 314. Pistol grip handle 200 is provided with a correspond battery pack recess 248 that can receive and mate with removable battery pack 314. Removable battery pack 314 is also shown connected to handle 200 in FIGS. 47 and 58. In alternative embodiments, first and second energy storage members 300, 302 may be distinct elements that are attached and detached from handle 206 independently.

Position of Power Supply 304

A hand vacuum cleaner using any aspect discussed herein may have a power supply 304 and, if so, power supply 304 may be positioned at any location discussed herein. While the position of power supply 304 with respect to other components is discussed separately with respect to each other component, it will be appreciated that any embodiment of a hand vacuum cleaner may utilize the positioning of power supply 304 with respect to one or more of the other components discussed herein.

For example, power supply 304 may be provided in body portion 120 (see, e.g., FIGS. 2, 11, and 20), and optionally below suction motor housing 119 (e.g., FIG. 61 if, instead of a second energy storage member, reference numeral 302 denotes a power supply).

With respect to handle 200, power supply 304 may be positioned directly or indirectly below handle 200 (e.g., FIG. 61 if, instead of a second energy storage member, reference numeral 302 denotes a power supply), directly or indirectly above handle 200 (e.g., see FIGS. 2, 6, 7, 9, 11, 12, 13, 18, 20, 21, and 22) or in handle 200 (e.g., if in FIG. 9 second energy storage pack 302 was instead a power supply). For example, power supply 304 may be positioned directly at upper handle end 204 (see, e.g., FIGS. 13 and 22).

Figure 22:
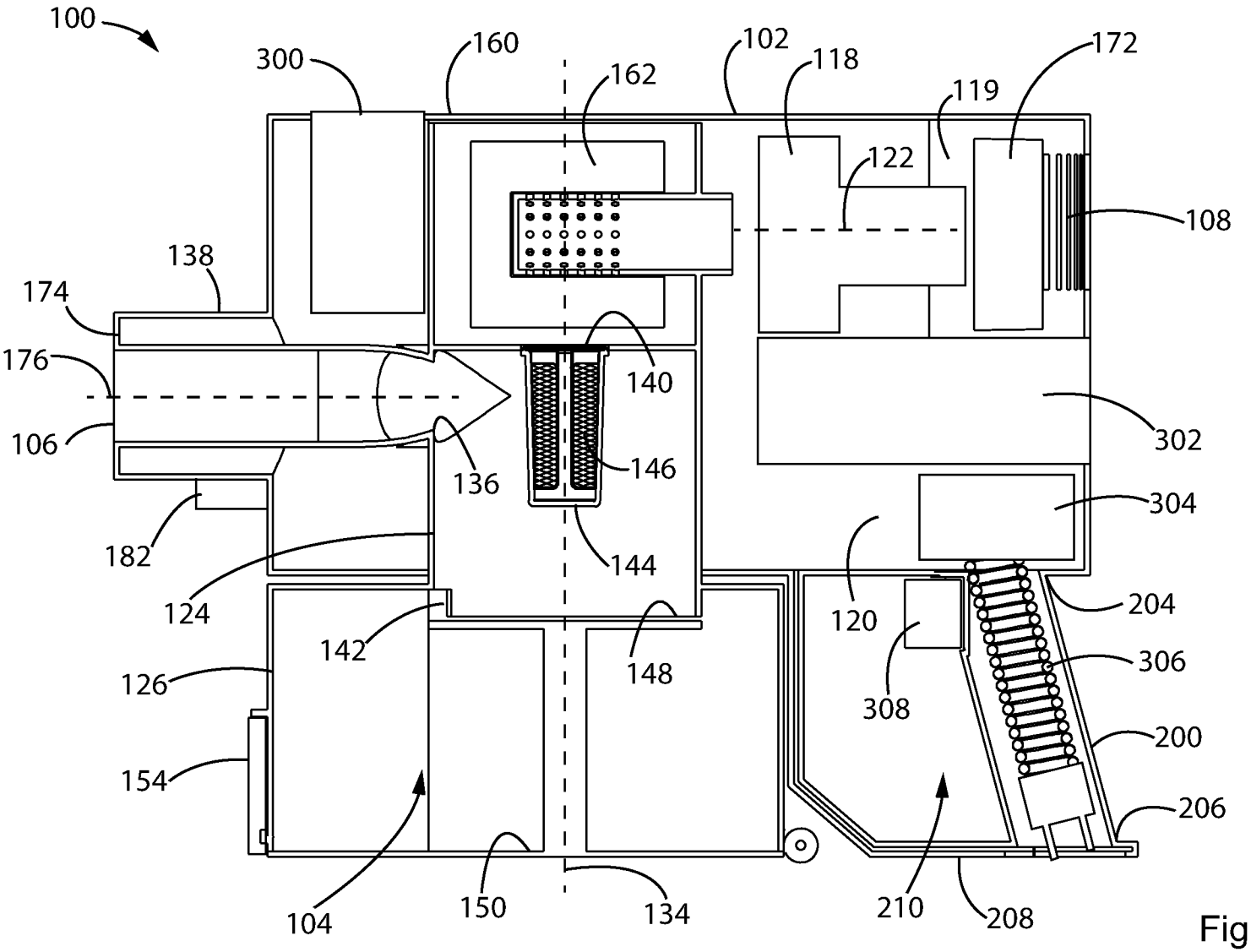

At least a portion of power supply 304 may directly or indirectly overlie upper handle end 204 (see, e.g., FIGS. 6, 7, and 9-13, and 22). For example, at least 50% (e.g., 50%, 60%, 70%, 80%, 90%, or more) of power supply 304 may overlie upper handle end 204. As an example, the illustrated embodiment of FIG. 12 shows about 50% of power supply 304 overlying upper handle end 204. As another example, the illustrated embodiment of FIG. 22 shows about 75% of power supply 304 overlying upper handle end 204.

Alternately, or in addition, at least a portion of power supply 304 may overlie finger grip area 210 (see, e.g., FIGS. 7, 9, 10, 11, 12, 18, 20, 21, 23, and 25). For example, at least 50% (e.g., 50%, 60%, 70%, 80%, 90%, or more) of power supply 304 may overlie finger grip area 210. As an example, the illustrated embodiment of FIG. 18 shows about 50% of power supply 304 overlying finger grip area 210. As another example, the illustrated embodiment of FIG. 21 shows about 75% of power supply 304 overlying finger grip area 210.

It will be appreciated that the power supply may be provided at the upper end of handle 200, regardless of the portion of the hand vacuum cleaner at which the upper end of handle 200 is located. For example, power supply 304 may be positioned between upper handle end 204 and air treatment member (e.g., FIG. 40, if instead of a second energy storage member, reference numeral 302 denotes a power supply).

With respect to first energy storage pack 300, power supply 304 may be positioned directly or indirectly forward of first energy storage pack 300 (see, e.g., FIG. 8) and may be located partially or fully above or below thereof, directly or indirectly rearward of first energy storage pack 300 (see, e.g., FIGS. 20-26) and may be located partially or fully above or below thereof, directly or indirectly below first energy storage pack 300 (see, e.g., FIGS. 2, 6, 7, 20, and 21) or directly or indirectly above first energy storage pack 300 (see, e.g., FIGS. 9-13, 18, and 49).

At least a portion of power supply 304 may overlie first energy storage pack 300 (see, e.g., FIGS. 9-13 and 49). In some embodiments, at least 50% (e.g., 50%, 60%, 70%, 80%, 90%, or more) of power supply may overlie first energy storage pack 300. As an example, the illustrated embodiment of FIG. 12 shows 100% of power supply 304 overlying first energy storage pack 300.

With respect to second energy storage pack 302, power supply 304 may be positioned directly or indirectly forward of second energy storage pack 302 (see, e.g., FIG. 24) and may be located partially or fully above or below thereof, directly or indirectly rearward of second energy storage pack 302 (see, e.g., FIG. 26) and may be located partially or fully above or below thereof, directly or indirectly below second energy storage pack 302 (see, e.g., FIGS. 2 and 20-23) or directly or indirectly above second energy storage pack 302 (see, e.g., FIGS. 12 and 18).

At least a portion of power supply 304 may overlie second energy storage pack 302 (see, e.g., FIGS. 12 and 18). In some embodiments, at least 50% (e.g., 50%, 60%, 70%, 80%, 90%, or more) of power supply 304 may overlie second energy storage pack 302. As an example, the illustrated embodiment of FIG. 12 shows about 50% of power supply 304 overlying second energy storage pack 302.

With respect to suction motor 118, power supply 304 may be positioned directly or indirectly forward of suction motor 118 (see, e.g., FIGS. 8 and 24) and may be located partially or fully above or below thereof, directly or indirectly rearward of suction motor 118 (see, e.g., FIGS. 2 and 6) and may be located partially or fully above or below thereof, directly or indirectly below suction motor 118 (see, e.g., FIGS. 2, 12, 21 and 49) or directly or indirectly above suction motor 118 (see, e.g., FIGS. 7, 9-11 and 25).

Figure 9:
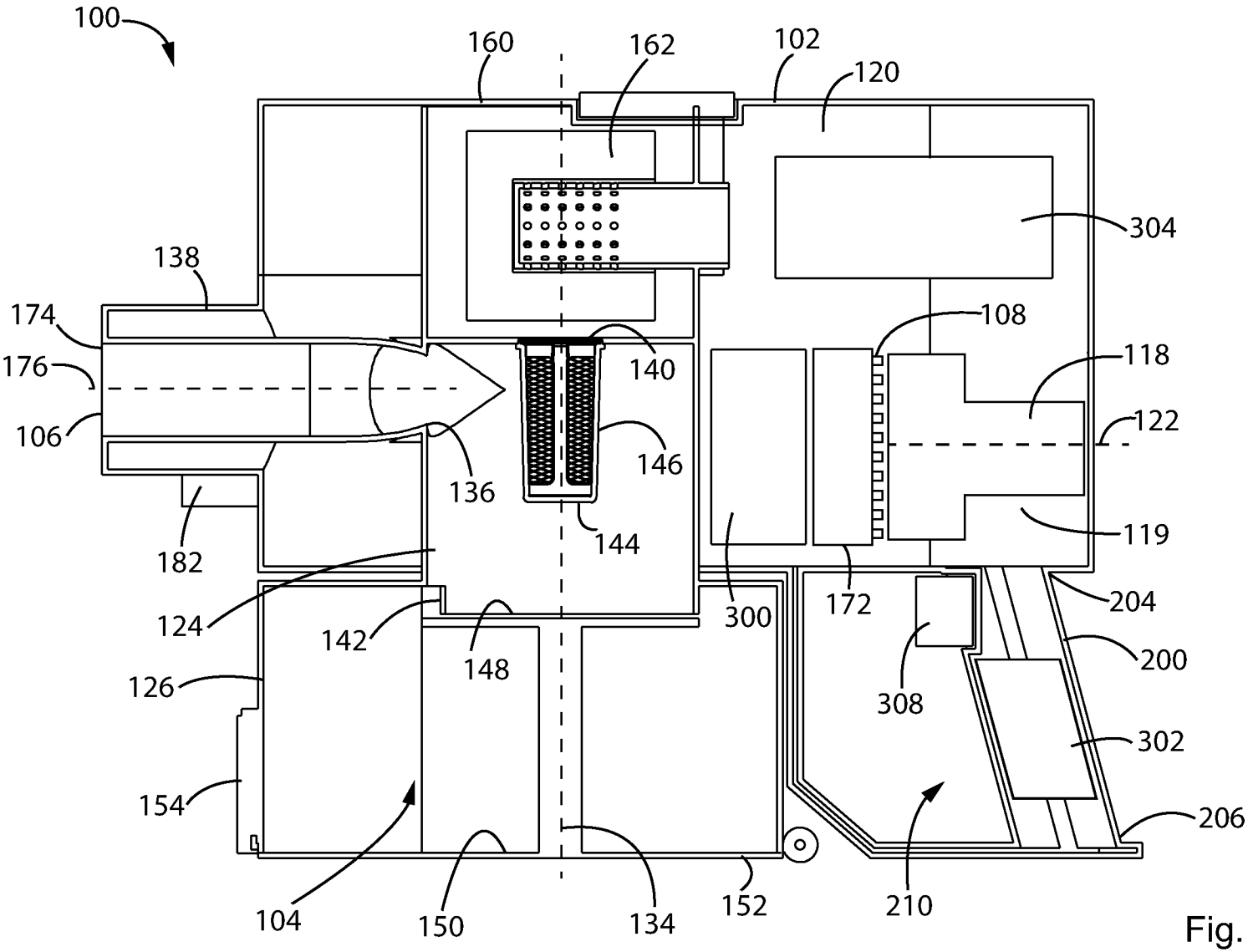

At least a portion of power supply 304 may overlie suction motor 118 (see, e.g., FIGS. 7, 9-11 and 25). In some embodiments, at least 50% (e.g., 50%, 60%, 70%, 80%, 90%, or more) of power supply 304 may overlie suction motor 118. As an example, the illustrated embodiment of FIG. 7 shows about 75% of power supply 304 overlying suction motor 118. As another example, the illustrated embodiment of FIG. 9 shows about 50% of power supply 304 overlying suction motor 118.

With respect to post-motor filter 172, power supply 304 may be positioned directly or indirectly forward of post-motor filter 172 (see, e.g., FIGS. 8 and 24) and may be located partially or fully above or below thereof, directly or indirectly rearward of post-motor filter 172 (see, e.g., FIG. 6) and may be located partially or fully above or below thereof, directly or indirectly below post-motor filter 172 (see, e.g., FIGS. 2, 12, 13, 18, 20-24 and 49) or directly or indirectly above post-motor filter 172 (see, e.g., FIGS. 2, 12, 13, 18, 20-24 and 49).

Figure 26:
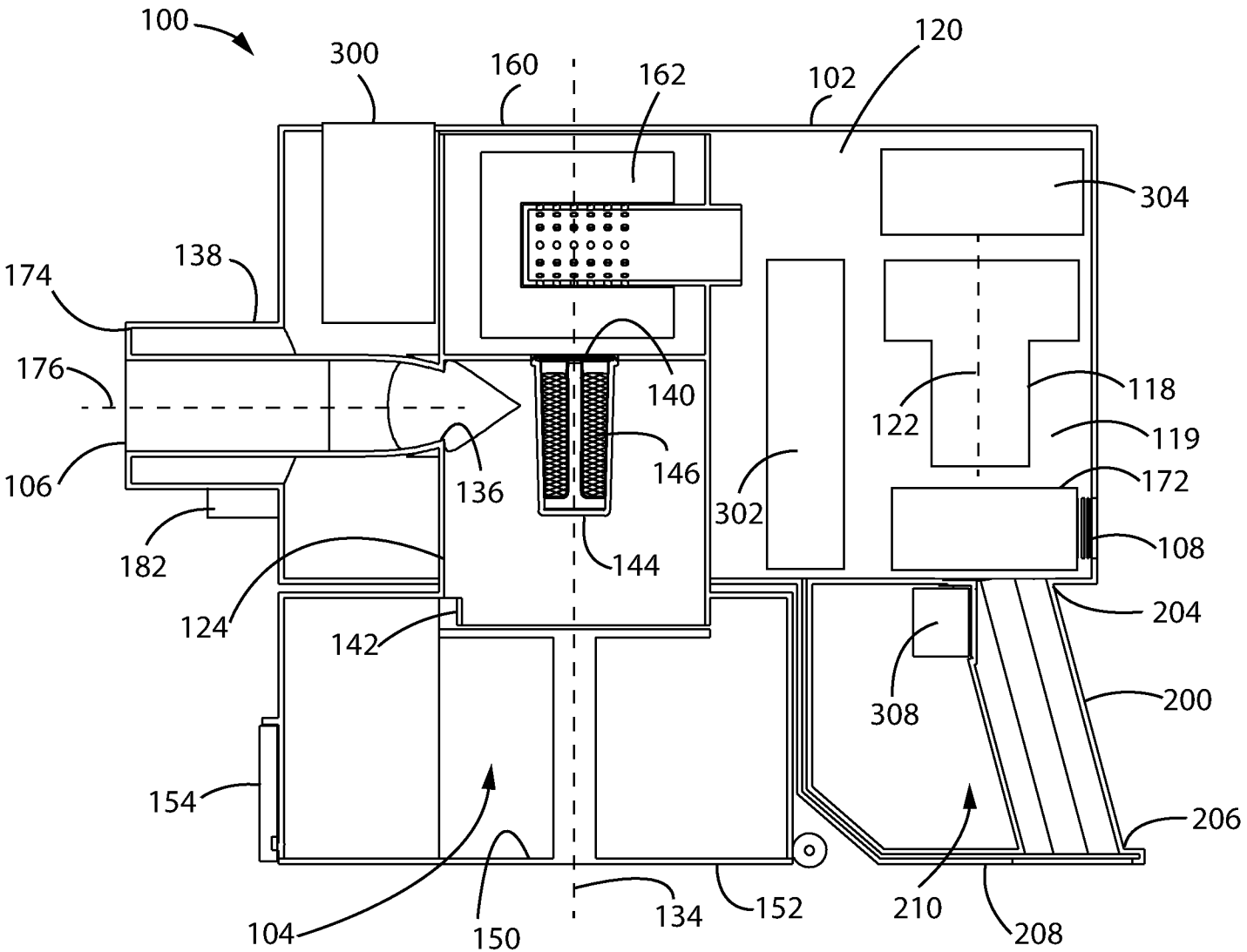

At least a portion of power supply 304 may overlie post-motor filter (see, e.g., FIGS. 7, 9-11, 25 and 26). In some embodiments, at least 50% (e.g., 50%, 60%, 70%, 80%, 90%, or more) of power supply 304 may overlie suction motor 118. As an example, the illustrated embodiment of FIG. 10 shows about 75% of power supply 304 overlying post-motor filter 172. As another example, the illustrated embodiment of FIG. 26 shows 100% of power supply 304 overlying post-motor filter 172.

Position of Suction Motor 118

A hand vacuum cleaner using any aspect discussed herein may have a suction motor 118 positioned at any location discussed herein. While the position of suction motor 118 with respect to other components is discussed separately with respect to each other component, it will be appreciated that any embodiment of a hand vacuum cleaner may utilize the positioning of suction motor 118 with respect to one or more of the other components discussed herein.

With respect to handle 200, suction motor 118 may be positioned above handle 200 (e.g., see FIGS. 2, 18, 22, 25, 34, and 36). For example, at least a portion of suction motor 118 may overlie upper handle end 204 (see, e.g., FIGS. 7-10, 24, 25 and 52) and at least 50% (e.g., 50%, 60%, 70%, 80%, 90%, or more) of suction motor 118 may overlie upper handle end 204. As an example, the illustrated embodiment of FIGS. 9 and 24 show about 75% of suction motor 118 overlying upper handle end 204.

Alternately or in addition, at least a portion of suction motor 118 may overlie finger grip area 210 (see, e.g., FIGS. 2, 6-14, 18 and 20-27). For example, at least 50% (e.g., 50%, 60%, 70%, 80%, 90%, or more) of suction motor 118 may overlie finger grip area 210. As an example, the illustrated embodiment of FIG. 6 shows about 50% of suction motor 118 overlying finger grip area 210 and FIG. 25 shows about 75% of suction motor 118 overlying finger grip area 210.

Figure 56:
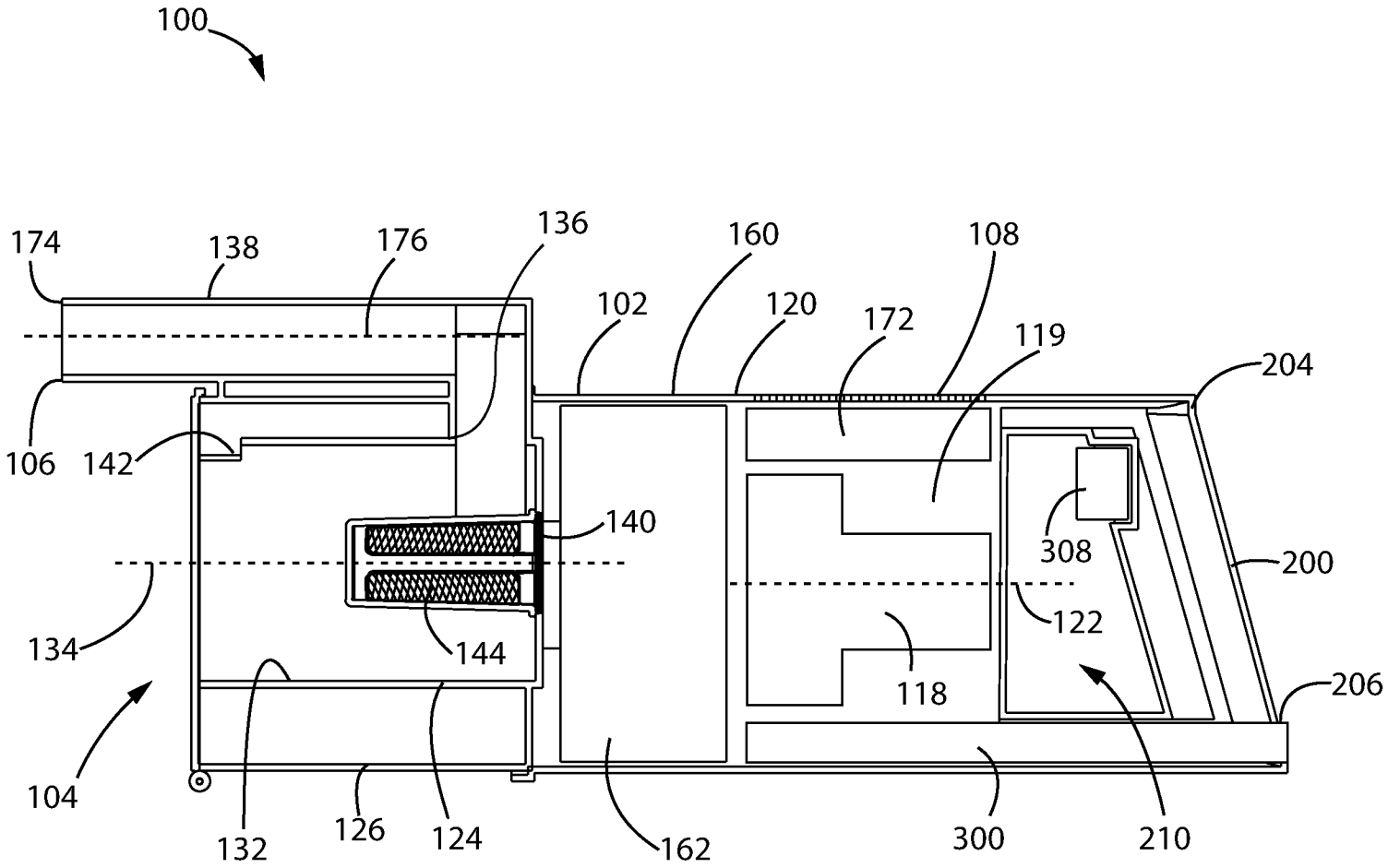
FIGS. 56-57 are cross-sectional views of other example hand vacuum cleaners with the handle mounted at the rear end of the suction motor housing.
Figure 57:
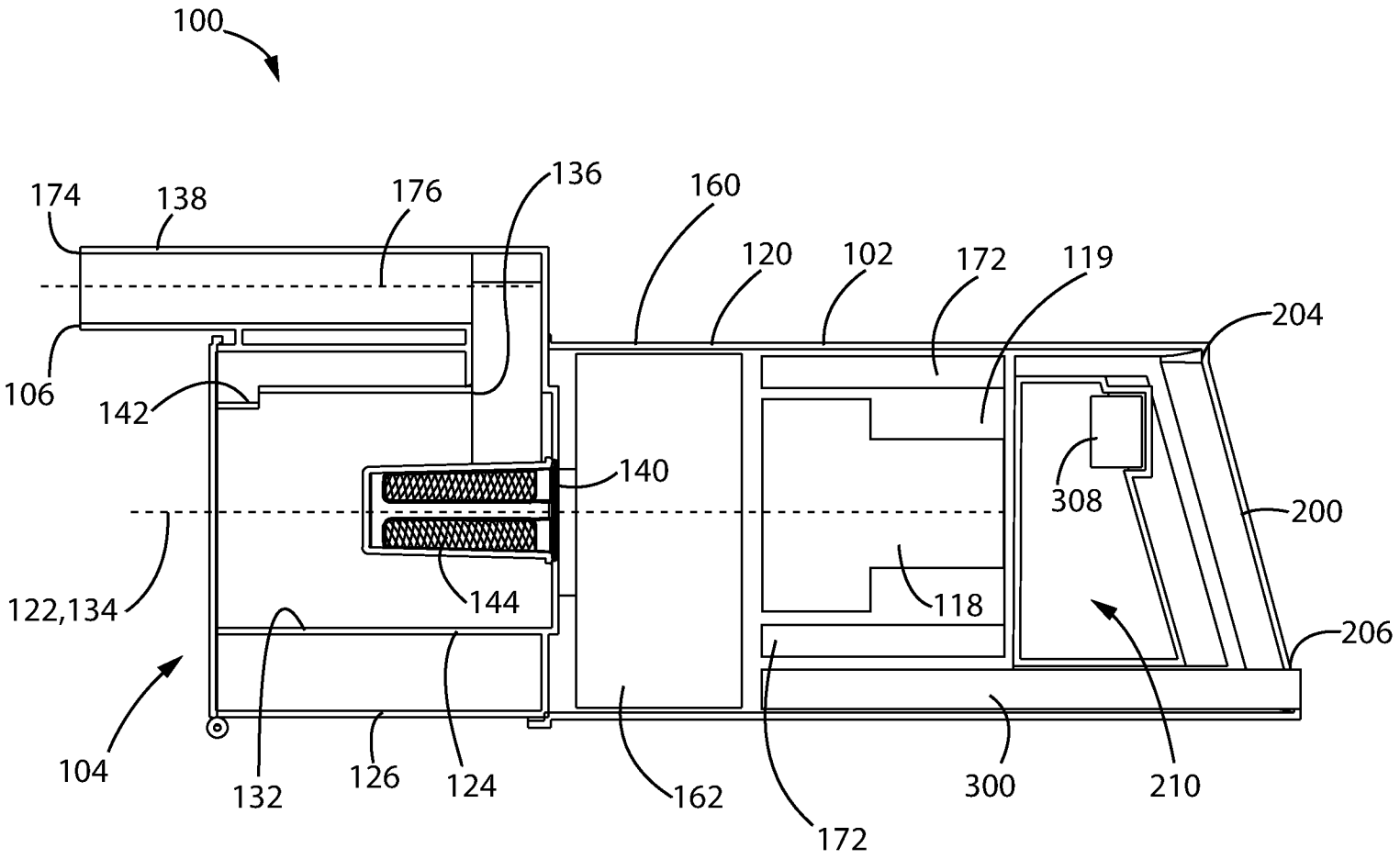

In some embodiments, suction motor 118 may be positioned forward of handle 200 (e.g., see FIGS. 55-57) and optionally forward of an enclosed finger grip area 210 (e.g., see FIGS. 55-57).

In some embodiments, suction motor 118 may be positioned below handle 200 (e.g., see FIGS. 61, 63, and 64) and optionally positioned below an enclosed finger grip area 210 (e.g., see FIG. 63). Suction motor 118 is not visible in FIGS. 61, 63 and 64; however, it is housed within suction motor housing 119.

With respect to first energy storage pack 300, suction motor 118 may be positioned directly or indirectly forward of first energy storage pack 300 (see, e.g., FIGS. 2, 6, 11, 13 and 14) and may be located partially or fully above or below thereof, directly or indirectly rearward of first energy storage pack 300 (see, e.g., FIGS. 9 and 10) and may be located partially or fully above or below thereof, directly or indirectly below first energy storage pack 300 (see, e.g., FIGS. 7 and 8) or directly or indirectly above first energy storage pack 300 (see, e.g., FIGS. 12 and 18).

At least a portion of suction motor 118 may overlie first energy storage pack 300 (see, e.g., FIGS. 12 and 18). For example, at least 50% (e.g., 50%, 60%, 70%, 80%, 90%, or more) of suction motor 118 may overlie first energy storage pack 300. As an example, the illustrated embodiments of FIGS. 12 and 18 show about 75% of suction motor 118 overlying first energy storage pack 300.

In some embodiments, suction motor 118 may be partially or fully surrounded by first energy storage pack 300 (e.g., see FIGS. 37, 55 and 60). In the illustrated embodiments of FIGS. 37, 55 and 60, suction motor 118 is surrounded by first energy member 300 that has an annular configuration (e.g., ring-shaped). First energy storage pack 300 may be arcuate in shape so as to extend around, e.g., at least 50% (e.g., 50%, 60%, 70%, 80%, 90%, or more) of suction motor 118.

With respect to second energy storage pack 302, suction motor 118 may be positioned directly or indirectly forward of second energy storage pack 302 (see, e.g., FIG. 20) and may be located partially or fully above or below thereof, directly or indirectly rearward of second energy storage pack 302 (see, e.g., FIG. 26) and may be located partially or fully above or below thereof, directly or indirectly below second energy storage pack 302 (see, e.g., FIGS. 23, 24, and 25) or directly or indirectly above second energy storage pack 302 (see, e.g., FIGS. 2, 9, 10, 12, 18, 21, and 22).

At least a portion of suction motor 118 may overlie second energy storage pack 302 (see, e.g., FIGS. 2, 9, 10, 12, 21 and 22). For example, at least 50% (e.g., 50%, 60%, 70%, 80%, 90%, or more) of suction motor 118 may overlie second energy storage pack 302. As an example, the illustrated embodiment of FIG. 2 shows 100% of suction motor 118 overlying second energy storage pack 302 and FIG. 9 shows about 50% of suction motor 118 overlying second energy storage pack 302.

With respect to pre-motor filter housing 160, suction motor 118 may be positioned directly or indirectly forward of pre-motor filter housing 160 and may be located partially or fully above or below thereof, directly or indirectly rearward of pre-motor filter housing 160 (see, e.g., FIGS. 2, 25, 29, 33 and 34) and may be located partially or fully above or below thereof, directly or indirectly below pre-motor filter housing 160 (see, e.g., FIG. 52) or directly or indirectly above pre-motor filter housing 160 (see, e.g., FIGS. 51 and 53).

Figure 51:
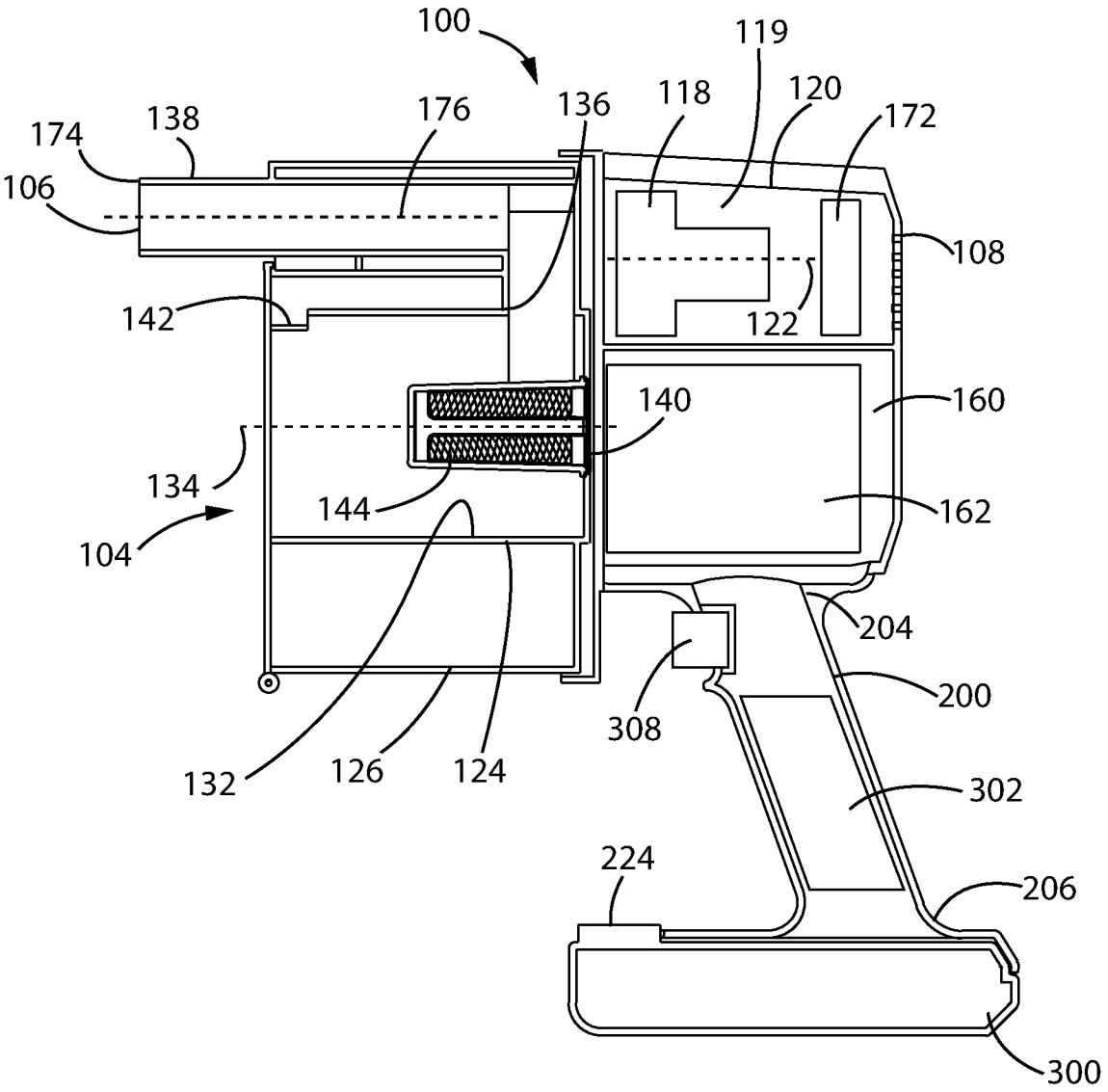
FIG. 51 is a cross-sectional view taken along line G-G of FIG. 50.
Figure 53:
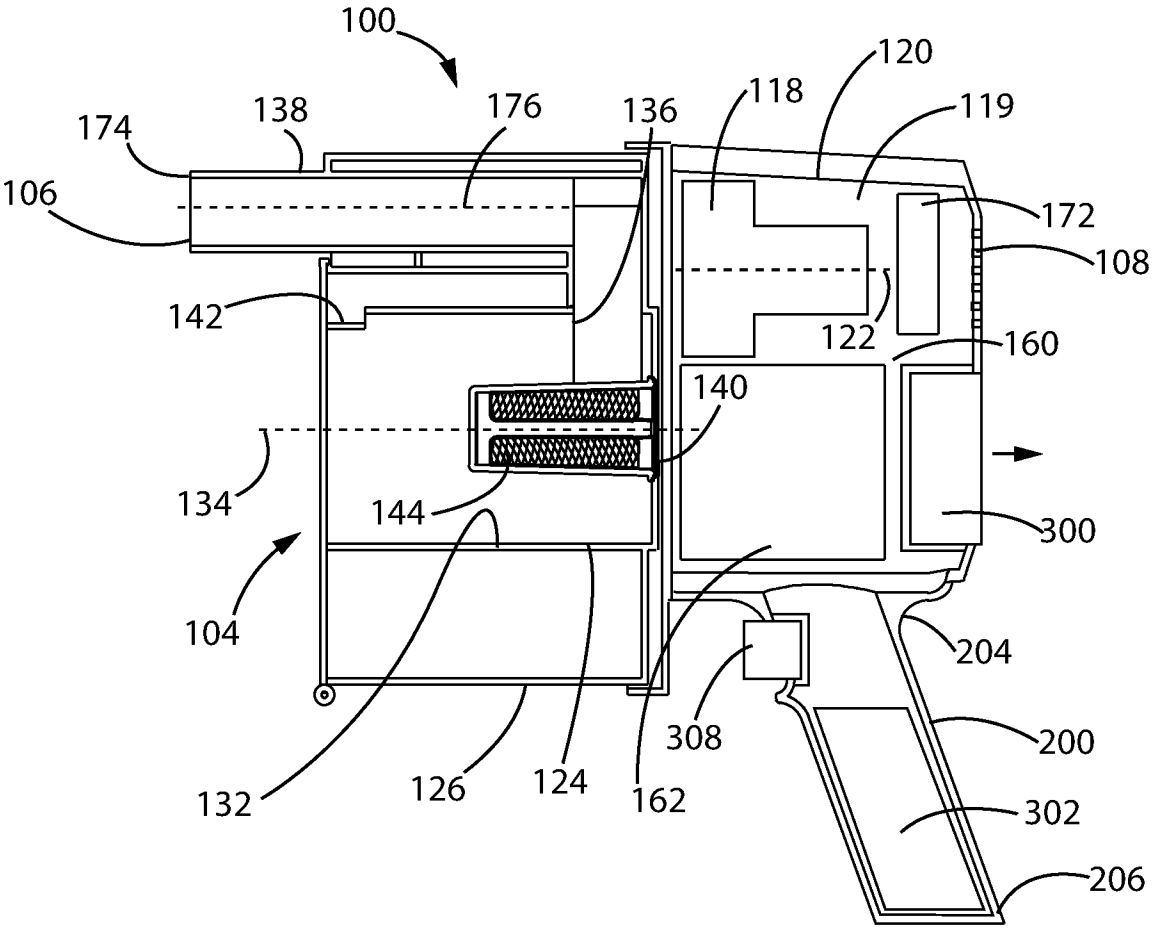
FIG. 53 is a cross-sectional view of an example hand vacuum cleaner with an energy storage member positioned in the handle.

At least a portion of suction motor 118 may overlie pre-motor filter housing 160 (see, e.g., FIGS. 51 and 53). For example, at least 50% (e.g., 50%, 60%, 70%, 80%, 90%, or more) of suction motor 118 may overlie pre-motor filter housing 160. As an example, the illustrated embodiment of FIG. 51 shows 100% of suction motor 118 overlying pre-motor filter housing 160.

With respect to power supply 304, suction motor 118 may be positioned directly or indirectly forward of power supply 304 (see, e.g., FIGS. 2 and 6) and may be located partially or fully above or below thereof, directly or indirectly rearward of power supply 304 (see, e.g., FIGS. 8 and 24) and may be located partially or fully above or below thereof, directly or indirectly below power supply 304 (see, e.g., FIGS. 7, 9-11 and 25) or directly or indirectly above power supply 304 (see, e.g., FIGS. 2, 12, 21 and 49).

Figure 49:
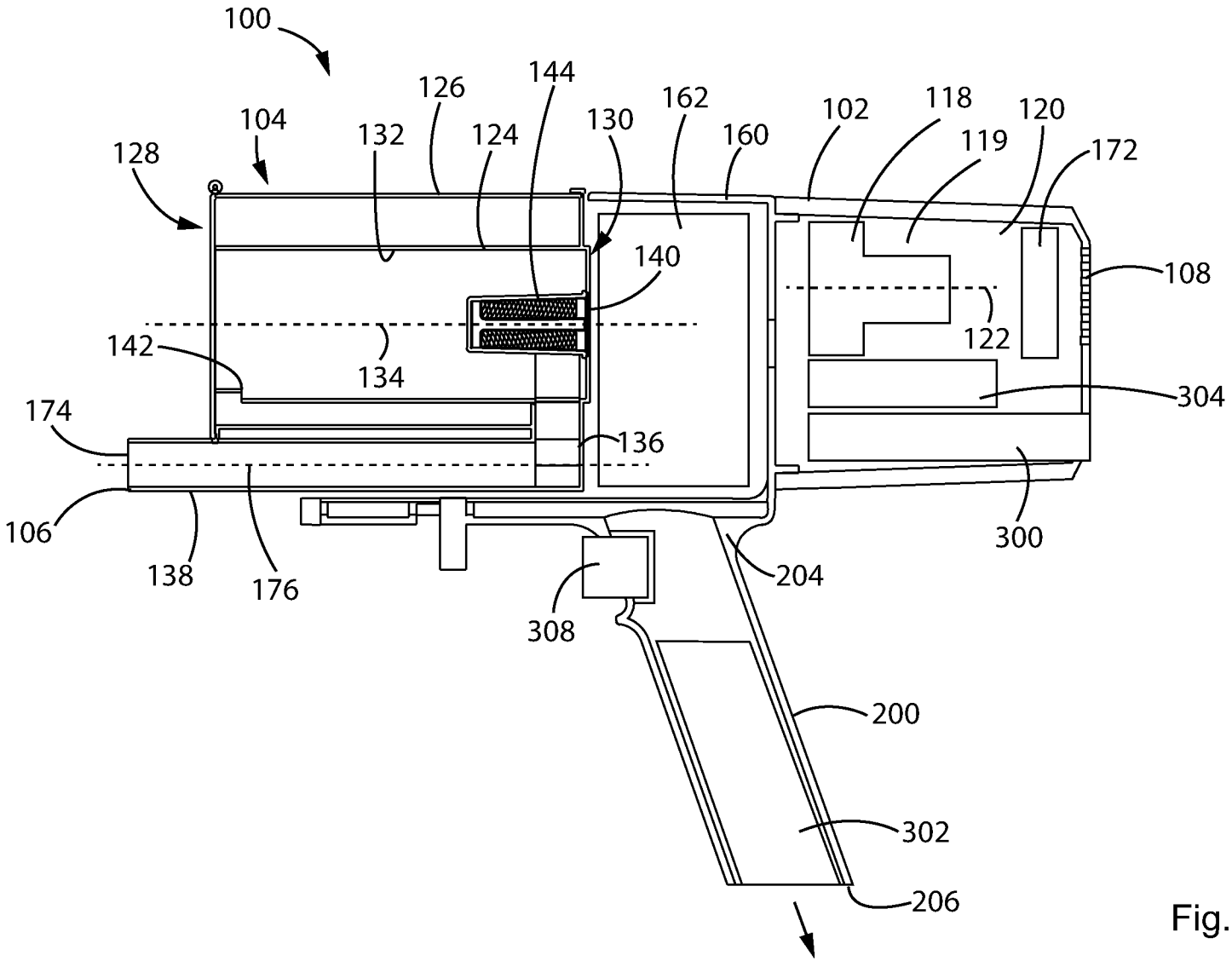
FIG. 49 is a cross-sectional view taken along line F-F of FIG. 48.
Figure 50:
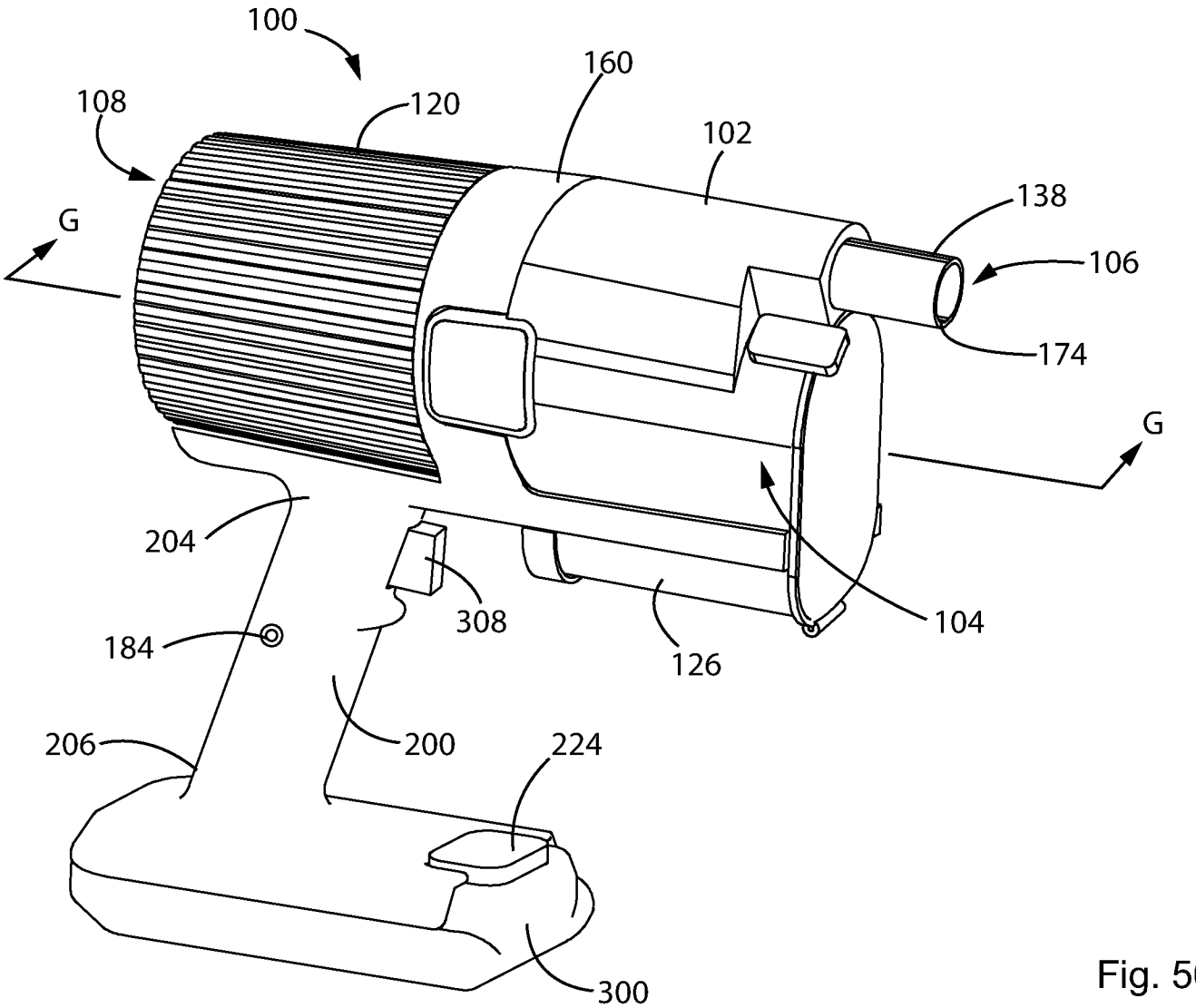
FIG. 50 is a side perspective view of another example hand vacuum cleaner with a pistol grip handle mounted to the pre-motor filter housing, the suction motor above the pre-motor filter and with an energy storage member positioned at the lower end of the handle.

At least a portion of suction motor 118 may overlie power supply 304 (see, e.g., FIGS. 12, 21 and 49). For example, at least 50% (e.g., 50%, 60%, 70%, 80%, 90%, or more) of suction motor 118 may overlie power supply 304. As an example, the illustrated embodiments of FIG. 12 and show about 75% of suction motor 118 overlying first energy storage pack 300.

With respect to post-motor filter 172, suction motor 118 may be positioned directly or indirectly forward of post-motor filter 172 (see, e.g., FIGS. 2, 6, 11, 18, 20, 36, and 42) and may be located partially or fully above or below thereof, directly or indirectly rearward of post-motor filter 172 (see, e.g., FIGS. 8 and 9) and may be located partially or fully above or below thereof, directly or indirectly below post-motor filter 172 (see, e.g., FIGS. 10, 24, 56, and 57) or directly or indirectly above post-motor filter 172 (see, e.g., FIGS. 26 and 57).

As exemplified, an optional perforated motor collar 186 may be positioned around suction motor 118 to permit the air flow to travel in a radially outward direction from suction motor 118 toward annular post-motor filter 172 (which provides clean air outlet 108).

Position of Post-Motor Filter 172

A hand vacuum cleaner using any aspect discussed herein may have one or more post-motor filters 172 and, if so, the one or more post-motor filters 172 may be positioned at any location discussed herein. While the position of the one or more post-motor filters 172 with respect to other components is discussed separately with respect to each other component, it will be appreciated that any embodiment of a hand vacuum cleaner may utilize the positioning of the one or more post-motor filters 172 with respect to one or more of the other components discussed herein.

With respect to suction motor 118, post-motor filter 172 may be positioned directly or indirectly forward of suction motor 118 (see, e.g., FIGS. 8 and 9) and may be located partially or fully above or below thereof, directly or indirectly rearward of suction motor 118 (see, e.g., FIGS. 2, 6, 11, 18, 20, 36, and 42) and may be located partially or fully above or below thereof, directly or indirectly below suction motor 118 (see, e.g., FIGS. 10, 26, 56 and 57) or directly or indirectly above suction motor 118 (see, e.g., FIGS. 24 and 57).

If two pre-motor filters 172 are provided, then each may be in the same location or optionally each may be at any location discussed previously. For example, as exemplified in FIG. 57, two post-motor filters 172 are provided wherein one post-motor filter 172 is positioned above suction motor 118 and the other post-motor filter 172 is positioned below suction motor 118.

Figure 34:
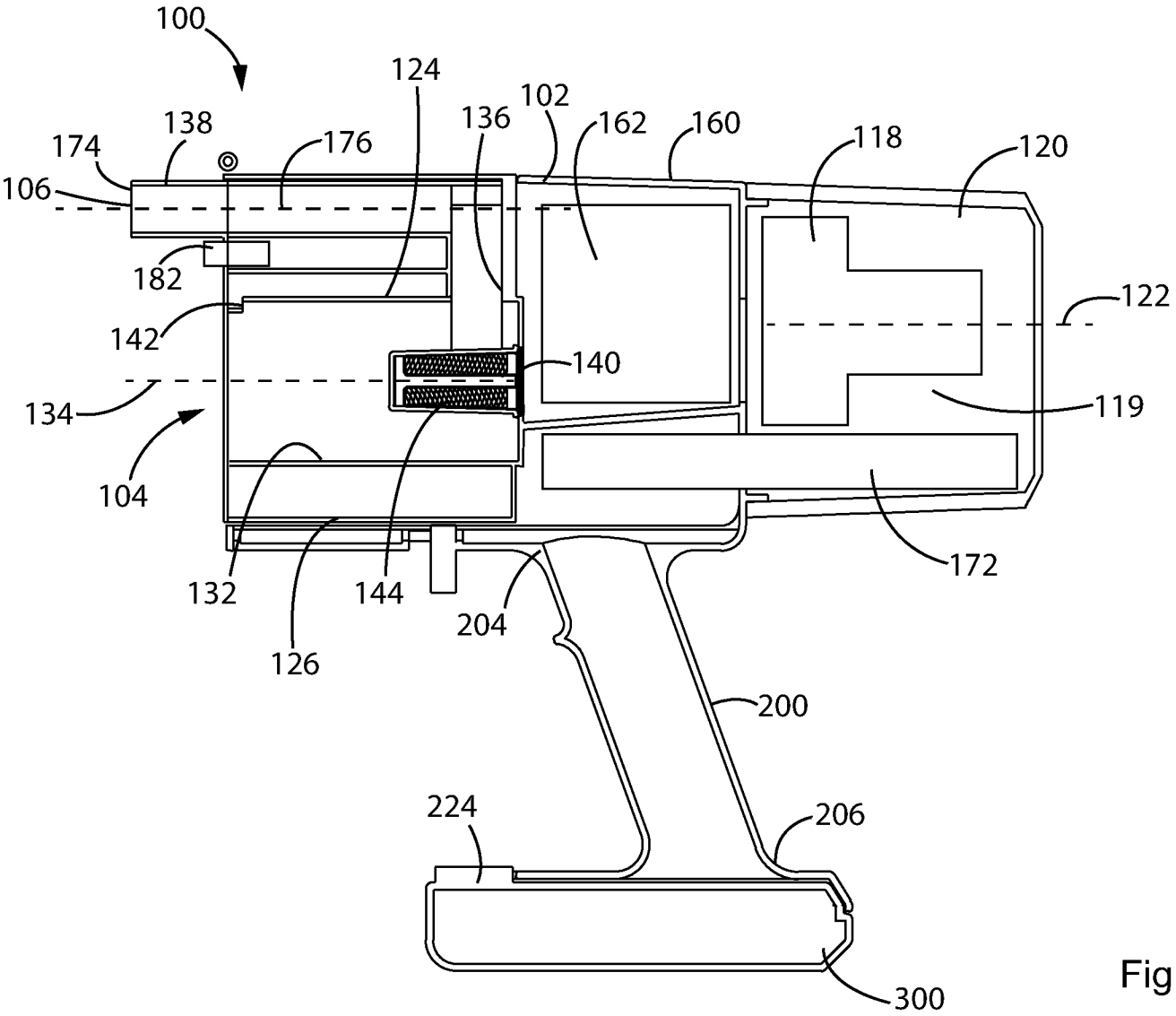

In the illustrated embodiment of FIG. 34, an elongate post-motor filter 172 is provided below suction motor 118 and pre-motor filter housing 160. Elongate post-motor filter 172 may extend longitudinally (in a forward/rearward direction) so that at least a portion of pre-motor filter housing 160 and suction motor 118 overlie elongate post-motor filter 172. As exemplified in FIG. 34, nearly 100% of pre-motor filter housing 160 and 100% suction motor 118 overlie elongate post-motor filter 172.

Figure 28:
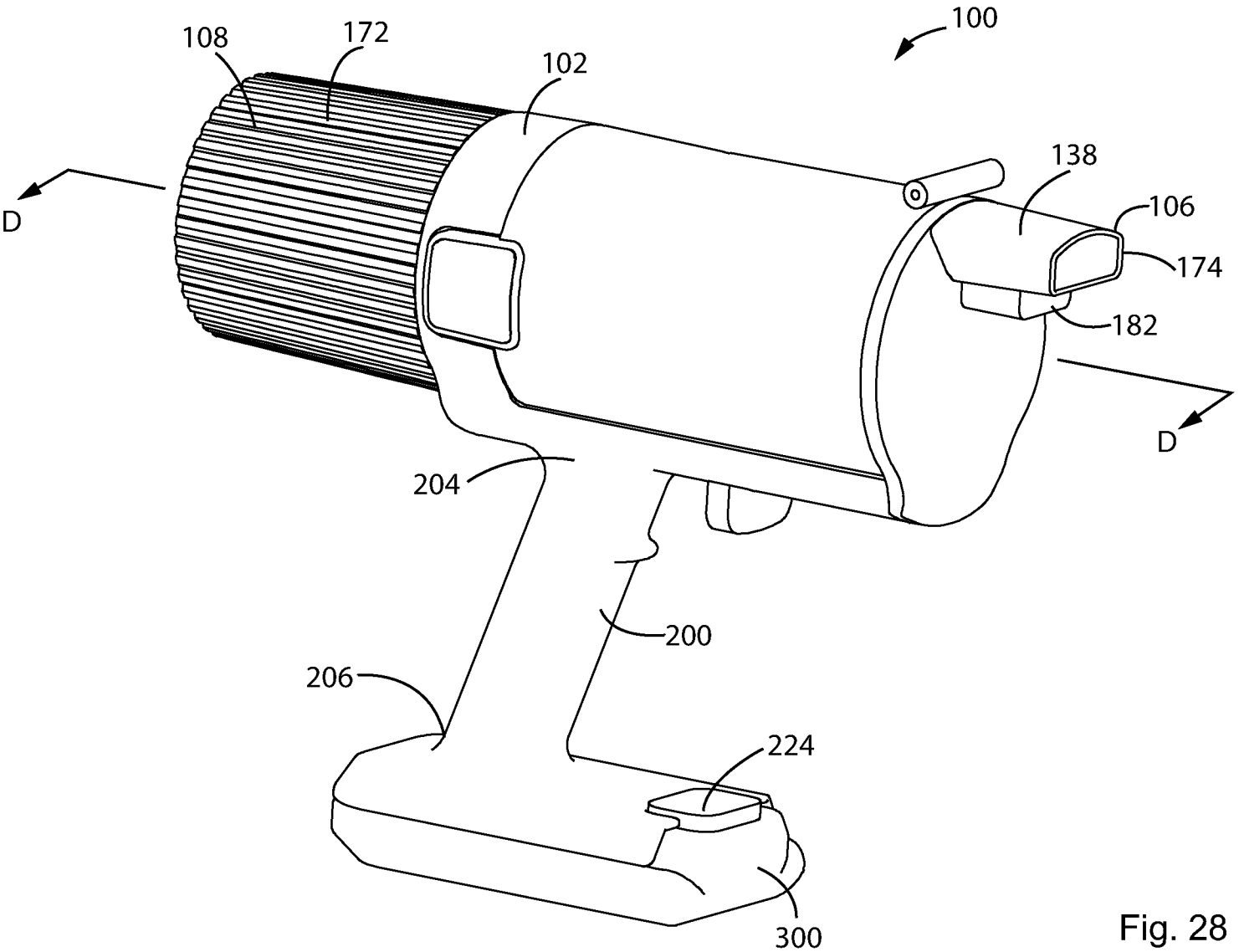
FIG. 28 is a side perspective view of an example hand vacuum cleaner with a pistol grip handle mounted to a pre-motor filter housing and an energy storage member positioned at the lower end of the handle.

As exemplified in FIGS. 28 and 29, suction motor 118 may be surrounded by an annular post-motor filter 172. As with the energy storage pack, it will be appreciated that post-motor filter 172 may be arcuate in shape and may surround, e.g., at least 50% (e.g., 50%, 60%, 70%, 80%, 90%, or more) of suction motor 118. Post-motor filter 172 may be a single contiguous arcuate member or a plurality of discrete arcuate members that may abut (e.g., two semi-circular post-motor filters 172) or which may be spaced apart.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

CLAUSES

Clause Set A

1. A hand vacuum cleaner having a front end and a rear end, the hand vacuum cleaner comprising:
   (a) an air flow path extending from a dirty air inlet to a clean air outlet with a suction motor provided in the air flow path;
   (b) an air treatment member provided in the air flow path at the front end of the hand vacuum cleaner, the air treatment member having an upper end, a lower end, an air inlet provided at the upper end and an air outlet provided at the upper end; (c) a pistol grip handle provided at the rear end of the hand vacuum cleaner, wherein a finger grip area is positioned between the pistol grip handle and a rear side of the air treatment member; and,
   (d) a body portion positioned overlying at least one of the finger grip area and an upper end of the pistol grip handle;

wherein a first energy storage member and the suction motor are provided in the body portion.
2. The hand vacuum cleaner of clause 1, wherein at least a portion of the first energy storage member overlies the upper end of the pistol grip handle.
3. The hand vacuum cleaner of clause 1, wherein at least 50% of the first energy storage member overlies the upper end of the pistol grip handle.
4. The hand vacuum cleaner of clause 3, wherein the suction motor is positioned forward of the first energy storage member.
5. The hand vacuum cleaner of clause 4, wherein at least a portion of the suction motor is positioned overlying the finger grip area.
6. The hand vacuum cleaner of clause 5, wherein at least 50% of the suction motor overlies the upper end of the pistol grip handle.
7. The hand vacuum cleaner of clause 5, wherein the air flow path comprises an inlet passage extending from the dirty air inlet to the air inlet of the air treatment member, the inlet passage has an air flow path, and a projection of the air flow path intersects at least one of the suction motor and the first energy storage member.
8. The hand vacuum cleaner of clause 1, wherein a second energy storage member is provided in the pistol grip handle.
9. The hand vacuum cleaner of clause 1, wherein a power cord is provided in the pistol grip handle.
10. The hand vacuum cleaner of clause 9, wherein a power supply is provided at the upper end of the pistol grip handle.

11. The hand vacuum cleaner of clause 1, wherein the first energy storage member comprises a removable energy storage pack.
12. The hand vacuum cleaner of clause 1, wherein at least a portion of the suction motor is positioned overlying the first energy storage member.
13. The hand vacuum cleaner of clause 12, wherein at least 50% the suction motor is positioned overlying the first energy storage member.
14. The hand vacuum cleaner of clause 12, wherein at least a portion of the suction motor is positioned overlying the finger grip area.
15. The hand vacuum cleaner of clause 13, wherein at least 50% the suction motor is positioned overlying the first energy storage member.
16. The hand vacuum cleaner of clause 14, wherein the air flow path comprises an inlet passage extending from the dirty air inlet to the air inlet of the air treatment member, the inlet passage has an air flow path, and a projection of the air flow path intersects at least one of the suction motor and the first energy storage member.
17. The hand vacuum cleaner of clause 12, wherein a second energy storage member is provided in the pistol grip handle.
18. The hand vacuum cleaner of clause 12, wherein a power cord is provided in the pistol grip handle.
19. The hand vacuum cleaner of clause 18, wherein a power supply is provided at the upper end of the pistol grip handle.
20. The hand vacuum cleaner of clause 12, wherein the first energy storage member comprises a removable energy storage pack.
21. The hand vacuum cleaner of clause 1, wherein the air treatment member comprises a cyclone having a cyclone axis of rotation that intersects the upper end and the lower end of the air treatment member.
22. The hand vacuum cleaner of clause 1, wherein a second energy storage member is provided at a lower end of the pistol grip handle.
23. A hand vacuum cleaner having a front end and a rear end, the hand vacuum cleaner comprising:
(a) an air flow path extending from a dirty air inlet to a clean air outlet with a suction motor provided in the air flow path;
(b) an air treatment member provided in the air flow path at the front end of the hand vacuum cleaner, the air treatment member having an upper end, a lower end, an air inlet provided at the upper end and an air outlet provided at the upper end; (c) a pistol grip handle provided at the rear end of the hand vacuum cleaner, wherein a finger grip area is positioned between the pistol grip handle and a rear side of the air treatment member; and,
(d) a body portion positioned overlying at least one of the finger grip area and an upper end of the pistol grip handle;
wherein the suction motor and a power supply are provided in the body portion.
24. The hand vacuum cleaner of clause 23, wherein the power supply is provided rearward of the suction motor.
25. The hand vacuum cleaner of clause 23, wherein a power cord is provided in the pistol grip handle.
26. The hand vacuum cleaner of clause 23, wherein an energy storage member is provided in the pistol grip handle.
27. The hand vacuum cleaner of clause 23, wherein an energy storage member is provided at a lower end of the pistol grip handle.

Clause Set B

1. A hand vacuum cleaner having a front end and a rear end, the hand vacuum cleaner comprising:
(a) an air flow path extending from a dirty air inlet to a clean air outlet with a suction motor provided in the air flow path;
(b) an air treatment member provided in the air flow path at the front end of the hand vacuum cleaner, the air treatment member having an upper end, a lower end, an air inlet provided at the upper end and an air outlet provided at the upper end;
(c) a pistol grip handle provided at the rear end of the hand vacuum cleaner, wherein a finger grip area is positioned between the pistol grip handle and a rear side of the air treatment member; and,
(d) a body portion positioned overlying at least one of the finger grip area and an upper end of the pistol grip handle;
wherein the suction motor is provided in the body portion and a first energy storage member is positioned forward of the suction motor.
2. The hand vacuum cleaner of clause 1, wherein at least a portion of the first energy storage is positioned overlying at least a portion of the air treatment member.
3. The hand vacuum cleaner of clause 2, wherein at least 50% of the first energy storage is positioned overlying the air treatment member.
4. The hand vacuum cleaner of clause 1, further comprising a pre-motor filter positioned between at least a portion of the first energy storage member and the suction motor.
5. The hand vacuum cleaner of clause 4, wherein at least a portion of the first energy storage is positioned overlying at least a portion of the air treatment member.
6. The hand vacuum cleaner of clause 5, wherein at least 50% of the first energy storage is positioned overlying the air treatment member.
7. The hand vacuum cleaner of clause 5, wherein at least a portion of the pre-motor filter is positioned overlying at least a portion of the air treatment member.
8. The hand vacuum cleaner of clause 5, wherein at least 50% of the pre-motor filter is positioned overlying the air treatment member.
9. The hand vacuum cleaner of clause 7, wherein at least 50% of the pre-motor filter is positioned overlying the air treatment member.
10. The hand vacuum cleaner of clause 1, wherein at least a portion of the suction motor is positioned overlying a second energy storage member.
11. The hand vacuum cleaner of clause 10, wherein at least 50% of the suction motor is positioned overlying the second energy storage member.
12. The hand vacuum cleaner of clause 10, wherein at least a portion of the second energy storage member is positioned overlying the finger grip area and at least a portion of the suction motor is also positioned overlying the finger grip area.
13. The hand vacuum cleaner of clause 10, wherein at least 50% of the second energy storage member is positioned overlying the finger grip area and at least 50% of the suction motor is also positioned overlying the finger grip area.
14. The hand vacuum cleaner of clause 1, wherein at least a portion of the suction motor is positioned overlying the finger grip area.

15. The hand vacuum cleaner of clause 14, wherein at least 50% of the suction motor is positioned overlying the finger grip area.
16. The hand vacuum cleaner of clause 1, wherein a second energy storage member is provided in the pistol grip handle.
17. The hand vacuum cleaner of clause 1, wherein a power cord is provided in the pistol grip handle.
18. The hand vacuum cleaner of clause 17, wherein a power supply is provided at the upper end of the pistol grip handle.
19. The hand vacuum cleaner of clause 1, wherein the first energy storage member comprises a removable energy storage pack.
20. The hand vacuum cleaner of clause 1, wherein the air flow path comprises an inlet passage extending from the dirty air inlet to the air inlet of the air treatment member, the inlet passage has an air flow path, and a projection of the air flow path intersects at least one of the suction motor and the first energy storage member.
21. The hand vacuum cleaner of clause 1, wherein the air treatment member comprises a cyclone having a cyclone axis of rotation that intersects the upper end and the lower end of the air treatment member.

Clause Set C

1. A hand vacuum cleaner having a front end and a rear end, the hand vacuum cleaner comprising:
   (a) an air flow path extending from a dirty air inlet to a clean air outlet with a suction motor provided in the air flow path;
   (b) an air treatment member provided in the air flow path at the front end of the hand vacuum cleaner, the air treatment member having an upper end, a lower end, a front end, a rear end, an air inlet and an air outlet provided at the rear end of the air treatment member;
   (c) a pre-motor filter housing provided rearward of the air treatment member;
   (d) a handle;
   (e) a suction motor housing, which houses the suction motor, positioned rearward of the pre-motor filter housing, the suction motor housing having an upper end, a lower end, a first lateral side extending between the upper and lower ends of the suction motor housing and a second lateral side that is opposed to the first lateral side and that extends between the upper and lower ends of the suction motor housing; and,
   (f) at least one first energy storage member positioned rearward of the pre-motor filter housing and radially outwardly of at least two of the upper end, the lower end, the first lateral side and the second lateral side of the suction motor housing.
2. The hand vacuum cleaner of clause 1 wherein the at least one first energy storage member is positioned radially outwardly of at least three of the upper end, the lower end, the first lateral side and the second lateral side of the suction motor housing.
3. The hand vacuum cleaner of clause 1, wherein the at least one first energy storage member surrounds the suction motor housing.
4. The hand vacuum cleaner of clause 1, wherein the handle is mounted to the suction motor housing.
5. The hand vacuum cleaner of clause 1, wherein the handle is a pistol grip handle.
6. The hand vacuum cleaner of clause 4, wherein the handle is mounted at a location that is radially outward of the suction motor housing.
7. The hand vacuum cleaner of clause 6, wherein the handle is a pistol grip handle.
8. The hand vacuum cleaner of clause 7, further comprising a second energy storage member provided at a lower end of the pistol grip handle.
9. The hand vacuum cleaner of clause 7, further comprising a second energy storage member provided in the pistol grip handle.
10. The hand vacuum cleaner of clause 6 wherein at least one of the at least one first energy storage member is positioned between the handle and the suction motor housing.
11. The hand vacuum cleaner of clause 4, wherein the handle is mounted at a rear end of the suction motor housing.
12. The hand vacuum cleaner of clause 11, wherein the at least one first energy storage member is positioned radially outwardly of at least three of the upper end, the lower end, the first lateral side and the second lateral side of the suction motor housing.
13. The hand vacuum cleaner of clause 11, wherein the at least one first energy storage member surrounds the suction motor housing.
14. The hand vacuum cleaner of clause 11, wherein the handle is a pistol grip handle.
15. The hand vacuum cleaner of clause 14, further comprising a second energy storage member provided at a lower end of the pistol grip handle.
16. The hand vacuum cleaner of clause 14, further comprising a second energy storage member provided in the pistol grip handle.
17. The hand vacuum cleaner of clause 14, wherein at least one of the at least one first energy storage member is positioned between the handle and the suction motor housing.
18. The hand vacuum cleaner of clause 1, wherein the handle is mounted below the air treatment member.
19. The hand vacuum cleaner of clause 18 wherein the handle is a pistol grip handle.
20. The hand vacuum cleaner of clause 19, further comprising a second energy storage member provided at a lower end of the pistol grip handle.
21. The hand vacuum cleaner of clause 19, further comprising a second energy storage member provided in the pistol grip handle.
22. A hand vacuum cleaner having a front end and a rear end, the hand vacuum cleaner comprising:
   (a) an air flow path extending from a dirty air inlet to a clean air outlet with a suction motor provided in the air flow path;
   (b) an air treatment member provided in the air flow path at the front end of the hand vacuum cleaner, the air treatment member having an upper end, a lower end, a front end, a rear end, an air inlet and an air outlet provided at the rear end of the air treatment member;
   (c) a pre-motor filter housing provided rearward of the air treatment member;
   (d) a pistol grip handle;
   (e) a suction motor housing, which houses the suction motor, positioned rearward of the pre-motor filter housing; and,
   (f) at least one first energy storage member positioned rearward of the pre-motor filter housing.
23. The hand vacuum cleaner of clause 22, wherein the suction motor housing has an upper end, a lower end, a first lateral side extending between the upper and lower ends of the suction motor housing and a second lateral side that is opposed to the first lateral side and that extends between the upper and lower ends of the suction motor housing, and the at least one first energy storage member is positioned radially outwardly of at least two of the upper end, the lower end, the first lateral side and the second lateral side of the suction motor housing.

24. The hand vacuum cleaner of clause 22, wherein the at least one first energy storage member surrounds the suction motor housing.

25. The hand vacuum cleaner of clause 22, wherein the pistol grip handle is mounted at a rear end of the suction motor housing.

26. The hand vacuum cleaner of clause 25, wherein the suction motor housing has an upper end, a lower end, a first lateral side extending between the upper and lower ends of the suction motor housing and a second lateral side that is opposed to the first lateral side and that extends between the upper and lower ends of the suction motor housing, and the at least one first energy storage member is positioned radially outwardly of at least two of the upper end, the lower end, the first lateral side and the second lateral side of the suction motor housing.

27. The hand vacuum cleaner of clause 25, wherein the at least one first energy storage member surrounds the suction motor housing.

28. The hand vacuum cleaner of clause 25, wherein the at least one first energy storage member is positioned radially outwardly of the suction motor housing and the hand vacuum cleaner further comprises a second energy storage member provided at a lower end of the pistol grip handle.

29. The hand vacuum cleaner of clause 25, wherein the at least one first energy storage member is positioned radially outwardly of the suction motor housing and the hand vacuum cleaner further comprises a second energy storage member provided in the pistol grip handle.

Clause Set D

1. A hand vacuum cleaner having a front end and a rear end, the hand vacuum cleaner comprising:
   (a) an air flow path extending from a dirty air inlet to a clean air outlet with a suction motor provided in the air flow path;
   (b) an air treatment assembly provided in the air flow path at the front end of the hand vacuum cleaner, the air treatment assembly having an upper end, a lower end, a front end, a rear end, an air inlet and an air outlet provided at the rear end of the air treatment assembly;
   (c) a body portion, which houses the suction motor;
   (d) a pistol grip handle; and,
   (e) a recess which removably receives an energy storage member pack provided at an upper end of the pistol grip handle.

2. The hand vacuum cleaner of clause 1, wherein the upper end of the pistol grip handle is mounted to the body portion.

3. The hand vacuum cleaner of clause 2, wherein the body portion is positioned rearward of the air treatment assembly.

4. The hand vacuum cleaner of clause 2, wherein the pistol grip handle removably receives a supplemental energy storage member.

5. The hand vacuum cleaner of clause 3, wherein the upper end of the pistol grip handle has first and second spaced apart struts which are mounted to the body portion and the recess is provided between the first and second spaced apart struts, a lower surface of the body portion and an upper surface of the pistol grip handle.

6. The hand vacuum cleaner of clause 2, wherein a central axis extends between the front end of the air treatment assembly and the rear end of the air treatment assembly, and the central axis extends through the body portion.

7. The hand vacuum cleaner of clause 6, wherein the air treatment assembly comprises a cyclone and the central axis is a cyclone axis of rotation.

8. The hand vacuum cleaner of clause 1, wherein the upper end of the pistol grip handle is mounted below the air treatment assembly.

9. The hand vacuum cleaner of clause 8, further comprising a second energy storage member provided in the pistol grip handle.

10. The hand vacuum cleaner of clause 8, wherein the upper end of the pistol grip handle is mounted to the lower end of the air treatment assembly.

11. The hand vacuum cleaner of clause 10, further comprising a second energy storage member provided in the pistol grip handle.

12. The hand vacuum cleaner of clause 10, wherein the upper end of the pistol grip handle has first and second spaced apart struts which are mounted to the air treatment assembly and the recess is provided between the first and second spaced apart struts, a lower surface of the air treatment assembly and an upper surface of the pistol grip handle.

13. The hand vacuum cleaner of clause 8, wherein a central axis extends between the front end of the air treatment assembly and the rear end of the air treatment assembly, and the central axis extends through the body portion.

14. The hand vacuum cleaner of clause 13, wherein the air treatment assembly comprises a cyclone and the central axis is a cyclone axis of rotation.

Clause Set E

1. A hand vacuum cleaner having a front end and a rear end, the hand vacuum cleaner comprising:
   (a) an air flow path extending from a dirty air inlet to a clean air outlet with a suction motor provided in the air flow path;
   (b) an air treatment assembly provided in the air flow path at the front end of the hand vacuum cleaner, the air treatment assembly having an upper end, a lower end, a front end, a rear end, an air inlet and an air outlet;
   (c) a pistol grip handle having a front side that receives the fingers of a user, a rear side that receives the palm of a user, and first and second lateral sides which each extend between the front side and the rear side of the pistol grip handle; and,
   (d) a first energy storage member provided on the first lateral side of the pistol grip handle and a second energy storage member provided on the second lateral side of the pistol grip handle.

2. The hand vacuum cleaner of clause 1, wherein the first and second energy storage members are provided at the upper end of pistol grip handle.

3. The hand vacuum cleaner of clause 1, wherein the first and second energy storage members are removably mounted to the pistol grip handle.

4. The hand vacuum cleaner of clause 3, wherein the first and second energy storage members are provided in a single removable battery pack.

5. The hand vacuum cleaner of clause 1, further comprising a body portion that houses the suction motor, and the pistol grip handle is mounted to the body portion.

6. The hand vacuum cleaner of clause 5, wherein the body portion is positioned rearward of the air treatment assembly.

7. The hand vacuum cleaner of clause 6, wherein the body portion further houses a pre-motor filter.
8. The hand vacuum cleaner of clause 6, wherein the pistol grip handle is mounted to a lower surface of the body portion.
9. The hand vacuum cleaner of clause 6, wherein the pistol grip handle is mounted to a rear surface of the body portion.
10. The hand vacuum cleaner of clause 5, wherein a central axis extends between the front end of the air treatment assembly and the rear end of the air treatment assembly, and the central axis extends through the body portion.
11. The hand vacuum cleaner of clause 10, wherein the air treatment assembly comprises a cyclone and the central axis is a cyclone axis of rotation.
12. The hand vacuum cleaner of clause 1, wherein an upper end of the pistol grip handle is mounted below the air treatment assembly.
13. The hand vacuum cleaner of clause 12, wherein the upper end of the pistol grip handle is mounted to the lower end of the air treatment assembly.
14. The hand vacuum cleaner of clause 13, wherein a central axis extends between the front end of the air treatment assembly and the rear end of the air treatment assembly, and the central axis extends through a suction motor housing.
15. The hand vacuum cleaner of clause 14, wherein the air treatment assembly comprises a cyclone and the central axis is a cyclone axis of rotation.

Clause Set F

1. A hand vacuum cleaner having a front end and a rear end, the hand vacuum cleaner comprising:
   (a) an air flow path extending from a dirty air inlet to a clean air outlet with a suction motor provided in the air flow path;
   (b) an air treatment assembly provided in the air flow path at the front end of the hand vacuum cleaner, the air treatment assembly having an upper end, a lower end, a front end, a rear end, an air inlet and an air outlet provided at the rear end of the air treatment assembly;
   (c) a suction motor housing, which houses the suction motor, positioned rearward of the air treatment assembly, the suction motor housing having an upper end, a lower end, a first lateral side extending between the upper and lower ends of the suction motor housing and a second lateral side that is opposed to the first lateral side and that extends between the upper and lower ends of the suction motor housing;
   (d) at least one first energy storage member positioned radially outwardly of the suction motor housing; and,
   (e) a handle mounted to an upper end of the hand vacuum cleaner.
2. The hand vacuum cleaner of clause 1, wherein the handle is mounted to the upper end of the air treatment assembly.
3. The hand vacuum cleaner of clause 2, wherein the at least one first energy storage member is positioned radially outwardly of at least two of the upper end, the lower end, the first lateral side and the second lateral side of the suction motor housing.
4. The hand vacuum cleaner of clause 2, wherein the at least one first energy storage member is positioned radially outwardly of at least three of the upper end, the lower end, the first lateral side and the second lateral side of the suction motor housing.
5. The hand vacuum cleaner of clause 2, wherein the handle includes a pistol grip portion.
6. The hand vacuum cleaner of clause 5, wherein the pistol grip portion is positioned rearward of the at least one energy storage member.
7. The hand vacuum cleaner of clause 5, wherein the pistol grip portion is positioned rearward of the suction motor housing.
8. The hand vacuum cleaner of clause 7, further comprising a pre-motor filter housing provided between the air treatment assembly and the suction motor housing.
9. The hand vacuum cleaner of clause 1, further comprising a pre-motor filter housing provided between the air treatment assembly and the suction motor housing and the handle is mounted to an upper surface of the pre-motor filter housing.
10. The hand vacuum cleaner of clause 9, wherein the at least one first energy storage member is positioned radially outwardly of at least two of the upper end, the lower end, the first lateral side and the second lateral side of the suction motor housing.
11. The hand vacuum cleaner of clause 9, wherein the at least one first energy storage member is positioned radially outwardly of at least three of the upper end, the lower end, the first lateral side and the second lateral side of the suction motor housing.
12. The hand vacuum cleaner of clause 9, wherein the handle includes a pistol grip portion.
13. The hand vacuum cleaner of clause 12, wherein the pistol grip portion is positioned rearward of the at least one energy storage member.
14. The hand vacuum cleaner of clause 12, wherein the pistol grip portion is positioned rearward of the suction motor housing.
15. The hand vacuum cleaner of clause 1, wherein the handle is mounted to the upper end of the suction motor housing.
16. The hand vacuum cleaner of clause 15, wherein the at least one first energy storage member is positioned radially outwardly of at least two of the upper end, the lower end, the first lateral side and the second lateral side of the suction motor housing.
17. The hand vacuum cleaner of clause 15, wherein the at least one first energy storage member is positioned radially outwardly of at least three of the upper end, the lower end, the first lateral side and the second lateral side of the suction motor housing.
18. The hand vacuum cleaner of clause 15, wherein the handle includes a pistol grip portion.
19. The hand vacuum cleaner of clause 18, wherein the pistol grip portion is positioned rearward of the at least one energy storage member.
20. The hand vacuum cleaner of clause 18, wherein the pistol grip portion is positioned rearward of the suction motor housing.
21. The hand vacuum cleaner of clause 20, further comprising a pre-motor filter housing provided between the air treatment assembly and the suction motor housing.

The invention claimed is:

1. A hand vacuum cleaner having a front end and a rear end, the hand vacuum cleaner comprising:
   (a) an air flow path extending from a dirty air inlet to a clean air outlet with a suction motor provided in the air flow path;
   (b) an air treatment member provided in the air flow path at the front end of the hand vacuum cleaner, the air treatment member having an upper end, a lower end, a front end, a rear end, an air inlet and an air outlet, wherein the air outlet is provided at the rear end of the air treatment member;

(c) a pre-motor filter housing, which in operation, houses a pre-motor filter, wherein the pre-motor filter comprises a porous physical filter media and is provided downstream of the air treatment member;

(d) a main body comprising the suction motor; and, (e) a pistol grip handle having an upper end that is mounted to the main body, a lower end, a hand grip portion between the upper and lower ends of the handle, a hand grip portion front side, a hand grip portion rear side, a central handle axis extending centrally through the hand grip portion from a lower end of the hand grip portion to an upper end of the hand grip portion and a rear handle axis that extends along the hand grip portion rear side, wherein the central handle axis extends through the pre-motor filter but not the suction motor and wherein the rear handle axis extends through the hand vacuum cleaner forward of the suction motor, wherein the air flow path comprises an inlet conduit extending from the dirty air inlet to the air inlet of the air treatment member, the inlet conduit having an inlet, a rearwardly positioned outlet and a central inlet conduit axis extending centrally through the conduit from the inlet of the conduit to the outlet of the conduit and the inlet conduit axis intersects the pre-motor filter.

2. The hand vacuum cleaner of claim 1, wherein, when the hand vacuum cleaner is oriented with an upper end of the hand vacuum cleaner positioned above a lower end of the hand vacuum cleaner and the front end of the hand vacuum cleaner positioned forward of the rear end of the hand vacuum cleaner, the main body has an upper surface and a lower surface, and the upper end of the pistol grip handle is mounted to the lower surface of the main body.

3. The hand vacuum cleaner of claim 2, wherein the suction motor is positioned rearward of the pre-motor filter.

4. The hand vacuum cleaner of claim 3, wherein a central axis extends between the front end of the air treatment member and the rear end of the air treatment member, and the central axis extends through the pre-motor filter housing and a suction motor housing.

5. The hand vacuum cleaner of claim 4, wherein the air treatment member comprises a cyclone and the central axis is a cyclone axis of rotation.

6. The hand vacuum cleaner of claim 2, further comprising an energy storage member positioned at the lower end of the pistol grip handle and wherein the inlet conduit is provided at the upper end of the hand vacuum cleaner.

7. The hand vacuum cleaner of claim 6, further comprising a post-motor filter positioned radially outwardly of the suction motor.

8. The hand vacuum cleaner of claim 1, wherein the rear end of the hand vacuum cleaner comprises a rear wall having a power switch and a central axis extends between the front end of the air treatment member and the rear end of the air treatment member, and the central axis extends through the pre-motor filter housing and the rear wall.

9. The hand vacuum cleaner of claim 8, wherein the air treatment member comprises a cyclone and the central axis is a cyclone axis of rotation.

10. The hand vacuum cleaner of claim 8 wherein, when the hand vacuum cleaner is oriented with the central axis positioned substantially parallel to a horizontal surface, the inlet conduit is positioned above the upper end of the air treatment member.

11. The hand vacuum cleaner of claim 1, wherein the suction motor is positioned rearward of the pre-motor filter.

12. The hand vacuum cleaner of claim 11, wherein a central axis extends between the front end of the air treatment member and the rear end of the air treatment member, and the central axis extends through the pre-motor filter housing and a suction motor housing.

13. The hand vacuum cleaner of claim 1, wherein the air treatment member comprises an air treatment chamber and the hand vacuum cleaner further comprises a dirt collection chamber positioned radially from the air treatment chamber.

14. The hand vacuum cleaner of claim 13, further comprising a post-motor filter positioned radially outwardly of the suction motor.

15. The hand vacuum cleaner of claim 1, wherein the rear end of the hand vacuum cleaner comprises a rearward facing wall having a power switch.

16. The hand vacuum cleaner of claim 15, further comprising a post-motor filter positioned radially outwardly of the suction motor.

17. The hand vacuum cleaner of claim 1, further comprising a post-motor filter positioned radially outwardly of the suction motor.

18. A hand vacuum cleaner having a front end and a rear end, the hand vacuum cleaner comprising:

(a) an air flow path extending from a dirty air inlet to a clean air outlet with a suction motor provided in the air flow path;

(b) an air treatment member provided in the air flow path at the front end of the hand vacuum cleaner, the air treatment member having an upper end, a lower end, a front end, a rear end, an air inlet and an air outlet, wherein the air outlet is provided at the rear end of the air treatment member;

(c) a main body comprising a pre-motor filter housing and the suction motor, wherein in operation the pre-motor filter housing houses a pre-motor filter, the pre-motor filter comprises a porous physical filter media and a rear end of the pre-motor filter housing is provided rearward of the air treatment member, wherein the suction motor is positioned rearward of the pre-motor filter; and, (d) a pistol grip handle having an upper end that is mounted to the main body and a longitudinally extending hand grip portion wherein a central longitudinal axis extends centrally through a longitudinal length of the hand grip portion, wherein the central longitudinal axis extends through the pre-motor filter but not the suction motor, wherein the air flow path comprises an inlet conduit extending from the dirty air inlet to the air inlet of the air treatment member, the inlet conduit having an inlet, a rearwardly positioned outlet and a central inlet conduit axis extending centrally through the conduit from the inlet of the conduit to the outlet of the conduit and the inlet conduit axis intersects the pre-motor filter but not the suction motor.

19. The hand vacuum cleaner of claim 18, further comprising an energy storage member positioned at a lower end of the pistol grip handle.

20. The hand vacuum cleaner of claim 19, wherein the inlet conduit is provided at an upper end of the hand vacuum cleaner.

21. The hand vacuum cleaner of claim 20, further comprising a post-motor filter positioned radially outwardly of the suction motor.

22. The hand vacuum cleaner of claim 18, wherein the air treatment member comprises an air treatment chamber and the hand vacuum cleaner further comprises a dirt collection chamber positioned radially from the air treatment chamber.

23. The hand vacuum cleaner of claim 22, further comprising a post-motor filter positioned radially outwardly of the suction motor.

24. The hand vacuum cleaner of claim 18, wherein the rear end of the hand vacuum cleaner comprises a rearward facing wall having a power switch.

25. The hand vacuum cleaner of claim 24, further comprising a post-motor filter positioned radially outwardly of the suction motor.

26. The hand vacuum cleaner of claim 18, further comprising a post-motor filter positioned radially outwardly of the suction motor.

27. The hand vacuum cleaner of claim 18, wherein a rear handle axis, which extends along a rear side of the hand grip portion, extends through the hand vacuum cleaner forward of the suction motor.

* * * * *